US012331508B2

(12) United States Patent
Lippert

(10) Patent No.: US 12,331,508 B2
(45) Date of Patent: Jun. 17, 2025

(54) FOLDING FRAMES FOR BUILDING CONSTRUCTION

(71) Applicant: Stephen Lee Lippert, Honolulu, HI (US)

(72) Inventor: Stephen Lee Lippert, Honolulu, HI (US)

( * ) Notice: Subject to any disclaimer, the term of this patent is extended or adjusted under 35 U.S.C. 154(b) by 492 days.

(21) Appl. No.: 17/949,897

(22) Filed: Sep. 21, 2022

(65) Prior Publication Data

US 2023/0095414 A1 Mar. 30, 2023

Related U.S. Application Data

(60) Provisional application No. 63/400,684, filed on Aug. 24, 2022, provisional application No. 63/247,246, filed on Sep. 22, 2021.

(51) Int. Cl.
*E04B 1/344* (2006.01)
*E04B 1/00* (2006.01)

(52) U.S. Cl.
CPC ..... *E04B 1/344* (2013.01); *E04B 1/3445* (2013.01)

(58) Field of Classification Search
CPC ..... E04B 1/344; E04B 1/3445
USPC ..... 52/263
See application file for complete search history.

(56) References Cited

U.S. PATENT DOCUMENTS 1,678,971 A * 7/1928 Bergesen, Sr. ..... E04G 1/06 52/114
2,394,221 A * 2/1946 Waltz ..... E04G 1/34 182/12
2,642,825 A * 6/1953 McElhone ..... E04B 1/3441 52/641
3,136,092 A * 6/1964 Contini ..... E04H 6/08 52/236.7
3,189,949 A 6/1965 Hurkamp
3,233,374 A * 2/1966 Micheels ..... E04H 5/02 52/234
3,296,752 A 1/1967 Philp
(Continued)

FOREIGN PATENT DOCUMENTS

CZ 387692 A3 * 7/1993 ..... E04G 1/06
WO WO-2005052282 A1 * 6/2005 ..... E04G 1/22

OTHER PUBLICATIONS

Lindly, Williams, Jacobson, "Panelized Units Speed Construction", pp. 26-29, Modern Steel Construction, Sep. 2010.

*Primary Examiner* — Brian D Mattei
*Assistant Examiner* — Joseph J. Sadlon

(57) ABSTRACT

A modular frame assembly for constructing a building frame includes a deck assembly having longitudinal frame members covered by a metal deck and at least two vertical support members rotatably coupled to the deck assembly. Vertical support members have flanges and an intervening web or may alternatively be formed from hollow square or round cylindrical tubes. Vertical support members may be rotatably coupled to flat sides of the longitudinal frame members or may alternately be coupled to the ends of the longitudinal frame members by intervening vertical support member connectors. Vertical support members may be rotated to fold the frame assembly for transport and unfolded and affixed to longitudinal frame members to form part of a building frame. Some embodiments include more than one frame assembly affixed along their sides to one another and/or stacked one atop the other.

27 Claims, 36 Drawing Sheets

(56) References Cited

U.S. PATENT DOCUMENTS 3,336,717 A * 8/1967 Ward, Jr. ..... E04B 1/344 52/645
3,354,596 A * 11/1967 Schafer ..... E04G 1/34 52/646
3,490,807 A * 1/1970 Sare ..... B60P 3/34 52/64
3,517,962 A * 6/1970 Bassett ..... B60P 3/34 296/168
3,638,380 A * 2/1972 Perri ..... E04B 1/34807 52/79.12
3,707,811 A * 1/1973 Hampson ..... E04B 1/343 52/79.8
3,744,193 A * 7/1973 Lau ..... E04B 1/34807 414/277
3,769,772 A * 11/1973 Oetiker ..... A47C 17/64 52/646
3,788,018 A * 1/1974 Simmons ..... E04F 11/02 52/127.2
3,832,956 A * 9/1974 Briel, Jr. ..... E04B 1/3445 108/55.1
3,968,618 A 7/1976 Johnson
4,015,377 A * 4/1977 Jastrzebski ..... E04B 1/3441 52/236.8
4,115,975 A * 9/1978 Bliss ..... E04B 1/19 52/646
4,335,557 A * 6/1982 Morton ..... E04B 1/164 52/250
4,656,799 A * 4/1987 Maryon ..... E04H 1/06 52/30
4,736,557 A * 4/1988 Maryon ..... E04H 1/00 52/30
4,779,514 A * 10/1988 Prigmore ..... E04B 1/3445 52/79.5
4,813,201 A * 3/1989 Parsons ..... E04H 3/12 52/263
4,831,807 A * 5/1989 Bolt ..... E04B 1/3445 403/53
4,918,889 A * 4/1990 Lundstrom ..... E04H 1/04 52/234
4,926,591 A * 5/1990 Buijs ..... E04B 1/3447 52/63
5,038,532 A * 8/1991 Shahinpoor ..... E04B 1/3441 52/109
5,050,358 A * 9/1991 Vladislavic ..... E04B 1/161 52/250
5,060,426 A * 10/1991 Jantzen ..... E04B 1/344 52/587.1
5,182,884 A * 2/1993 Tarics ..... E04B 1/0023 52/234
5,228,258 A * 7/1993 Onoda ..... B64G 99/00 343/915
5,319,904 A * 6/1994 Pascoe ..... E04H 1/1205 52/79.5
5,331,778 A * 7/1994 Mazpule ..... E04B 1/34321 52/79.5
5,692,625 A * 12/1997 Filipescu ..... A47F 5/108 211/85.5
5,960,593 A 10/1999 Murphy
5,966,956 A * 10/1999 Morris ..... E04B 1/3444 52/79.5
6,014,842 A * 1/2000 Matsubara ..... E04C 2/384 52/234
6,318,043 B1 * 11/2001 Johnson ..... E04H 1/1205 52/643
6,401,422 B1 6/2002 Olden
6,607,421 B1 * 8/2003 Rossi ..... A63H 3/52 52/79.5
7,021,242 B2 * 4/2006 Axelrod ..... A01K 1/0245 119/498
7,637,070 B2 * 12/2009 Hawes ..... E04G 21/30 52/843
7,647,742 B2 * 1/2010 Han ..... E04C 3/34 52/741.1
8,505,599 B2 8/2013 Williams
8,528,294 B2 * 9/2013 Vanker ..... E04C 3/40 52/270
8,800,229 B2 * 8/2014 Rahimzadeh ..... E04B 5/40 52/251
8,875,445 B2 * 11/2014 Lippert ..... E04B 1/34838 52/79.2
8,919,072 B2 * 12/2014 Han ..... E04B 1/4121 52/649.3
9,016,001 B2 * 4/2015 Heger ..... E04B 1/34384 52/79.5
9,441,372 B2 * 9/2016 Swenters ..... E04C 3/32
10,006,195 B2 * 6/2018 Matsuoka ..... F16M 11/38
10,400,468 B2 * 9/2019 Beard ..... E04H 9/027
10,689,840 B2 * 6/2020 Bonlin ..... E04H 1/1205
10,822,786 B2 * 11/2020 Jackson ..... E04B 2/58
11,459,755 B2 * 10/2022 Strickland ..... E04B 5/04
11,536,018 B2 * 12/2022 Peterson ..... E04B 7/045
11,680,401 B2 * 6/2023 Carrion ..... E04B 1/34 52/250
12,110,683 B2 * 10/2024 Lim ..... E04B 5/328
12,116,771 B2 * 10/2024 Rafezy ..... E04B 1/34384
2002/0020141 A1 * 2/2002 Payer ..... E04B 1/24 52/741.11
2003/0041555 A1 * 3/2003 Scallan ..... E04B 1/34 52/745.2
2004/0250482 A1 12/2004 Jacobson
2005/0066588 A1 3/2005 Stapleton
2005/0066609 A1 3/2005 Olah
2006/0248809 A1 11/2006 Rulquin
2011/0047889 A1 3/2011 Gad
2011/0179732 A1 * 7/2011 Ermer ..... F24F 11/0001 454/333
2012/0279142 A1 11/2012 Michaud
2013/0055671 A1 3/2013 Bruce
2014/0115976 A1 5/2014 Lippert
2015/0068138 A1 * 3/2015 Rubel ..... E04B 5/023 52/223.6
2015/0218794 A1 * 8/2015 Martyn ..... E04B 1/343 52/79.5
2015/0252559 A1 9/2015 Vieira Lopes
2016/0153183 A1 6/2016 Richter
2016/0201313 A1 * 7/2016 Kawazoe ..... E04G 5/046 52/745.1
2017/0021998 A1 1/2017 Flint
2017/0370091 A1 12/2017 Dragan
2018/0106031 A1 4/2018 Coombes
2018/0119432 A1 * 5/2018 Finlay ..... E04G 5/16
2018/0347175 A1 * 12/2018 Anderson ..... E04B 1/3483
2020/0239225 A1 7/2020 Van Der Berg
2021/0332584 A1 * 10/2021 Johnson ..... E04B 1/3483
2022/0154444 A1 5/2022 Ellen
2022/0205235 A1 6/2022 Chapman
2022/0213684 A1 * 7/2022 Besjak ..... E04C 2/26
2022/0228361 A1 7/2022 Hoddinott
2022/0403647 A1 12/2022 Hancock
2023/0175249 A1 6/2023 Marchionno

* cited by examiner

View A

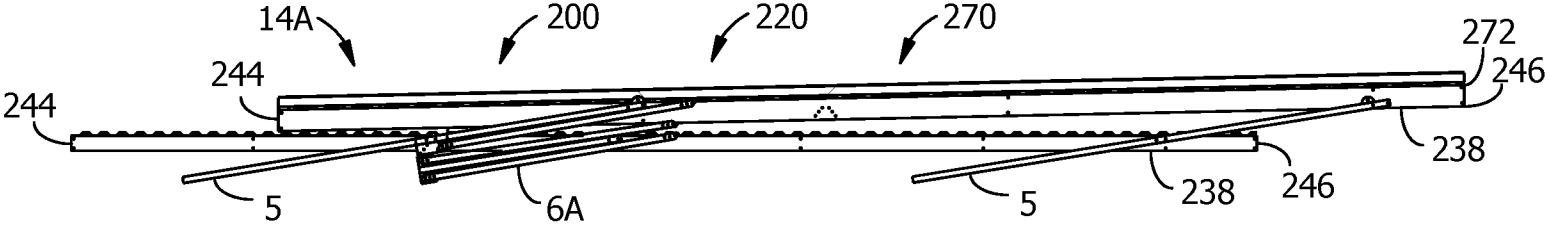
Fig. 18
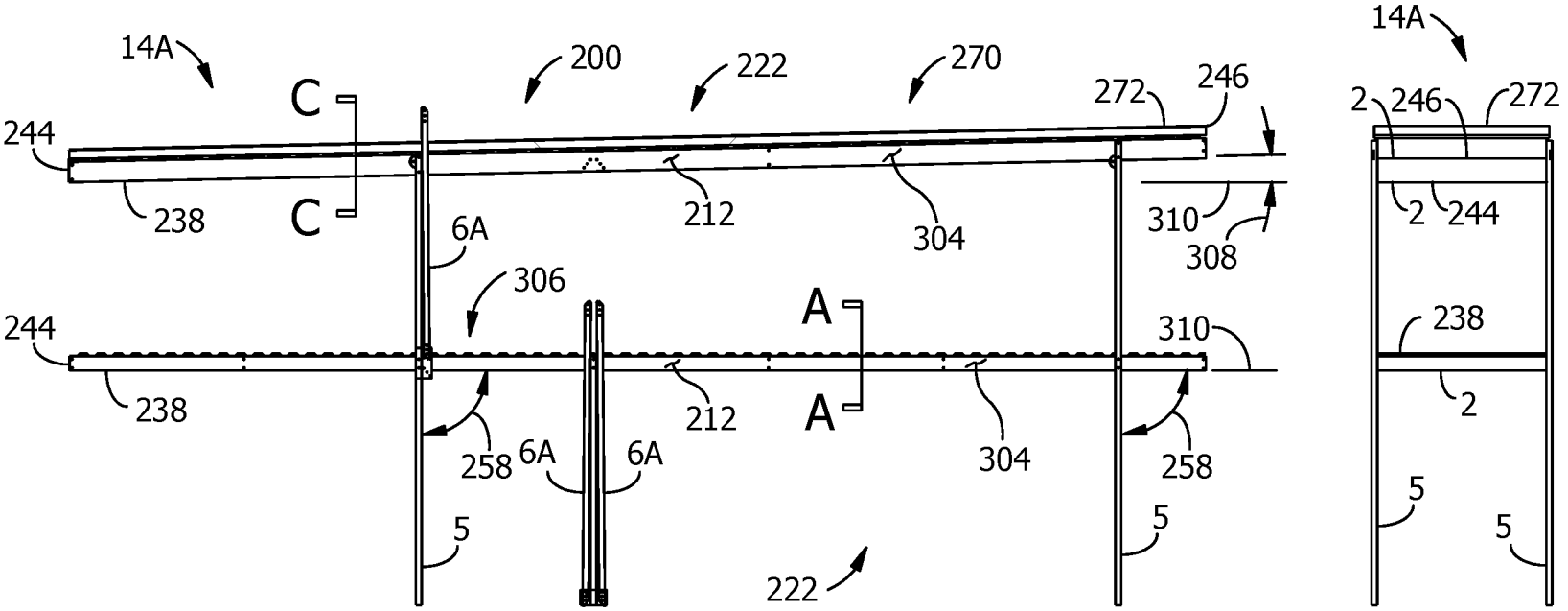
Fig. 19
Fig. 20

View G

View H

Section B-B

Section A-A

Section D-D

Section C-C

View B
VIEW C
200
202
220
122
14
242
244
240
16
115
108
109
112
111
114
133
134
213
212
9
8
5
4
4A
2
1
3
E View C View D View E Section E-E View F

FOLDING FRAMES FOR BUILDING CONSTRUCTION

FIELD OF THE INVENTION

Embodiments are related to buildings constructed with floor decks supported by horizontal structural members such as beams, channels, or joists attached to columns or other vertical structural members.

BACKGROUND

A building may be constructed with a load-bearing framework providing structural support for building floors, walls, exterior cladding, the building roof, and equipment installed in the building. The framework may include horizontal beams, channels, or joists attached to vertical columns and may be constructed piece by piece at the building site, with columns lifted one at a time and secured in a vertical orientation, beams lifted and joined horizontally one at a time to columns, and so on. Floor decks spanning open spaces between beams and columns may be attached to the framework to form structural supports for building floors. A floor deck may include decking material joined to beams or joists and may include other structural supports. Decking material for a floor deck may include, for example, corrugated metal sheets, metal channels placed against one another, or other materials.

Floor decks may be built piece by piece at the same building site where the framework is being assembled, moving the component pieces of the floor deck up to a location in the framework where a building floor is to be installed, then building the floor deck by attaching the component pieces to one another and to the framework. After being attached to the framework, a floor deck may provide a work surface for construction of other floor decks and other parts of the building. However, piece-by-piece assembly of the framework and floor decks at a building site is inefficient and exposes construction workers to safety hazards such as falls from high places, injuries from columns, beams, and decking material being moved into position during construction, and injuries from working in cramped or uncomfortable postures.

Some improvements in safety and efficiency have been obtained by assembling floor deck modules at ground level or prefabrication in a shop, then lifting the floor deck modules into position against the previously installed columns and beams of the building framework, and attaching the floor deck modules to the building framework. Each floor deck module may include decking material and beams, joists or other structural supports for a building floor. Floor deck modules may be attached to one another and to the framework to construct a building floor. A floor deck module assembled into a structural unit before being lifted and attached to a framework may be referred to as a panelized floor deck. Workers assembling panelized floor decks at ground level may be exposed to fewer fall risks and other safety hazards associated with piece-by-piece assembly of floor decks in the framework, but potentially hazardous work high above ground may still be needed during attachment of each panelized floor deck to the earlier-installed columns and beams of the framework.

After a floor deck has been attached to the building framework, concrete may be poured onto the decking material to form a composite floor deck. Passages, conduits, and openings for mechanical, electrical, plumbing, and fire protection (MEP/FP) components may be positioned under each floor deck. Other passages and openings may be made by cutting through concrete floor layers or other parts of the composite floor deck after the concrete sets. Electrical wiring, conduit, piping, ductwork, and other MEP/FP components may then be placed under the composite floor deck after the floor deck is attached to the framework.

Workers installing MEP/FP under floor metal decks with concrete topping slabs may repeatedly climb and reposition ladders, manlifts, or scaffolding to install MEP/FP components under or within a composite metal floor deck above their heads. MEP/FP components to be installed under a floor deck must be carried to the work area in the building from a staging area outside the building, cut or trimmed in place, and suspended from the underside of the floor deck. The construction delays and labor time required to complete such labor-intensive and physically demanding construction methods may cause the cost of MEP/FP installation to exceed the cost of constructing the building frame.

Some operations for completing construction of the building framework and floor decks may not be started until earlier steps have been completed. For example, the building framework may first be constructed piece-by-piece at the building site, then floor decks assembled piece-by-piece at elevated locations in the framework or possibly fabricated as panelized floor decks and lifted into the framework. After floor decks are installed, MEP/FP may be installed under the floor decks, possibly after waiting for concrete poured on the floor decks to cure. A delay in completion of any one of these logistically complex, labor-intensive operations can delay the start of subsequent steps and may delay the completion of the entire building.

SUMMARY

A frame assembly for a building includes a deck assembly. A deck assembly includes a first end, a second end longitudinally opposite the first end, a first side extending from the first end to the second end, and a second side transversely opposite first side; a first longitudinal frame member extending along the first side from the first end to the second end; a second longitudinal frame member extending along the second side from the first end to the second end; a metal deck in contact with the first longitudinal frame member and the second longitudinal frame member, and with the metal deck extending from the first end to the second end. The frame assembly further includes a first vertical support member rotatably coupled to the first longitudinal frame member; a second vertical support member rotatably coupled to the second longitudinal frame member transversely opposite the first vertical support member; and a third vertical support member rotatably coupled to the first longitudinal frame member.

The frame assembly for a building optionally further includes the first longitudinal frame member and the second longitudinal frame member, each including a beam web; a fourth vertical support member rotatably coupled to the second longitudinal frame member; the first, second, third, and fourth vertical support members each including a column flange and a column web joined to the column flange; a hinge bolt passing through the column flange of the first vertical support member and the beam web of the first longitudinal frame member; a second hinge bolt passing through the column flange of the second vertical support member and the beam web of the second longitudinal frame member; a third hinge bolt passing through the column flange of the third vertical support member and the beam web of the first longitudinal frame member; and a fourth hinge bolt passing through the column flange of the fourth vertical support member and the beam web of the second longitudinal frame member.

The frame assembly for a building optionally includes the deck assembly as a first deck assembly; and a second of the deck assembly rotatably coupled to the frame assembly between the first deck assembly and an upper end of the first vertical support member. The frame assembly with a second deck assembly optionally further includes a fifth hinge bolt passing through the column flange of the first vertical support member and the beam web of the first longitudinal frame member of the second deck assembly; a sixth hinge bolt passing through the column flange of the second vertical support member and the beam web of the second longitudinal frame member of the second deck assembly; a seventh hinge bolt passing through the column flange of the third vertical support member and the beam web of the first longitudinal frame member of the second deck assembly; and an eighth hinge bolt passing through the column flange of the fourth vertical support member and the beam web of the second longitudinal frame member of the second deck assembly.

The frame assembly optionally includes a third of the deck assembly rotatably coupled to the frame assembly between the second deck assembly and the upper end of the first vertical support member. In some embodiments, the first deck assembly forms a part of a building floor, the second deck assembly forms a part of a next higher building floor, and the first longitudinal frame member of the first deck assembly is parallel to the first longitudinal frame member of the second deck assembly. In some embodiments, the first deck assembly forms a part of a building floor, the second deck assembly includes a waterproof roof membrane; and the second deck assembly forms a part of a building roof.

Some embodiments of the frame assembly further include a brace rotatably coupled to the first longitudinal frame member of the first deck assembly, the brace extending to the first longitudinal frame member of the second deck assembly.

The frame assembly optionally includes a folded frame configuration with the second deck assembly optionally in contact with the first deck assembly. The frame assembly optionally includes a fully unfolded frame configuration with the first and third vertical support members perpendicular to the first longitudinal frame member of the first deck assembly and the second and fourth vertical support members perpendicular to the second longitudinal frame member of the first deck assembly. The fully unfolded frame configuration optionally includes the first longitudinal frame member of the first deck assembly positioned parallel to a horizontal reference; and the first longitudinal frame member of the second deck assembly tilted to an angle greater than one degree relative to the horizontal reference. The fully unfolded frame configuration further optionally includes a first bolt passing through the column flange of the first vertical support member and the beam web of the first longitudinal frame member of the first deck assembly; a second bolt passing through the column flange of the second vertical support member and the beam web of the second longitudinal frame member of the first deck assembly; a third bolt passing through the column flange of the third vertical support member and the beam web of the first longitudinal frame member of the first deck assembly; and a fourth bolt passing through the column flange of the fourth vertical support member and the beam web of the second longitudinal frame member of the first deck assembly, wherein the first, second, third, and fourth bolts nonrotatably affix the first, second, third, and fourth vertical support members to the first deck assembly.

The first vertical support member and the second vertical support member are optionally rotatably coupled to the first deck assembly at a separation distance from the first end in a range from one-quarter to one-half a longitudinal dimension of the first deck assembly, thereby forming a cantilevered segment of the first deck assembly.

In some embodiments the frame assembly is a first frame assembly, further including a second of the frame assembly affixed to the first frame assembly. An embodiment with a first frame assembly affixed to a second frame assembly optionally further includes the fourth vertical support member of the first frame assembly affixed to the cantilevered segment of the second frame assembly; the second vertical support member of the first frame assembly affixed to the second longitudinal frame member of the second frame assembly between the second vertical support member and the fourth vertical support member of the second frame assembly; and the fourth vertical support member of the second frame assembly affixed to the cantilevered segment of the first frame assembly.

In some embodiments, the frame assembly is a first frame assembly, further including a second of the frame assembly affixed to the first frame assembly with the upper end of the first vertical support member of the first frame assembly attached to a lower end of the first vertical support member of the second frame assembly.

Some embodiments of the deck assembly optionally include: a first transverse frame member attached at the first end to the first longitudinal frame member and the second longitudinal frame member; and a second transverse frame member attached at the second end to the first longitudinal frame member and the second longitudinal frame member.

The frame assembly optionally includes a vertical support connector. The vertical support connector includes a connector plate; a hinge bolt aperture formed through the connector plate; a bolt aperture formed through the connector plate; a gap formed in the connector plate to avoid connector contact with the beam flange when the column is rotated; and a stop formed on the connector plate at an end opposite the flange gap. The stop shape in the connector is located to terminate the column rotation towards the beam such that the connector bolt holes align with the beam bolt holes.

A frame assembly with a vertical support connector optionally further includes a first of the vertical support connector strongly affixed to the column flange of the first vertical support member, the hinge bolt passing through the hinge bolt aperture of the first vertical support connector and the beam web of the first longitudinal frame member; a second of the vertical support connector strongly affixed to the column flange of the second vertical support member, the second hinge bolt passing through the hinge bolt aperture of the second vertical support connector and the beam web of the second longitudinal frame member; a third of the vertical support connector strongly affixed to the column flange of the third vertical support member, the third hinge bolt passing through the hinge bolt aperture of the third vertical support connector and the beam web of the first longitudinal frame member; and a fourth of the vertical support connector strongly affixed to the column flange of the fourth vertical support member, the fourth hinge bolt passing through the hinge bolt aperture of the fourth vertical support connector and the beam web of the second longitudinal frame member.

The frame assembly optionally further includes a transverse beam having a beam flange and a beam web attached to the beam flange; and a fifth of the vertical support connector strongly affixed to the column web of the first vertical support member, another of the hinge bolt passing through the hinge bolt aperture of the fifth vertical support connector and the beam web of the transverse beam.

The frame assembly with a vertical support connector and a transverse beam optionally further includes a first centerline passing midway through a thickness dimension of the column web of the first vertical support member; a second centerline passing midway through a thickness dimension of the beam web of the transverse beam; and the fifth column connector positioned on the first vertical support member with the first centerline colinear with the second centerline.

The frame assembly with a vertical support connector optionally further includes a first centerline passing midway through a thickness dimension of the column web of the first vertical support member; a second centerline passing midway through a thickness dimension of the beam web of the first longitudinal frame member; and the first vertical support connector positioned on the first vertical support member with the first centerline colinear with the second centerline.

Some embodiments of the frame assembly further include the first longitudinal frame member and the second longitudinal frame member each including a beam web; the first vertical support member and the second vertical support member each formed as a cylinder or alternatively as a square tube; a vertical support connector, including a connector plate, a hinge bolt aperture formed through the connector plate, a bolt aperture formed through the connector plate, a flange gap formed in the connector plate, and an optional flange stop formed on the connector plate at an end opposite the flange gap; a first of the vertical support connector strongly affixed to the first vertical support member with a first hinge bolt passing through the hinge bolt aperture of the first vertical support connector and the beam web of the first longitudinal frame member; and a second of the vertical support connector strongly affixed to the second vertical support member with a second hinge bolt passing through the hinge bolt aperture of the second vertical support connector and the beam web of the second longitudinal frame member.

A frame assembly with the first vertical support member formed as cylinder or alternatively as a square tube further optionally includes a first centerline passing through a radial center of the first vertical support member; a second centerline passing midway through a thickness dimension of the beam web of the first longitudinal frame member; and the first vertical support connector positioned on the first vertical support member with the first centerline colinear with the second centerline.

For some embodiments of the frame assembly, the third vertical support member includes a hollow form for a concrete wall, the third vertical support member extending transversely from the first longitudinal frame member to the second longitudinal frame member; a third of the vertical support connector strongly affixed to the third vertical support member and rotatably coupled to the beam web of the first longitudinal frame member; and a fourth of the vertical support connector strongly affixed to the third vertical support member and rotatably coupled to the beam web of the second longitudinal frame member.

For embodiments of a frame assembly having the third vertical support member including a hollow form for a concrete wall, wherein the frame assembly is a first frame assembly, and further including a second of the frame assembly affixed to the first frame assembly with the first vertical support member of the first frame assembly affixed to the first vertical support member of the second frame assembly, the second vertical support member of the first frame assembly affixed to the second vertical support member of the second frame assembly, and the third vertical support member of the first frame assembly affixed to the third vertical support member of the second frame assembly. The frame assembly optionally further includes a transverse frame member affixed to the first vertical support member and the second vertical support member.

The frame assembly preferably includes the longitudinal frame member having a width dimension and a hinge bolt passing through the vertical support connector and the longitudinal frame member a maximum longitudinal distance equal to a mathematical product of 0.375 and the width dimension of the longitudinal frame member. The frame assembly optionally further includes the hinge bolt passing through the vertical support member and the longitudinal frame member a maximum vertical distance equal to a mathematical product of 0.25 and the width dimension of the longitudinal frame member.

BRIEF DESCRIPTION OF THE DRAWINGS

FIG. 18 is a side view of an example folded frame configuration having columns at bolt groups that were not occupied by columns in the examples of FIGS. 16-17. It is also an example frame assembly with a roof deck and a floor assembly, and further illustrating an example of a hinge brace folded for transport.

FIG. 19 continues the example of FIGS. 16-18, showing a side view of the example frame assembly in its fully unfolded configuration with the lower deck assembly parallel to a horizontal reference and the upper deck assembly configured as a roof deck and the upper deck tilted by a selected angle to the horizontal reference. In the example of FIG. 19, the frame long beams will be positioned adjacent to frame columns (ref. FIG. 17) and attached with bolts. The example frame columns of FIG. 19 adjacent to the frame long beam(s) (ref. FIG. 17) are attached by bolts in the example figures. Optional braces are connected by bolts to columns with connector plates.

FIG. 20 shows a view toward an end of the example frame assembly with a roof deck of FIGS. 16-19.

FIGS. 23-26 are applicable to all disclosed frame assembly embodiments having a deck assembly rotatably coupled to the side of a column.

FIG. 30 is applicable to all example frame assembly embodiments including a roof deck.

DESCRIPTION

Figure 1:
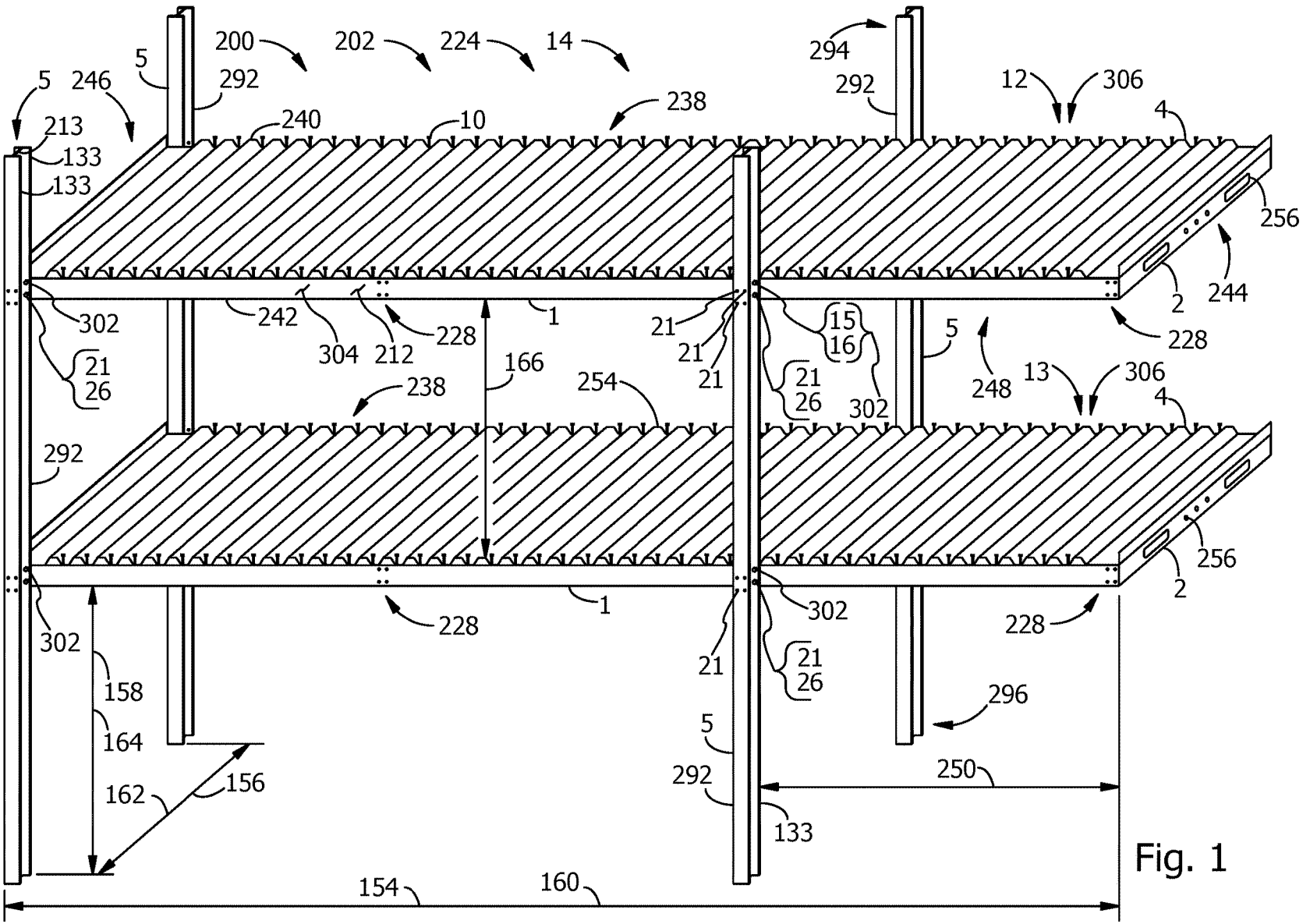
FIG. 1 is a pictorial view of an example frame assembly having two deck assemblies attached to four vertical support members, and further showing an example of deck assemblies with cantilevered segments.

Example apparatus embodiments provide a modular structure forming part of the load-bearing building frame of a building having one or more building floors elevated above a ground-level floor. The modular structure, referred to herein as a frame assembly, includes a deck assembly rotatably coupled to three vertical support members in some embodiments and four vertical support members in other embodiments. Each vertical support member is rotatable independently of the others to selectively place a frame assembly in a folded configuration, a partially unfolded configuration, or a fully unfolded configuration. The deck assembly for a frame assembly includes decking material, optional MEP/FP components, support structures for the decking material and MEP/FP components, and apertures for accepting bolts and other components for rotatable connections to the vertical support members. The example folded frames in the figures include 4 columns, but may alternatively have from 2 to 8 columns.

The folded configuration for a frame assembly reduces an overall height dimension of the frame assembly and is advantageous for transporting a frame assembly from a manufacturing site for frame assemblies to a building site where a building is being constructed. Placing a frame assembly in the fully unfolded configuration causes vertically adjacent deck assemblies to be separated from one another by a preferred vertical separation distance between adjacent building floors in the building frame. Attaching two or more fully unfolded frame assemblies to one another forms the building frame. Unfolded frame assemblies may be attached laterally on the long or short sides of the frame to one another to form building floors having length and width dimensions that are multiples of the length and width dimensions of one frame assembly. Frame assemblies may optionally be stacked vertically one atop the other to form buildings with multiple building floors. Adjacent frames are not required to be the same size.

Frame assemblies provide several advantages for building construction compared to piece-by-piece assembly of building frames. A manufacturing site for frame assemblies can be a different geographic location than the geographic location where a building is being constructed, also referred to herein as the building site. Deck assemblies can be tilted to any convenient angle at the frame assembly manufacturing site to give assembly workers ready access to all sides of the deck assembly for more ergonomic installation of structural and MEP/FP components. Frame assembly manufacturing workers may avoid the risk of falls from high places and are able to complete most of their assembly operations standing on the floor or a stable work platform next to a deck assembly tilted to a convenient angle, rather than working above their heads as may be required for piece-by-piece installation of columns, beams, MEP/FP components and other parts of building frames in previously known building construction methods. Frame assemblies may be assembled and transported in the folded configuration, unfolded while being lifted from a transport vehicle, and attached to other frame assemblies to provide a structurally stable, strong building frame with decking and MEP/FP components already in place. Construction workers at a building site may safely walk on a frame assembly after the frame assembly is affixed in its fully unfolded configuration.

As used herein, a building floor refers to a building story, for example, a first floor, a second floor, etc. References to building floor numbers used herein follow the most frequently applied convention used in the United States, with the first floor corresponding to the ground floor, the second floor corresponding to the first elevated floor above the ground floor, and so on.

Some structural components of the disclosed embodiments are described as affixed to one another and other components are described as rotatably coupled to one another. Examples of objects which are affixed to one another include, but are not limited to, objects that are welded together and objects that are held to one another by at least one, and preferably two or more, firmly tightened bolts and nuts. Examples of objects which are rotatably coupled to one another include objects held together by a hinge bolt and loosely connected nut, with one of the objects free to rotate about the hinge bolt relative to the other object. Objects which are rotatably coupled to one another may have other objects interposed between the rotatably coupled objects. Objects which are affixed to one another may have other objects interposed between the affixed objects. For structural components disclosed herein to be connected to one another by a bolt or similar threaded fastener, the connection further includes a washer and a nut for each bolt unless otherwise specified. Furthermore, unless otherwise specified, "approximate" or "approximately" as used herein corresponds to "plus or minus ten percent" of the stated condition.

Unless otherwise noted, a frame assembly in a fully unfolded frame configuration has the vertical support members affixed to the deck assemblies so that the vertical support members are no longer free to rotate relative to the deck assemblies and are instead secured at a fixed 90 degree angle relative to the deck assemblies. A frame assembly having vertical support members that are rotatably coupled to a deck assembly rather than being affixed to the deck assembly is considered herein to be in a folded frame configuration or a partially folded frame configuration, whether or not the vertical support members are at an angle of 90 degrees to the deck assemblies.

An example embodiment 200 corresponding to a frame assembly 14 is shown in the pictorial view of FIG. 1. The example frame assembly 14 of FIG. 1 includes four vertical support members 292 and two deck assemblies 238 assembled to one another at rotatable connections 302. Because each of the deck assemblies 238 in the example of a two-deck frame assembly 202 in FIG. 1 will form parts of building floors 306 in a building frame, one of the deck assemblies 238 may be referred to as lower floor deck assembly 13 and the other as an upper floor deck assembly 12. The lower floor deck assembly 13 is positioned a preferred separation distance 164 in a vertical direction 158 above a lower end 296 of the vertical support members 292. The upper floor deck assembly 12 is positioned between the lower floor deck assembly 13 and an upper end 294 of the vertical support members 292 at a preferred vertical separation distance 166 from the top surface 254 of the lower floor deck assembly 13.

The deck assemblies 238 included in the frame assemblies 14 disclosed herein may have a metal deck 4 extending in a transverse direction 156 from a first longitudinal frame member 1 along a first longitudinal side 240 to a second longitudinal frame member 1 along a second longitudinal side 242, and from a first end 244 in a longitudinal direction 154 to a second end 246. Optional Stud bolts 10 are welded to the first and second longitudinal frame members 1 along the first longitudinal side 240 and second longitudinal side 242 of the deck assembly. Some deck assembly embodiments include a transverse frame member 2 affixed to the first longitudinal frame member 1 and the second longitudinal frame member 1. The corrugated metal deck 4 may be formed from sheet metal. After frame assemblies 14 are attached to one another to form building floors 306, concrete (not shown in the figures) may be poured onto the metal deck to form a composite building floor. A metal deck closure may be installed at the ends of the channels in the corrugated metal deck to prevent concrete slurry from flowing off the metal deck, or the sides of the metal channels or sheets may be bent upward.

A floor deck assembly 12 may be provided with a metal deck as described. In alternative embodiments, the metal deck is optionally replaced with cast concrete planks, wood planks, or composite materials using wood, concrete, metal, epoxy, and/or metal.

Figure 4:
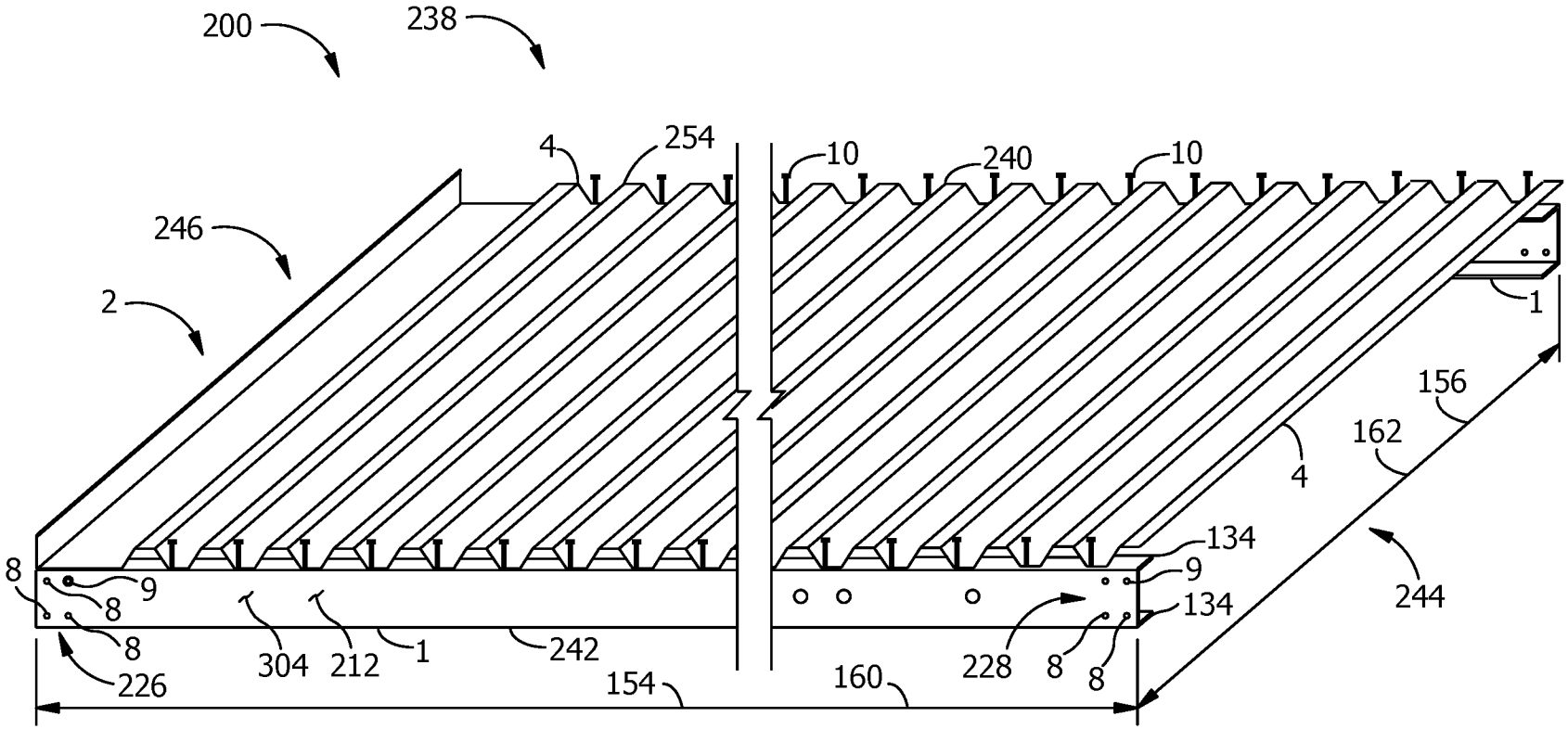
FIG. 4 shows a partial pictorial view of some components of an example deck assembly compatible with all the frame assemblies disclosed herein.

In some example embodiments 200, a vertical support member 292 may be implemented as a column 5 formed an H-beam or a W-beam having two column flanges 133 integrally formed with an intervening column web 213. As will be described later for other example embodiments, a vertical support member may alternatively be formed from a hollow structural section (HSS) beam having a square, rectangular, or circular cross section. Each rotatable connection 302 in the example frame assembly 14 of FIG. 1 includes a hinge bolt 16 passing through a hinge bolt aperture 15 formed in a column flange 133 of the column 5 and a corresponding hinge bolt aperture 9 (ref. FIG. 4) formed in a flat side 304 of the longitudinal frame member 1, with the flat side 304 corresponding in some embodiments to a beam web 212 of the longitudinal frame member. A blind bolt may optionally be used in place of the illustrated examples of a hinge bolt.

The frame assembly 14 of FIG. 1 is shown in an example of a fully unfolded frame configuration 224 with each of the vertical support members 292 at right angles to the longitudinal frame members 1 of the deck assemblies and the deck assemblies parallel to one another. The frame assembly may be locked nonrotatably into the fully unfolded frame configuration by affixing the vertical support members to the longitudinal frame members of each deck assembly. In the illustrated example, the vertical support members are affixed to the deck assemblies by passing bolts 26 through vertical support bolt apertures 21 formed in one of the column flanges 133 of each column 5 and corresponding bolt apertures 8 formed in the flat sides 304 of the first and second longitudinal frame members 1, and tightening nuts placed on the hinge bolt and bolts. Another group of vertical support bolt apertures 21 are formed in the second column flange 133 of each column 5 to enable the column to be affixed to an adjacent frame assembly 14 by passing additional bolts through the second column flange and a group 228 of bolt apertures 8 formed in the longitudinal frame members 1 of the adjacent frame assembly.

The example frame assembly 14 of FIG. 1 has two of the vertical support members 292 rotatably coupled to the flat sides 304 of the longitudinal frame members 1 adjacent the second end 246 of each deck assembly. A first vertical support member is positioned at a rotatable connection 302 on the flat side 304 of the longitudinal frame member 1 along the first longitudinal side 240 of the deck assembly and a second vertical support member is positioned transversely opposite the first at another rotatable connection 302 on the flat side 304 of the second longitudinal frame member along the second longitudinal side 242 of the deck assembly. A third vertical support member is positioned at another rotatable connection 302 on the same flat side 302 of the first longitudinal frame member as the first vertical support member. A fourth vertical support member is positioned at yet another rotatable connection 302 transversely opposite the third vertical support member on the same flat side 304 of the second longitudinal frame member as the second vertical support member.

In some frame assembly embodiments, for example the frame assembly of FIG. 1, the rotatable connections 302 for the third and fourth vertical support members are displaced from the first end 244 of each deck assembly by a cantilever distance 250, forming a cantilevered segment 248 of each deck assembly extending longitudinally beyond the third and fourth vertical support members. The cantilever distance 250 has a value in a range from 25 percent of the overall longitudinal dimension 160 of the deck assembly 238 to 50 percent of the longitudinal dimension 160. The cantilever distance 250 in the frame assembly example of FIG. 1 has a value of one-third the overall longitudinal dimension 160 of the deck assembly. A frame assembly may alternately have the third and fourth vertical support members rotatably coupled to the longitudinal frame members adjacent the first end of each deck assembly, i.e., although there is no cantilevered segment of a deck assembly illustrated, a cantilevered segment may optionally be provided. A useful aspect of the cantilevered segment 248 will be presented in discussion of FIG. 13.

Figure 2:
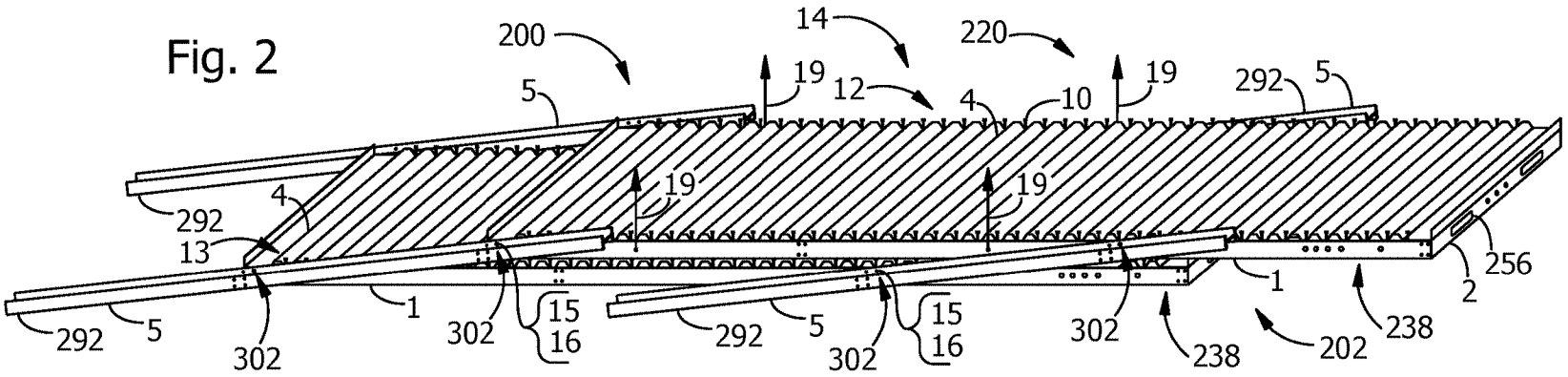
FIG. 2 is a pictorial view of the example frame assembly of FIG. 1 in a folded frame configuration with an upper deck assembly resting directly on top of a lower deck assembly while the two deck assemblies are joined to one another by the four vertical support members.
Figure 16:
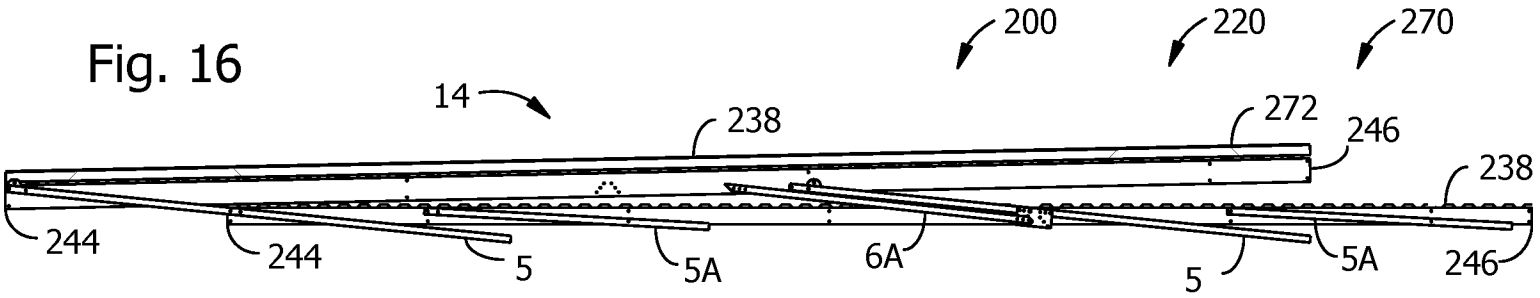
FIG. 16 is a side view of an example building frame in a folded frame configuration, with the upper deck assembly configured as part of a sloped building roof and one of the deck assemblies configured as part of an elevated building floor.

Rotatably coupling the vertical support members 292 to the deck assemblies 238 permits the frame assembly 14 to be placed in the folded frame configuration 220 shown in the example of FIG. 2. The folded frame configuration reduces the overall height of the frame assembly and is advantageous for transporting frame assemblies from a frame assembly manufacturing site to a building site. For the frame assembly to fold in the manner shown with the upper floor deck assembly 12 resting against the lower floor deck assembly 13 of a two-deck frame assembly 202, the vertical support members 292 will preferably be rotationally coupled to the deck assemblies by a loosely tightened hinge bolt at each rotatable connection 302. The folded frame assembly floor deck area can be maximized when the end and interior columns are inclined towards the opposite deck end and not away from the opposite deck end as shown in the example of FIG. 16, thereby enabling more deck floor area to be loaded onto a truck bed.

Figure 3:
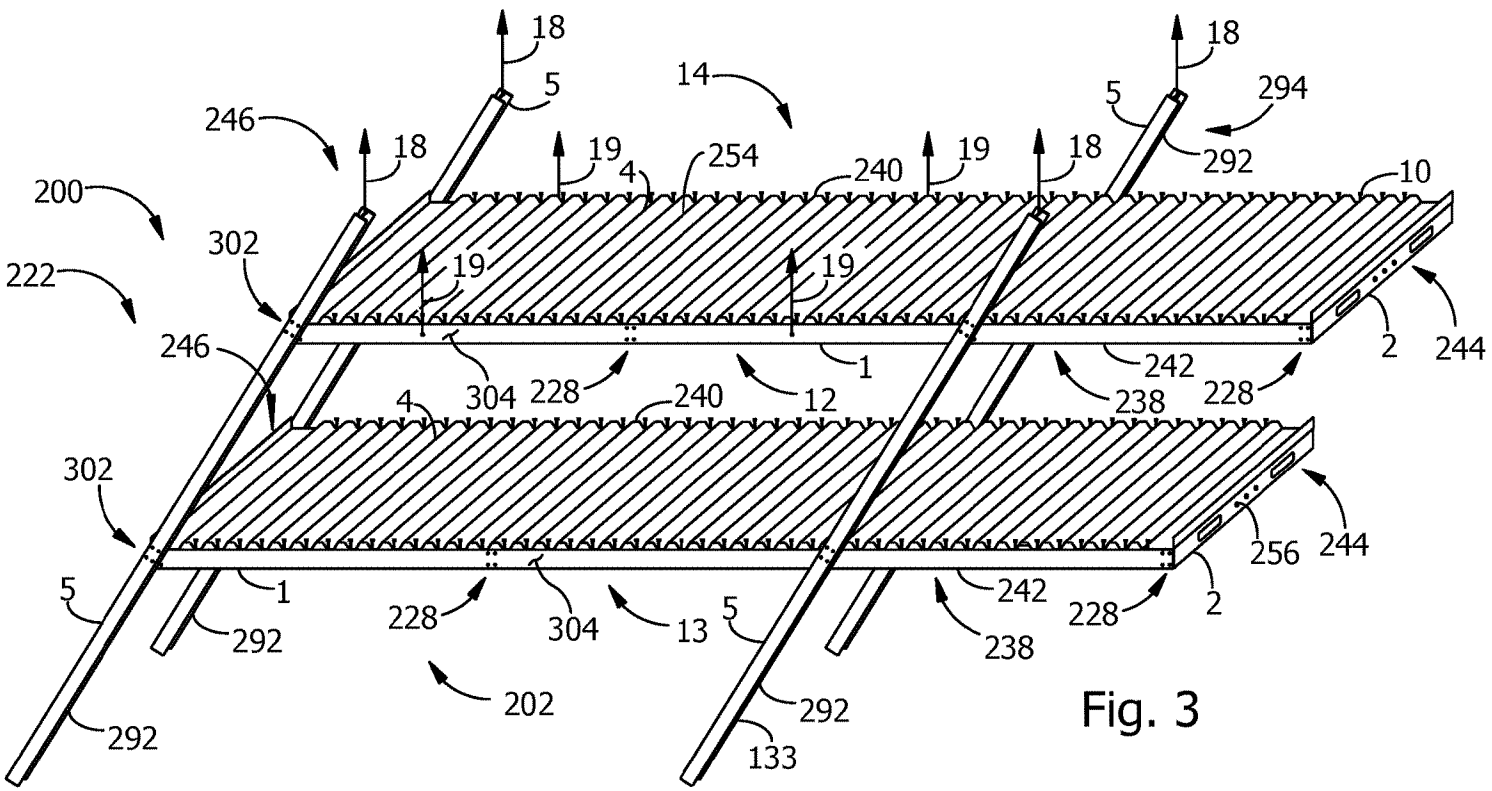
FIG. 3 is a pictorial view of the frame assembly of FIG. 1 and FIG. 2, showing the frame assembly in a partially unfolded configuration, an intermediate configuration between the examples of FIG. 1 and FIG. 2 resulting from lifting the frame assembly by the upper ends of the vertical support members or alternatively by the top deck long beams close to the columns.

A frame assembly 14 can be rotated from the folded frame configuration 220 of FIG. 2 to the fully unfolded configuration 224 of FIG. 1 by lifting the vertical support members 292 from their upper ends 294 with a crane, as suggested by example lift vectors 18 in FIG. 3. Raising the upper ends of the vertical support members separates the deck assemblies from one another, the frame assembly passing through the partially unfolded configuration 222 in the example of FIG. 3 until the columns are vertical and the frame assembly is in the fully unfolded configuration 224 as in the example of FIG. 1. The frame assembly 14 may be locked nonrotatably in the fully unfolded frame configuration 224 by the placement of bolts 26 at each rotatable connection 302 while the frame assembly is supported from the crane at the building site.

Additional details of an example deck assembly 238 used in some embodiments 200 are shown in the partial pictorial view of FIG. 4. The first and second longitudinal frame members 1 are separated from one another in a transverse direction 156 to establish a transverse dimension 162 of the deck assembly with the first longitudinal frame member 1 along a first longitudinal side 240 and the second longitudinal frame member 1 along a second longitudinal side 242. An example transverse frame member 2 included in some deck assembly embodiments is shown in position at the second end 246 of the deck assembly, but a second transverse frame member installed in some embodiments at the first end 244 has been omitted to show both longitudinal frame members. As suggested in FIG. 4, in some embodiments 200 the longitudinal frame members are formed from a channel having two flanges 134 integrally formed with an intervening beam web 212. The beam web of the example longitudinal frame member provides flat sides 304, against which the column flanges 133 of the columns 5 may rotate smoothly during unfolding of the frame assembly.

FIG. 4 further shows examples of hole patterns 226 formed in the beam web 212 for attachment of columns 5 and additional hole patterns 228 for attachment of columns from an adjacent frame assembly. Each hole pattern 226 includes a hinge bolt aperture 9 and one or more bolt apertures 8. Each hole pattern 228 includes at least two, and in the illustrated example, three, bolt apertures 8 for receiving bolts for affixing adjacent frame assemblies together and one hinge bolt aperture 9 for receiving the hinge bolt from the adjacent frame. Two of the hole patterns 226 on each longitudinal frame member 1 are provided for attachment of columns 5 included with the frame assembly 14, and two of the hole patterns 228 are provided for affixing columns 5 from an adjacent frame assembly 14. In some embodiments, bolt apertures are formed as round holes. One or more of the bolt apertures 8 may alternatively be formed as slots. In some embodiments, one of the hinge bolt apertures 9 on a vertical support member is formed as a round hole, and another hinge bolt aperture on the same vertical support member is formed as a slot.

Figure 5:
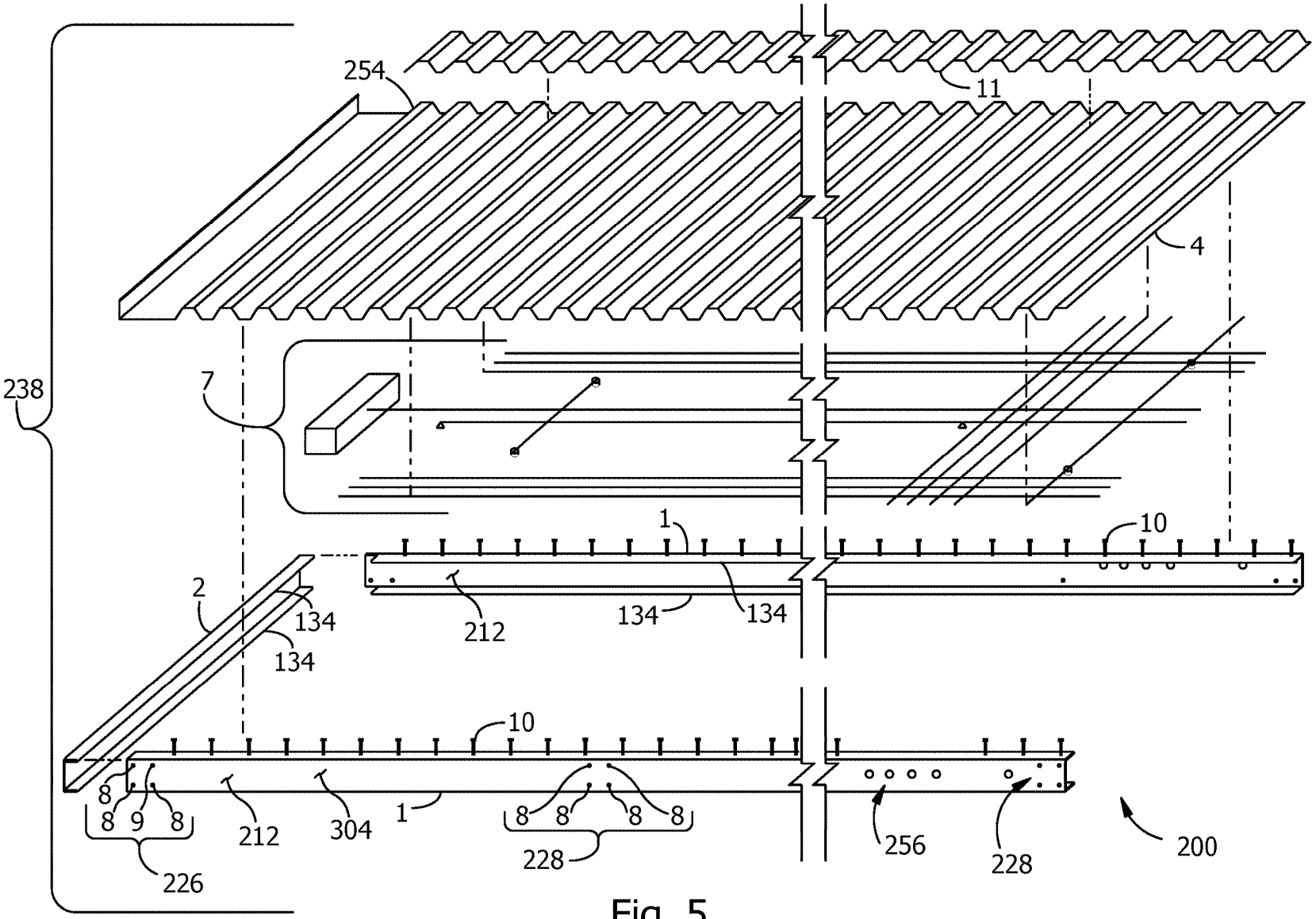
FIG. 5 is a partial exploded view of the example deck assembly of FIGS. 1-4, illustrating an example of MEP/FP components which may optionally be installed below the metal deck.

FIG. 5 shows additional features of the example deck assembly of FIG. 4, showing in a partial exploded view an advantage of the disclosed embodiments 200 compared to piece-by-piece assembly of floor decks at a building site. During fabrication of a deck assembly 238, MEP/FP components 7, represented schematically in the example of FIG. 5, may be attached to the longitudinal frame members 1, transverse frame members 2, and metal deck 4 by moving the deck assembly from one work station to another at the frame assembly manufacturing site, with each work station arranged to complete a related set of activities. For example, electrical wiring may be installed at one work station, fire protection components at a second work station, plumbing components at a third, and so on. Workers at each station can specialize in the tasks being performed, becoming more efficient with experience, and be provided with all necessary tools and supplies, without getting in the way of workers performing specialized tasks at other stations, and without relocating tools, work platforms, and assembly fixtures as may be necessary at a building site. Fabricating deck assemblies and frame assemblies at a manufacturing site before the frame assemblies are transported to a building site brings mass production efficiencies into the construction of building frames, reducing labor expense and assembly time and improving worker safety compared to piece-by-piece assembly at a building site.

A deck closure 11 may optionally be provided with a deck assembly 238. The deck closure 11 may be placed on the top surface 254 of the deck assemblies on two adjacent frame assemblies, covering a gap between the deck assemblies and permitting a continuous layer of concrete or other material to be poured onto the adjacent deck assemblies. An example deck closure 11 is shown in FIG. 5.

Figure 6:
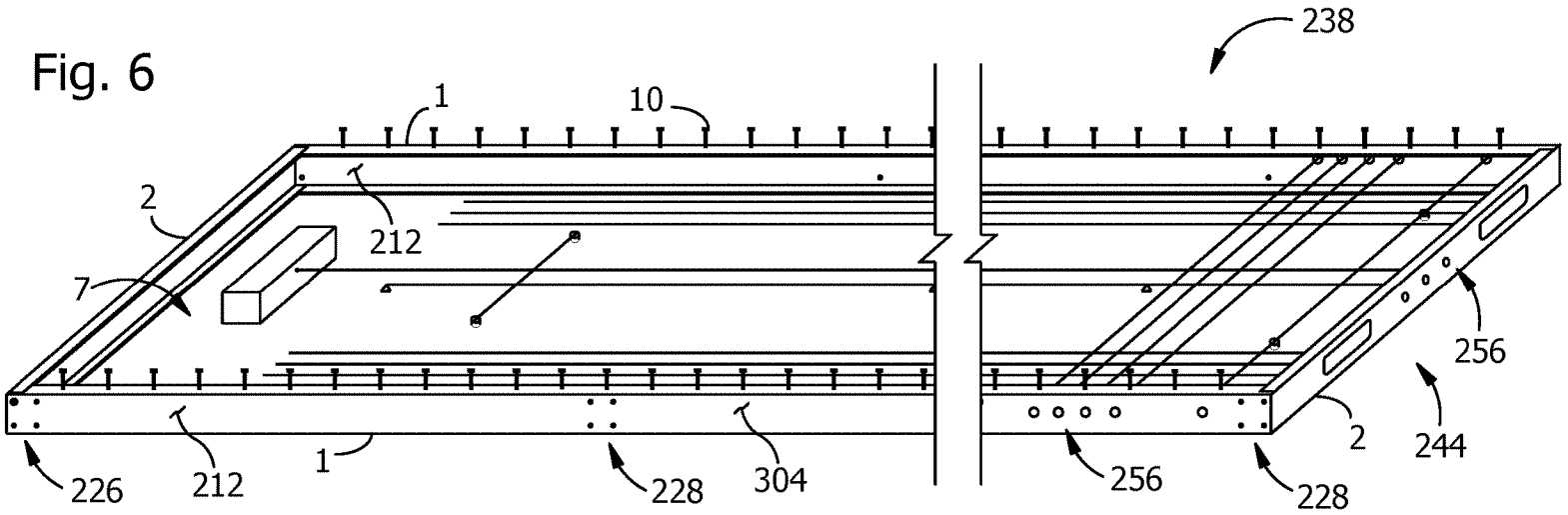
FIG. 6 continues the example of FIG. 5, showing the example MEP/FP components and example structural members of the deck assembly attached to one another, but omitting from the view the example metal deck shown of FIG. 5.

The longitudinal frame members 1 and transverse frame members 2 may be provided with standardized MEP/FP connection components and locations, accessible through optional connection apertures 256 formed in deck assembly components, to facilitate rapid linking of MEP/FP components in one frame assembly to corresponding MEP/FP components in adjacent frame assemblies. FIG. 6 presents an example of an embodiment 200 providing standardized connection locations for MFP/FP components and MEP/FP connection apertures for making connections between adjacent deck assemblies. FIG. 6 shows a schematic view of a deck assembly 238 with the metal deck omitted from the figure. Deck assembly provisions for MEP/FP connections reduce the labor expense associated with making building services operational, improve worker safety compared to installing MEP/FP components in partially completed building frames, and simplify future maintenance, repair, and remodeling.

Figure 7:
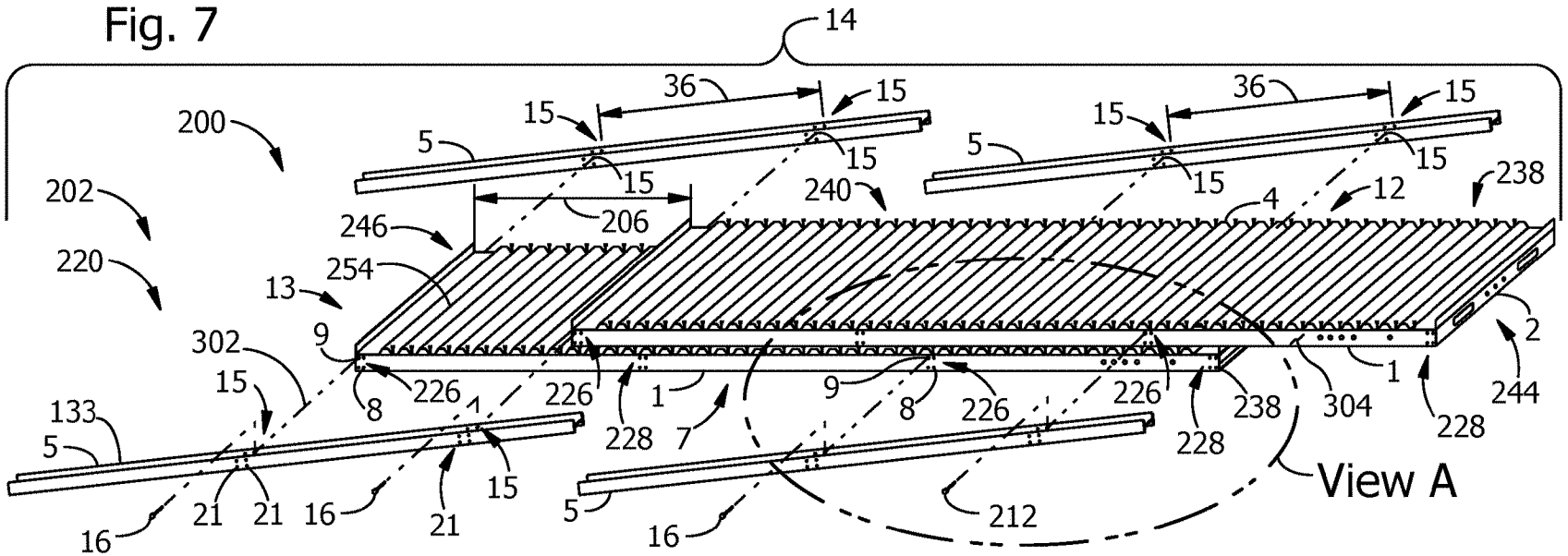
FIG. 7 is a partial exploded pictorial view illustrating an example method for constructing the frame assembly of the previous figures, showing the upper deck assembly offset from the lower deck assembly to enable attachment of the vertical support members to the deck assemblies.

An example of components positioned for connection to form a frame assembly 14 is shown in an exploded pictorial view in FIG. 7. The example frame assembly 14 includes four vertical support members corresponding to columns 5. The example frame assembly further includes two deck assemblies 238. Each deck assembly in the example of FIG. 7 optionally includes previously installed MEP/FP components, for example the MEP/FP components shown schematically in FIG. 6. The upper floor deck assembly 12 may be placed on top of the lower floor deck assembly 13 with the second end 246 of the upper floor deck assembly displaced in a longitudinal direction by an offset distance 206 from the second end of the lower floor deck assembly. The offset distance 206 is selected to cause the hinge bolt apertures 15 in the flanges of the columns 5 to align with the corresponding hinge bolt apertures 9 in the longitudinal fame members 1 of each deck assembly, enabling hinge bolts 16 to be passed through the aligned apertures as suggested by the broken lines from each hinge bolt 16 through related hinge bolt apertures. The hinge bolts may be loosely retained in the aligned hinge bolt apertures by nuts (not illustrated) loosely threaded onto the bolts.

Figure 8:
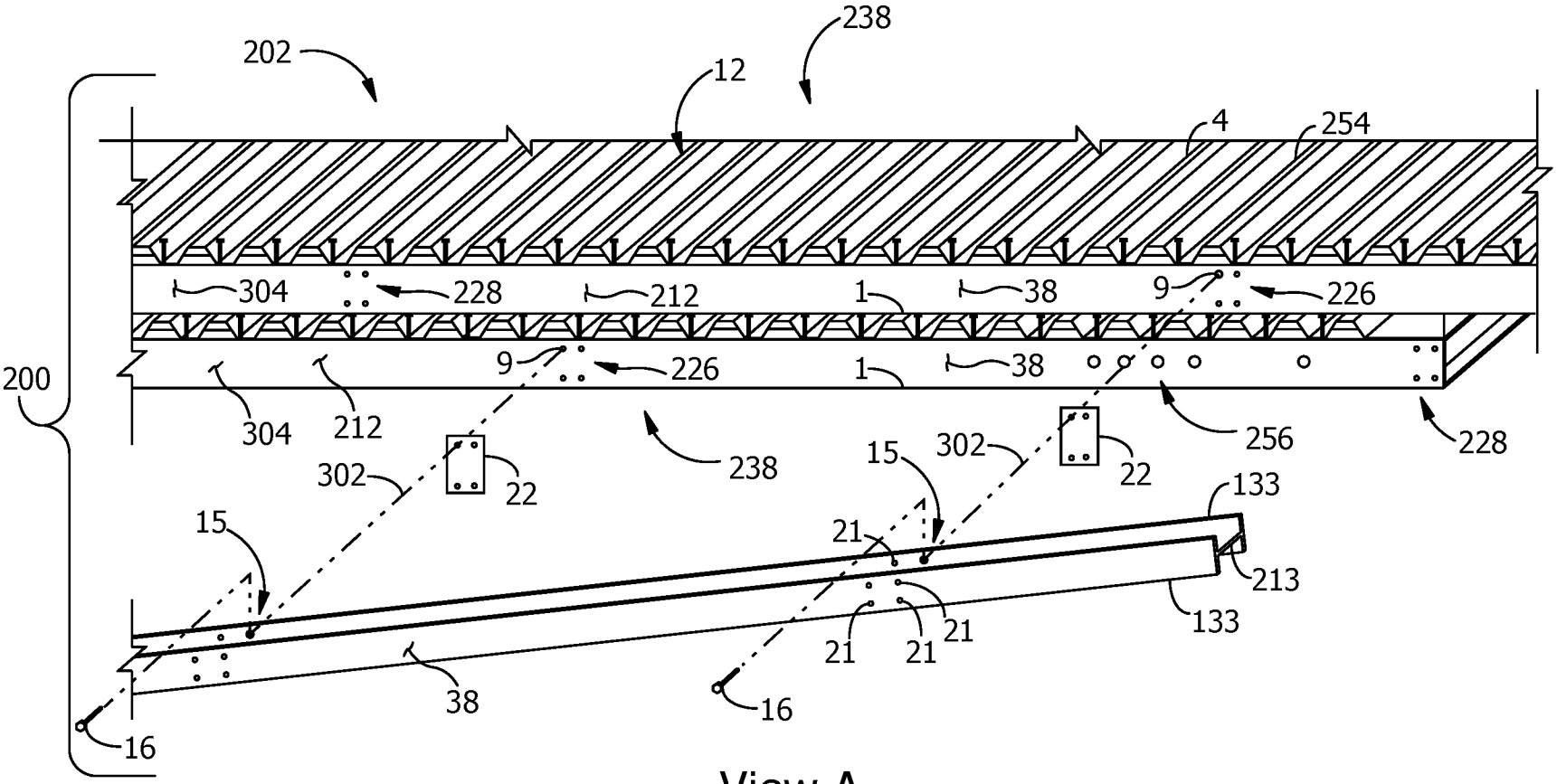
FIG. 8 shows in View A a partial exploded view of one of the vertical support members and parts of the two deck assemblies from FIG. 7.

Some additional features of the rotatable connections 302 between the vertical support members and deck assemblies are presented in View A in FIG. 8. The columns 5, longitudinal frame members 1, and other parts of the frame assembly 14 may optionally be coated with fire protection materials and/or anti-corrosion materials 38. Shims 22 made from a polymer or metal may be interposed between the flanges of the columns 5 and the flat side 304 of the longitudinal frame members 1, separating the adjacent coated surfaces from one other and preventing the coating materials being scraped off when the vertical support members rotate relative to the deck assemblies as the frame member is moved from the folded configuration to the fully unfolded configuration. The shims 22 are retained by the hinge bolts and are optionally removed when the hinge bolts are removed and replaced to join two adjacent frame assemblies.

Figure 9:
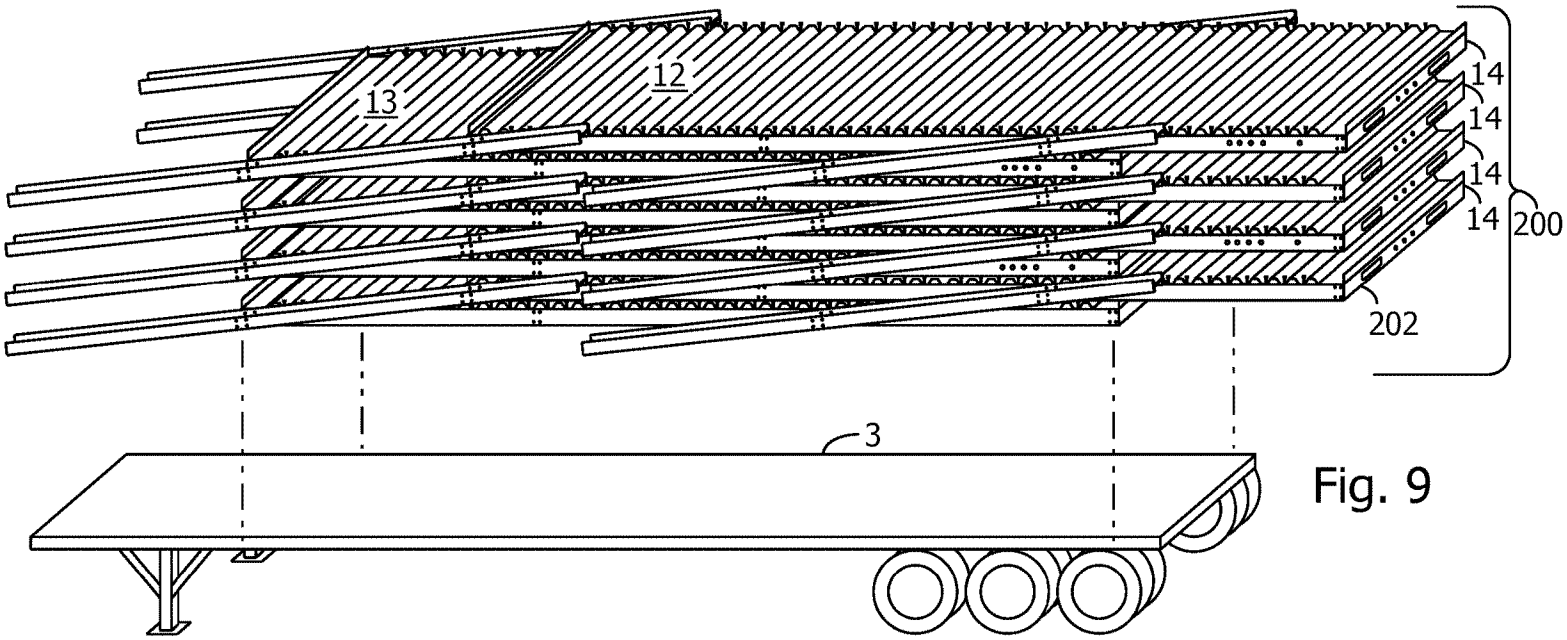
FIG. 9 shows an example of four frame assemblies, each in a folded frame configuration with the frame assemblies stacked one on top of another before being lifted on to a trailer or truck bed for transport to a construction site for a building.
Figure 10:
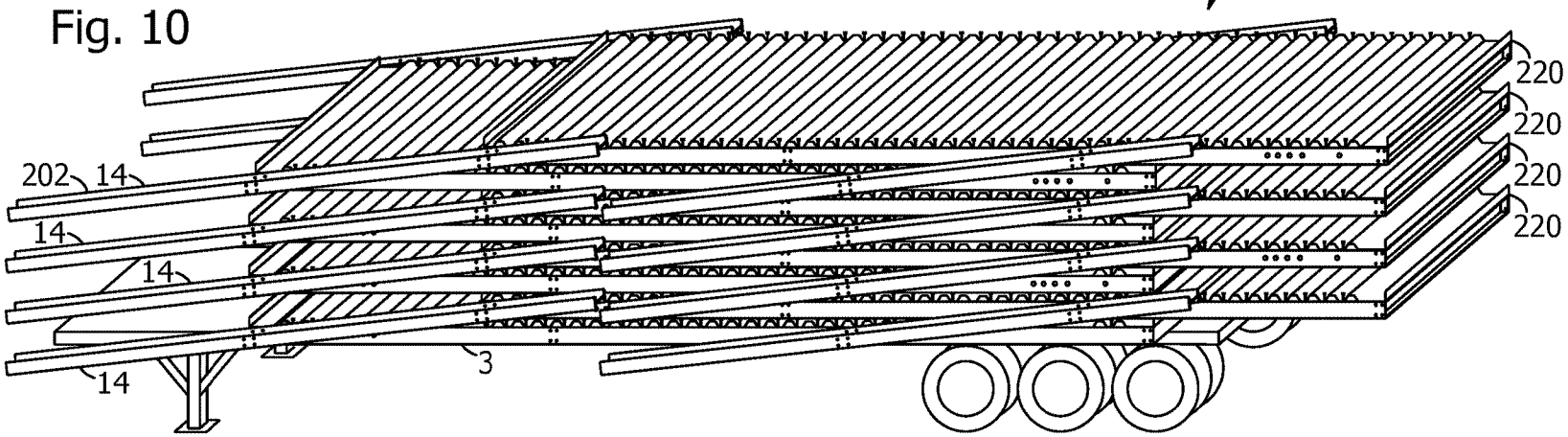
FIG. 10 continues the example of FIG. 9, showing an example of four frame assemblies carried aboard a trailer.

Examples of frame assemblies configured for transport, for example to move frame assemblies from a frame assembly manufacturing site to a construction site for a building, are shown in FIG. 9 and FIG. 10. Four frame assemblies 14, each representing an example of a two-deck frame assembly 202 having an upper floor deck assembly 12 and a lower floor deck assembly 13 with installed MEP/FP components, are placed in the folded frame configuration 220 then stacked one atop the other and lifted onto a conveyance. Examples of a conveyance 3 for transporting one or more frame assemblies 14 include, but are not limited to, a rail car, a truck bed, a trailer, a crane, and a fork lift. The frame assemblies may alternately be stacked one at a time onto the conveyance. The stacked frame assemblies 14 may alternately be placed on the example trailer 3 rotated end-for-end compared to the arrangement shown in the examples of FIG. 9 and FIG. 10.

Figure 11:
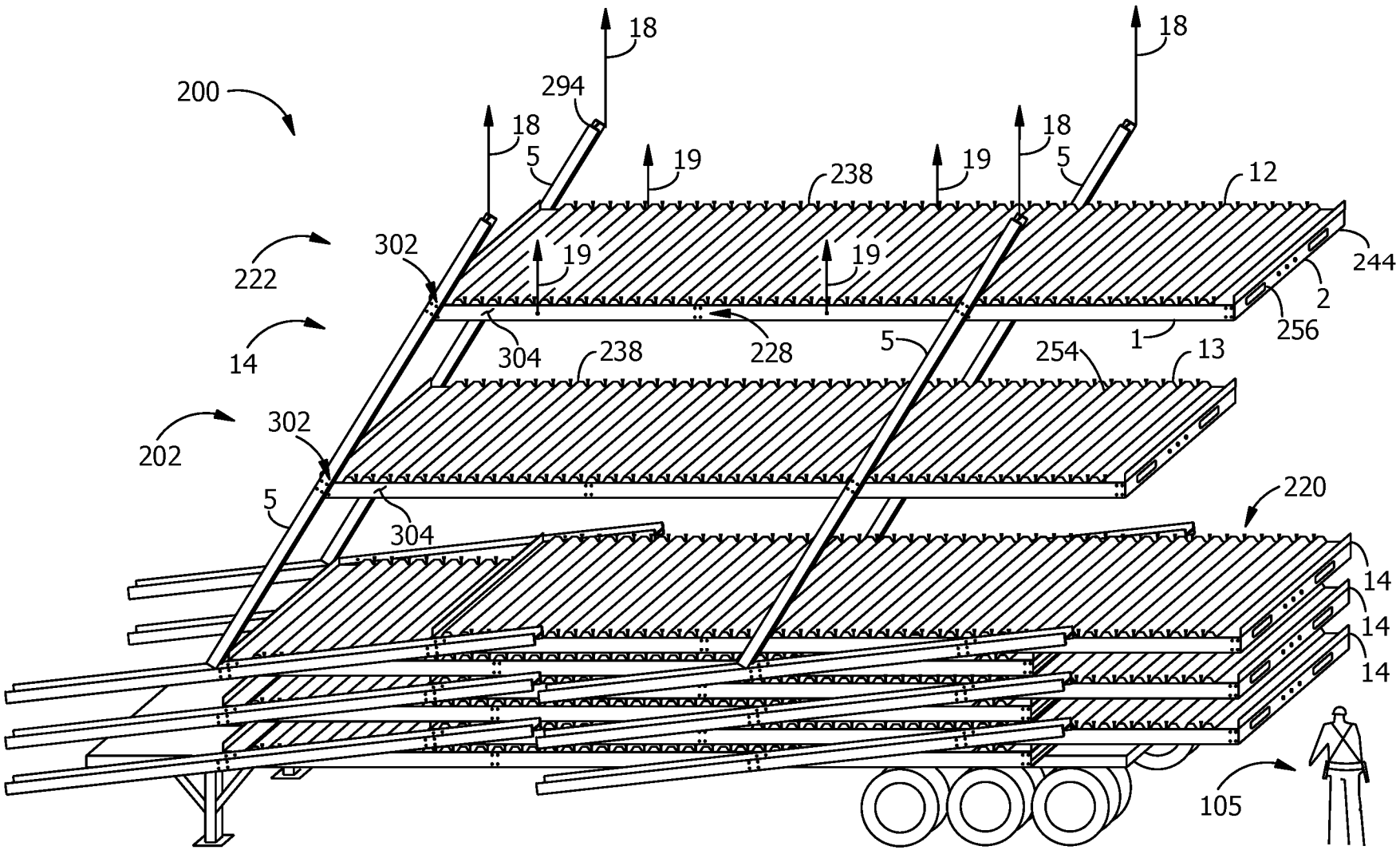
FIG. 11 shows a pictorial view of an example of a frame assembly being unfolded while being lifted from the stack of folded frame assemblies on a trailer.

FIG. 11 shows an example of a frame assembly 14 being lifted from a trailer 3. The frame assembly is preferably lifted upwards from the top long beam 1 close to the columns 5 at the example lift vectors 19. Alternatively, the frame can optionally be lifted from the upper ends 294 of the columns 5, as suggested by lift vectors 18. As the frame assembly is lifted upwards, the upper floor deck assembly 12 moves apart from the lower floor deck assembly and the columns 5 rotate toward a vertical position. When a longitudinal separation distance 36 between hinge bolts on a column is the same for all the columns on one frame assembly, as shown for example in FIG. 7, the deck assemblies 238 remain parallel to one another for frame assemblies in the folded frame configuration 220, the partially unfolded frame configuration 22, and the fully unfolded frame configuration 224. FIG. 11 further shows an example of a construction worker 105 standing near the stack of frame assemblies on a trailer to give a sense of the size of the illustrated example frame assemblies. Frame assemblies 14 may be provided in many other sizes than the examples shown in the figures, and as previously noted, adjacent frame assemblies need not be the same size.

FIGS. 1-11 present examples of one frame assembly in various stages of assembly, folding, and unfolding. FIGS. 12-15 show two or more frame assemblies 14 affixed to one another to form a building frame 208 with at least one building floor elevated above ground level. Unless otherwise noted, all frame assemblies included in the example building frames of FIG. 12 and subsequent figures have MEP/FP components installed in the deck assemblies and further include MEP/FP connection apertures 256 for connecting MEP/FP components in one frame assembly to MEP/FP components in an adjacent frame assembly. Also, unless otherwise noted, all building frames 208 including more than one frame assembly 14 have the lower ends 296 of the vertical support members on the lowest level of frame assemblies resting against a concrete pad, a building foundation, or another structure on the ground floor of a building being constructed, although the concrete pad or foundation may not be illustrated.

Figure 12:
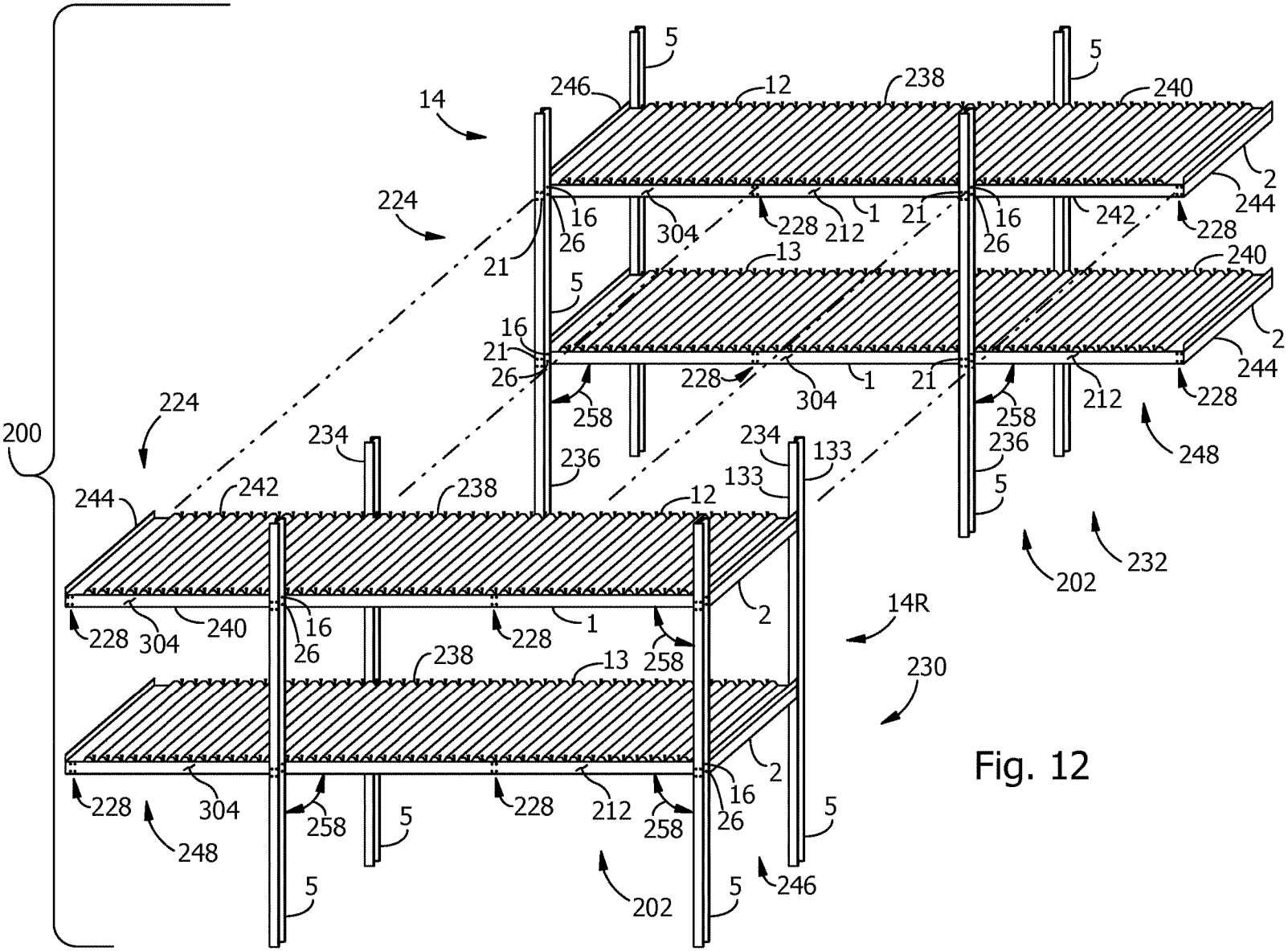
FIG. 12 shows a pictorial view of an example of two frame assemblies secured in a fully unfolded configuration by bolts connecting the vertical support members to the longitudinal frame members of each deck assembly, and further illustrating an example of one of the frame assemblies rotated end-for-end relative to the other frame assembly in preparation for affixing the two frame assemblies to one another.

FIG. 12 shows a pictorial view of an example of two frame assemblies 14 and 14R positioned prior to being affixed to one another to form a building frame. The two example frame assemblies have some of the columns 5 positioned to create a cantilevered segment 248 on each deck assembly 238. Both frame assemblies have been locked nonrotatably into the fully unfolded frame configuration 224 by a combination of hinge bolts and bolts affixing each column on a frame assembly to a longitudinal frame member on the same frame assembly. A first example frame assembly 230 is shown with the cantilevered segment 248 at the first end 244 facing to the left of the figure. The first frame assembly 230 has been rotated end-for-end compared to the second frame assembly 232 and is marked with reference designator 14R to indicate the rotated orientation. The second example frame assembly 232 is shown with the cantilevered segment facing to the right of the figure. As suggested by the broken lines, the columns 234 along the second longitudinal side 242 of the first frame assembly 230 will be affixed to the second longitudinal side 242 of the second frame assembly 232, with the cantilevered segments 248 of the two frame assemblies facing in opposite longitudinal directions. Likewise, the columns 236 along the second longitudinal side 242 of the second frame assembly 232 will be affixed to the second longitudinal side 242 of the first frame assembly 230, and columns 266 from the third frame assembly alternate with columns from the second frame assembly. Each column is affixed to the adjacent frame assembly by at least two bolts passing through the flanges of the column and the web of the longitudinal frame member on the laterally adjacent frame assembly, with the bolts secured by nuts and washers as will be shown in a later figure.

Figure 13:
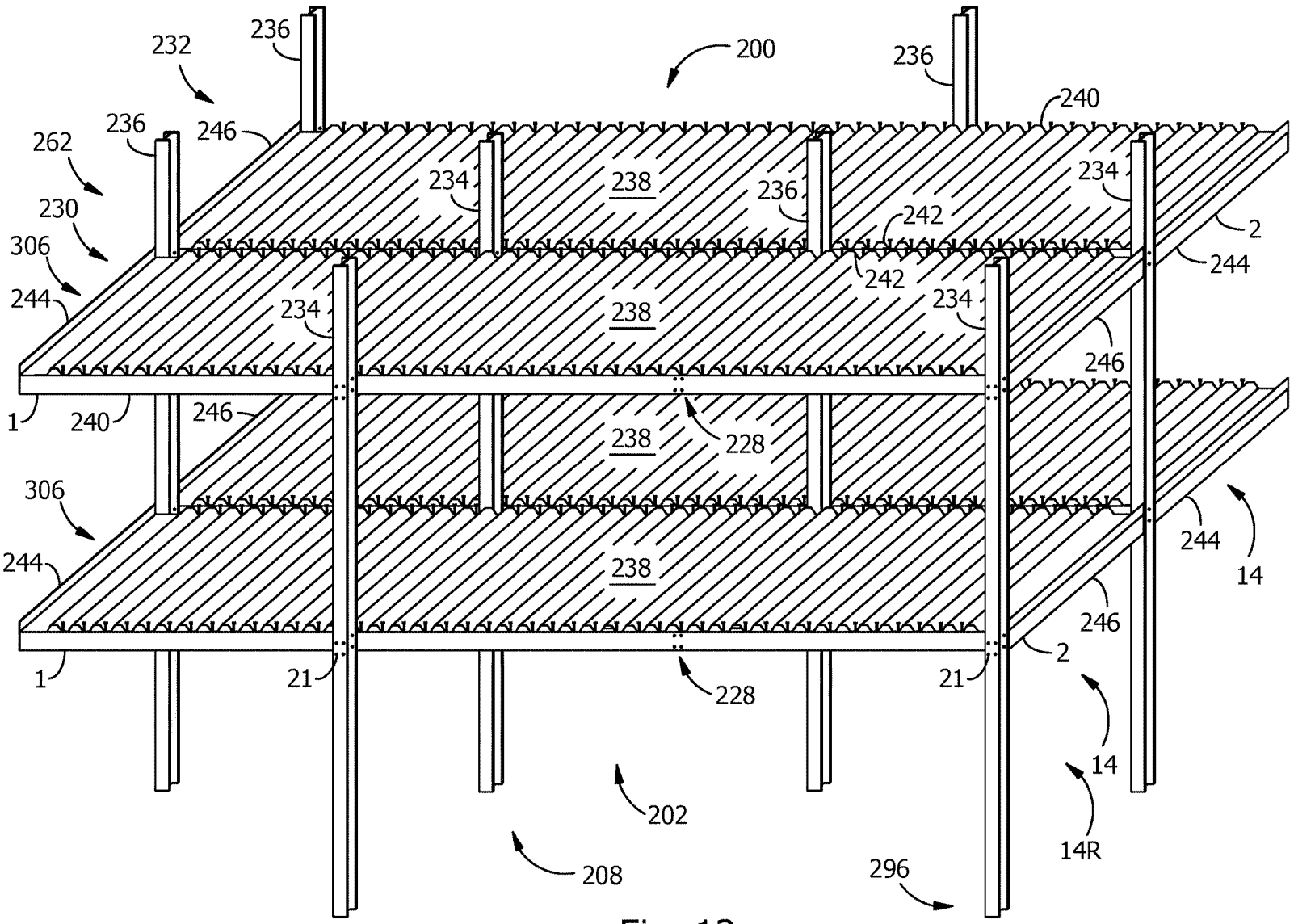
FIG. 13 continues the example of FIG. 12, showing the two frame assemblies attached to one another two form parts of two building floors, and further illustrating an example of the longitudinal alternation of vertical support members from one of the frame assemblies alternating with vertical support members of the other frame assembly along the area of connection between the two frame assemblies.

FIG. 13 continues the example of FIG. 12, showing the two frame assemblies (14, 14R) affixed to one another to form part of a building frame 208 having at least two building floors 306 elevated above a ground floor. Each of the frame assemblies in the figure has a cantilevered segment 248 as shown in the example of FIG. 12, two vertical support members displaced from a first end 244 by one-third the overall longitudinal dimension of the deck assembly, and two more vertical support members at the second end 246. When affixed to one another as shown, a longitudinal alternation of columns 262 is formed at equal intervals along the joined sides of the frame assemblies, with a column 236 from the second frame assembly at one longitudinal end, next a column 234 from the first frame assembly, then another column 236 from the second frame assembly, and lastly another column 234 from the first frame assembly at the opposite longitudinal end of the joined frame assemblies, with the four columns spaced at equal longitudinal intervals along the joined sides of the deck assemblies. Compared to frame assemblies lacking a cantilevered segment, the end-for-end reversal of every other frame assembly reduces a spacing between longitudinally adjacent vertical support members joining the laterally adjacent frame assemblies. Reducing the column spacing permits the use of lighter longitudinal frame members compared to building frames with longer distances between columns.

Figure 14:
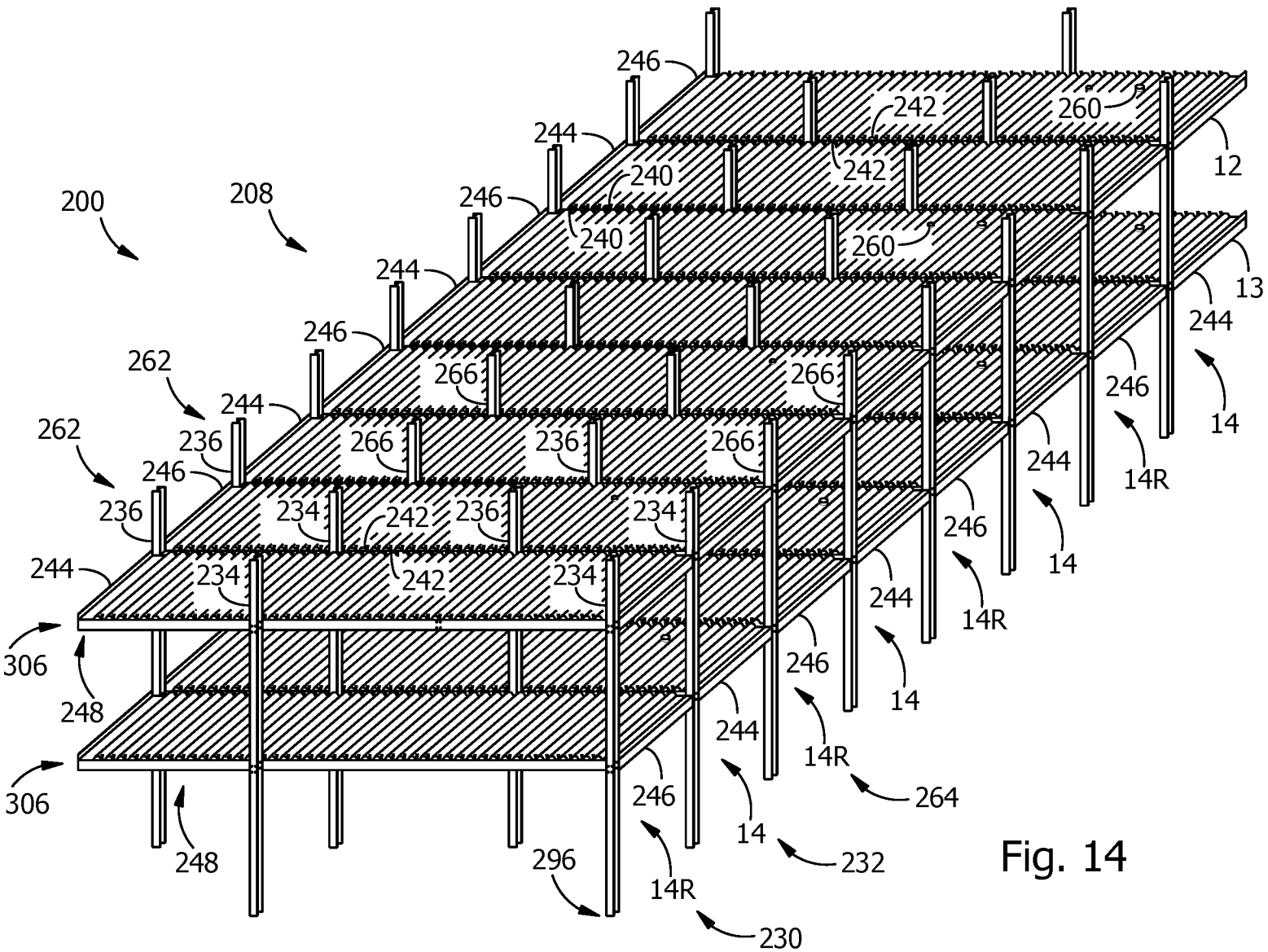
FIG. 14 continues the example of FIG. 13, showing eight frame assemblies attached to one another to form parts of an example ground floor and two elevated floors.

FIG. 14 extends the example of FIG. 13 to a building frame 208 have many frame assemblies 14 affixed to one another to form at least two elevated building floors 306. Each frame assembly in the illustrated example building frame has a cantilevered segment. Every other frame assembly is reversed end-for-end compared to an adjacent frame assembly to produce the alternation of columns 262 along each longitudinal line of columns. When the lower ends of the vertical support members are attached to a concrete pad or other foundation surface (not shown in the figures), the foundation surface establishes the location of the first floor, the lower floor deck assembly becomes part of the second building floor, and the upper floor deck assembly becomes part of the third building floor. As suggested in FIG. 14, deck assemblies may optionally include MEP/FP access pipes to provide access to MEP/FP components and connections after concrete is poured on the metal decks of the frame assemblies.

Figure 15:
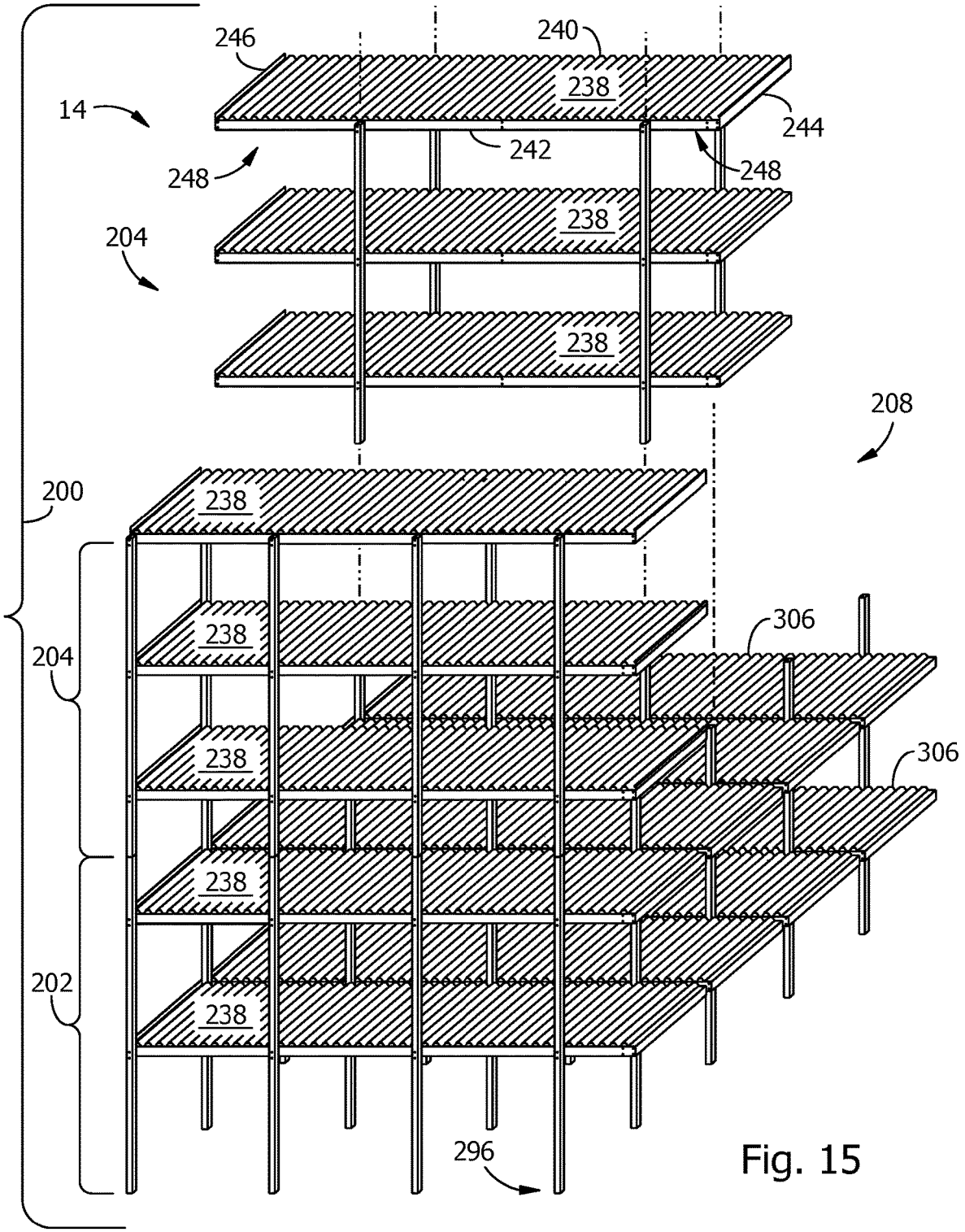
FIG. 15 illustrates in a pictorial view an example of a frame assembly having three deck assemblies, and further illustrates an example of frame assemblies with two deck assemblies and frame assemblies with three deck assemblies attached laterally to one another and stacked one on top of another to construct a building frame for a multi-floor building.

Another example of a building frame 208 in process of being constructed from frame assemblies 14 affixed to one another is shown in FIG. 15. The example building frame 208 of FIG. 15 includes four two-deck frame assemblies 202 affixed to one another along their longitudinal sides (240, 242) as in previous examples, and further includes examples of two three-deck frame assemblies 204 stacked on top of a lower group of two-deck frame assemblies to construct a building frame 208 with five elevated building floors 306. The three-deck frame assembly 204 can be constructed using the methods previously described for the two-deck frame assembly 202 and is configured to be placed in the folded frame configuration for transport and the fully unfolded configuration for placement in the building frame. The use and positioning of hinge bolts and bolts in the three-deck frame assembly is in accord with the descriptions given for the two-deck frame assembly 202, as are the positioning of vertical support members to create a three-deck frame assembly with a cantilevered segment.

The three-deck frame assembly 204 in FIG. 15 further illustrates an example of a frame assembly 14 having cantilevered segments at both ends. A frame assembly with cantilevered segments at both ends may provide advantageous column-to-column spacing in a longitudinal direction for frame assemblies affixed to one another end-to-end, for example with the first end 246 of a frame assembly affixed to the second end of a longitudinally adjacent frame assembly.

FIGS. 16-22 show examples of a frame assembly 14 having the lower deck assembly 238 configured as a floor assembly for forming part of a building floor 306 and the upper deck assembly 238 configured as a roof deck 272 for forming part of a building roof. A frame assembly 14 including a top-most deck assembly 238 configured as a roof deck 272 may also be referred to as a frame assembly with a roof deck 270. The example frame assembly with a roof deck 270 is shown in FIG. 16 in an example folded frame configuration 220 and in FIG. 17 an example partially unfolded frame configuration 222. The partially unfolded frame configuration 222 of FIG. 17 indicates that some components of the frame assembly, for example optional hinged brace members 6A, are shown in their folded frame configurations, while other components, for example the columns 5 and longitudinal beams 1 of the upper and lower deck assemblies, are in their fully-unfolded frame configurations.

Figure 17:
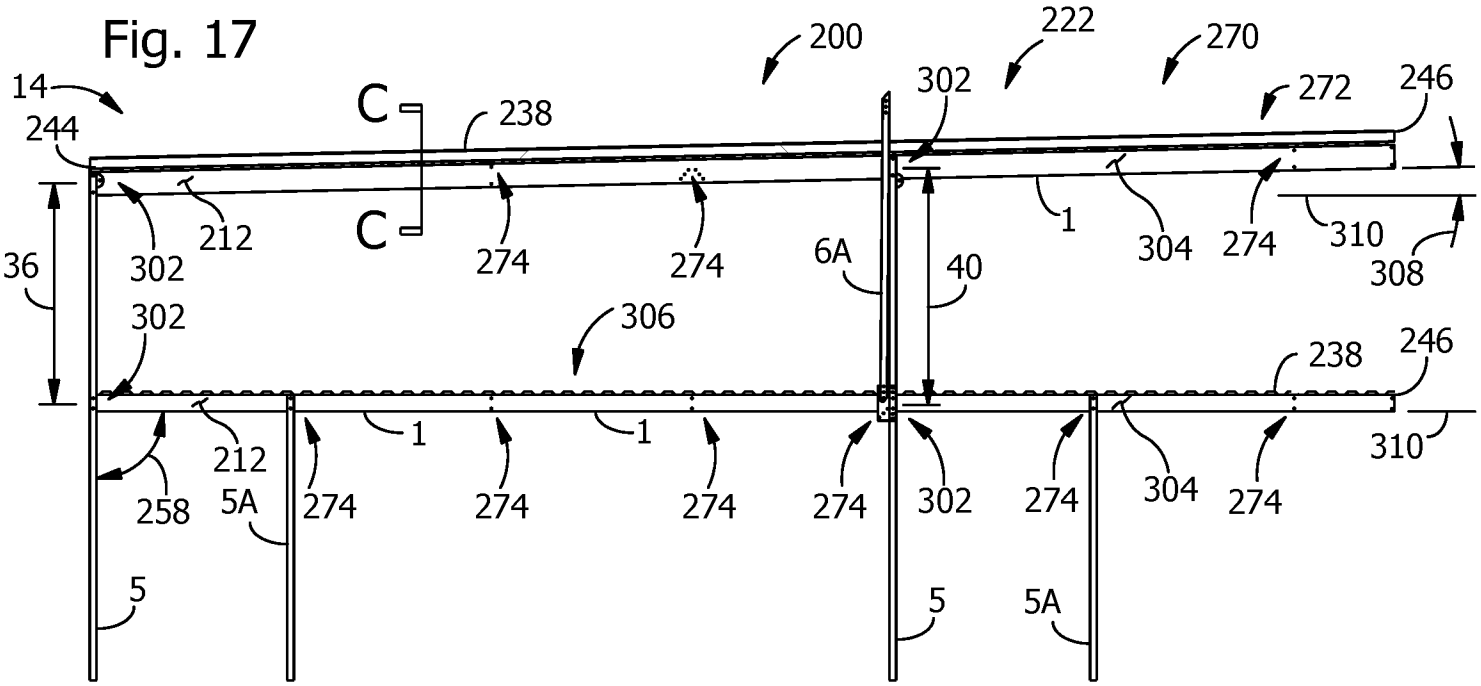
FIG. 17 continues the example of FIG. 16, showing the lower deck assembly joined to the vertical support members with a 90° angle between the longitudinal frame member of the lower deck assembly and each of the vertical support members, and further illustrating an example of the upper deck assembly configured as a roof deck with the roof deck tilted to a selected angle relative to a horizontal reference. An optional brace is attached by bolts to a column with connector plates.

FIG. 17 further illustrates that the lower deck assembly 238 will preferably be at a 90-degree angle 258 to each of the columns 5 when the deck assembly is affixed at the fully unfolded frame configuration. The lower deck assembly will preferably be parallel to a horizontal reference 310 such as a surface of a concrete pad or other building foundation (not illustrated) when the lower ends of the vertical support members 5 are attached to a horizontal surface of the foundation. For frame assemblies with roof decks 270, the topmost deck assembly 238 is optionally tilted at an angle 308 greater than or equal to % unit rise to 1 unit run with respect to the horizontal reference 310. In the illustrated example embodiment 200 of FIGS. 17-21, the topmost deck assembly 238, corresponding to a roof deck 272, has a pitch of 0.25 inch per foot.

As shown in the example of FIG. 17, the tilt angle 308 of the roof deck assembly 272 may be established by separating the positions of the rotatable connections 302 on the column 5 nearest the lower end of the roof deck 272 by a first separation distance 36 and the rotatable connections on the column 5 nearest the higher end of the roof deck by a second separation distance 40. In the example of FIG. 17, the lower end of the roof deck 272 is at the first end 244 of the frame assembly with a roof deck 270.

A frame assembly with a roof deck 270 may be placed in the folded frame configuration 220 with the first end 244 of the roof deck 272 extending longitudinally outward from the first end 244 of the lower deck assembly 238, as shown in the example of FIG. 16. A frame assembly with a roof deck 270 may alternately be placed in the folded frame configuration 220 with the first end of the lower deck assembly 238 extending longitudinally outward from the first end 244 of the roof deck 272, as shown in the example of FIG. 18. FIG. 19 shows the frame assembly of FIG. 18 in a partially unfolded configuration 222 with the columns 5 at a right angle 258 to the longitudinal frame members 1 and the brace members 6A still folded. FIG. 20 shows a view toward the second end 246 of the example frame assembly with a roof deck 270 of FIGS. 18-19.

A frame assembly 14 optionally includes brace members and optional one-level columns in addition to vertical support members. FIGS. 16-21 show examples of hinged brace members 6A configured for attachment to the longitudinal frame members of adjacent assemblies folded for transport. In FIGS. 16-20, the hinged brace members are still folded with other parts of the frame assembly fully unfolded.

Figure 21:
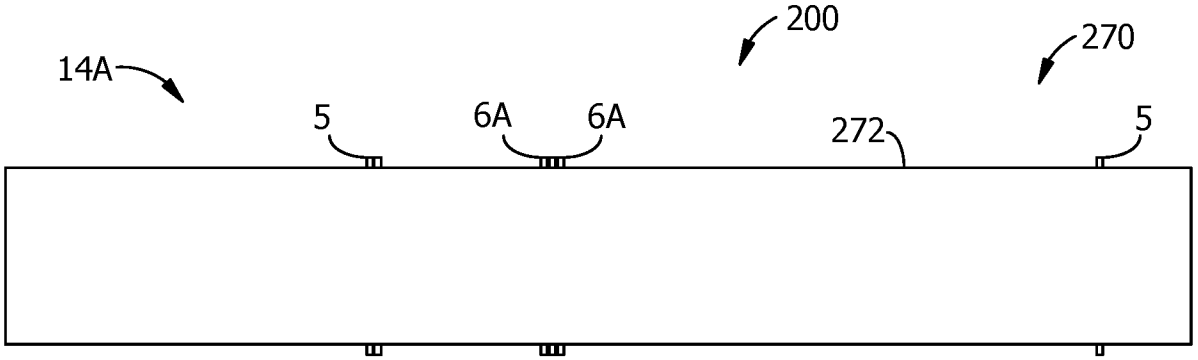
FIG. 21 is a view downward onto a frame assembly with a roof deck and a cantilevered segment, showing examples of columns, one-level columns, and brace members arranged along the longitudinal sides of the frame assembly, and the cantilevered segment at the left end of the frame assembly.
Figure 22:
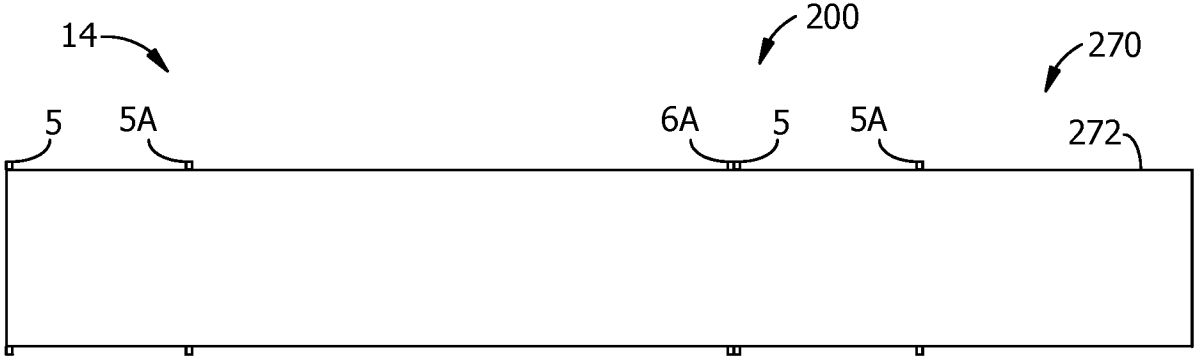
FIG. 22 is a view downward onto a frame assembly with a roof deck and a cantilevered segment, showing examples of columns, one-level columns, and brace members arranged along the longitudinal sides of the frame assembly, and the cantilevered segment at the right end of the frame assembly.

FIG. 21 and FIG. 22 show examples of positions for columns 5, one-level columns 5A, and brace member 6A for a frame assembly 14A oriented with the cantilevered segment 248 at the left end of the example frame assembly and a frame assembly 14 oriented with the cantilevered segment 248 at the right end of the example frame assembly. Embodiments 200 may have a different number of columns, one-level columns, and brace members than shown in the example figures. The viewing direction for FIGS. 21-22 is downward onto the roof deck 272 of each frame assembly 270.

Figure 24:
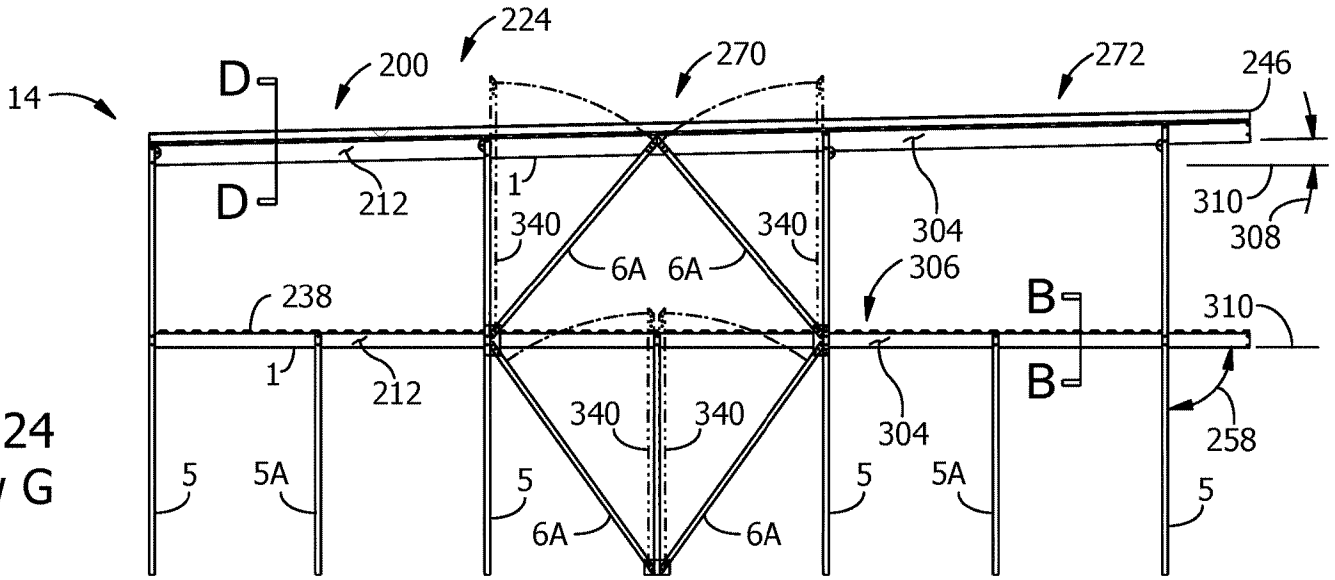
FIG. 24 continues the example of FIGS. 16-23, showing in View G toward a longitudinal side of the example frame assembly 272 with a roof deck 272 the connection of frame assemblies shown in FIGS. 17 and 19. The combined columns of each frame provide a series of columns at the ground level. At the second level, the example of FIG. 24 shows half of columns extending to the roof deck 272 due to a lower live load for the roof deck than for the floor deck. The combined example frame assemblies provide a roof deck with an example of the hinge braces deployed and connected to the longitudinal frame members, and optional connector plates of the upper deck assembly and the lower deck assembly.
Figure 25:
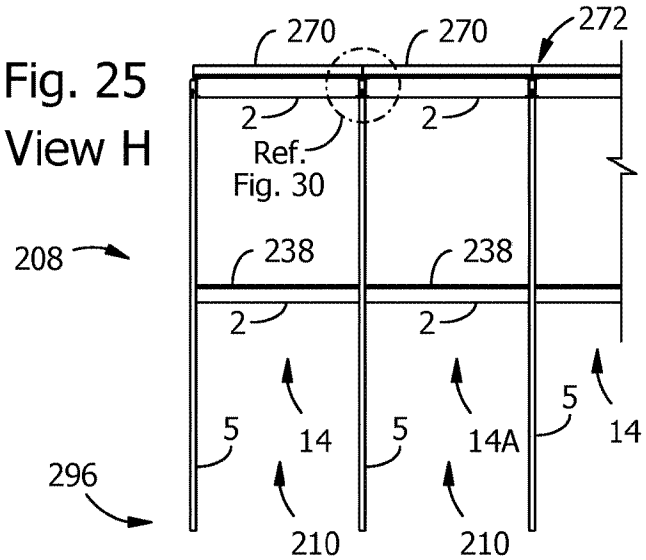
FIG. 25 continues the example of FIGS. 16-24, showing in View H a partial end view of an example building frame with two complete frame assemblies and a third partial frame assembly connected side-by-side to one another.
Figure 23:
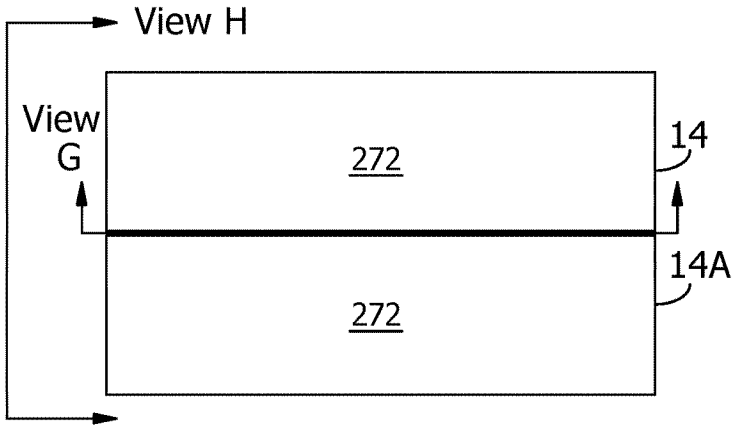
FIG. 23 shows a view downward toward the roof decks of two adjacent frame assemblies, with arrows indicating viewing directions for View G in FIG. 24 and View H in FIG. 25.

FIG. 23 includes viewing directions for View G in FIG. 24 and View H in FIG. 25. FIG. 24 shows in View G an example of the intersection of the combined folded frames 14 and 14A with hinged brace members 6A unfolded and affixed to the longitudinal frame members 1 of the deck assemblies forming parts of the roof deck 272 and building floor 306. The hinged brace members 6A may be fixed in place by bolts (not shown) passing through the brace members and apertures 274 formed in the longitudinal frame members (ref. FIG. 17). FIG. 23 continues the examples of FIGS. 16-22, showing an end view of example frame assemblies with roof decks 270 and laterally adjacent frame assemblies 210 affixed to one another. The frame assemblies in FIG. 21 and FIG. 22 are in the fully unfolded configuration 224. Examples of the hinged brace members 6A stowed for transport are shown in broken lines at location 340.

Figure 26:
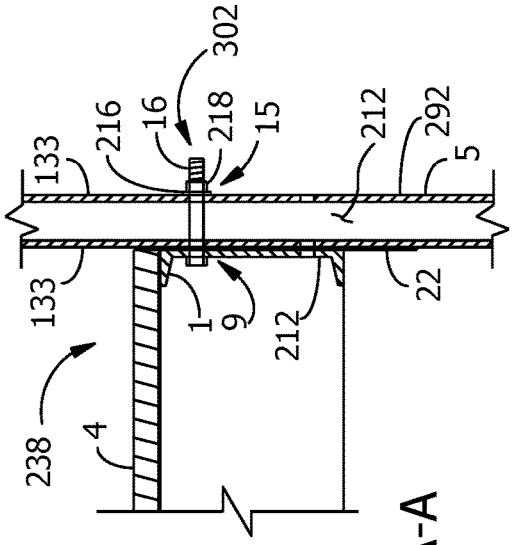
FIG. 26 shows a cross-sectional view A-A representing an example of a deck assembly rotatably coupled to a column by a hinge bolt passing through a web of a longitudinal frame member and through flanges of the column, with the hinge bolt fastened loosely by a nut and a bolt. A location and viewing direction for FIG. 26 are marked by a section line A-A in FIG. 19. The example of FIG. 26 applies to all disclosed embodiments with a vertical support member formed with a web and flanges, for example an I-, W-, or H-beam.

Rotatable connections 302 between vertical support members 292 and deck assemblies 238 enable frame assemblies to be placed in a folded frame configuration for transport and in a fully unfolded frame configuration for attachment to a building frame. An example arrangement of frame assembly components for forming a rotatable connection is shown in cross-sectional view A-A in FIG. 26. In the example of FIG. 26, the vertical support member 238 is implemented as an HSS tube column 5. FIG. 26 applies to all example embodiments 200 having a rotatable connection 302 formed by a hinge bolt 16 passing through a beam web 212 of a longitudinal frame member 1 and a column wall or column flange 133 of a vertical support member. The hinge bolt 16 passes through a hinge bolt aperture 9 formed in the beam web 212 of the longitudinal frame member 1 and through hinge bolt apertures 15 formed in the column walls of the column 5. The hinge bolt is retained at the rotatable connection 302 by a washer 16 and nut 218 loosely threaded onto the bolt so that the column 5 and deck assembly 238 are free to rotate relative to one another about a rotation axis established by the hinge bolt and the aligned hinge bolt holes in the coupled components.

Figure 27:
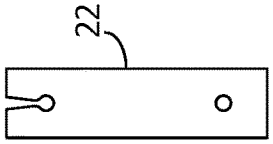
FIG. 27 shows an example shim used in some frame assembly embodiments.

A smooth shim 22, for example the shim of FIG. 8 or the shim of FIG. 27, may be interposed between the beam web 212 of a longitudinal frame member 1 and the adjacent column flange 133 of a column 5. The optional shim 22 may reduce an amount of force needed for rotational movement of the column relative to the deck assembly and protects optional fire prevention and/or anti-corrosion coatings on the column and longitudinal frame member from being scraped or gouged by rotation of the vertical support members about the hinge bolts.

Figure 28:
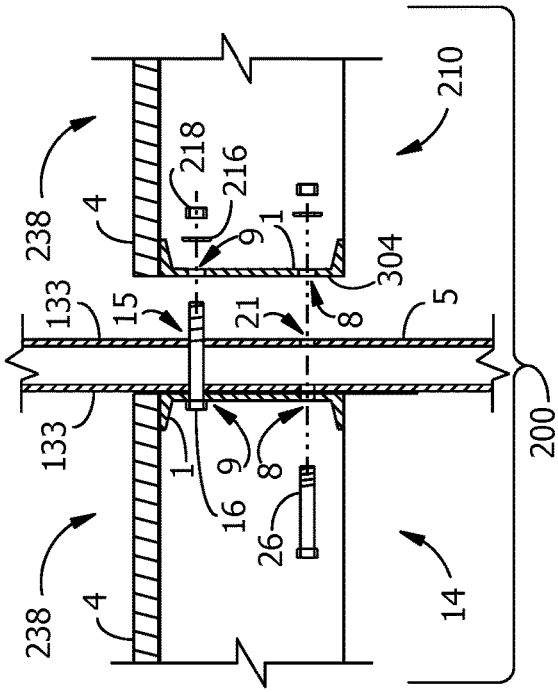
FIG. 28 continues the example of FIG. 26, showing the nut and bolt removed from the hinge bolt, the hinge bolt positioned to pass through the web of the longitudinal frame member of a second, adjacent frame assembly, and further showing an example of a bolt positioned to pass through the longitudinal frame members of both frame assemblies.

FIG. 28 builds on the example of FIG. 26, showing an example of a deck assembly from a second frame assembly positioned for connection to a first frame assembly. Vertical support members from the second frame assembly have been omitted from the view in FIG. 26 to more clearly illustrate the connections between the two deck assemblies at one of the vertical support members on the first frame assembly. Before bringing the second deck assembly into contact with the column of the first deck assembly, the washer 216 and nut 218 are preferably removed from the hinge bolt 16 holding the column 5 to the first frame assembly. Another deck assembly 238 from an adjacent frame assembly or roof assembly is then positioned so that the hinge bolt 16 will pass through a hinge bolt aperture 9 formed in the beam web 212 of the adjacent deck assembly. After the flat side 304 of the adjacent deck assembly has been brought into contact with the column flange 133 of a column 5 from the first frame assembly and the hinge bolt passed through hinge bolt apertures in both longitudinal frame members and the intervening column, the washer and nut may be replaced on the hinge bolt and tightened securely.

Figure 29:
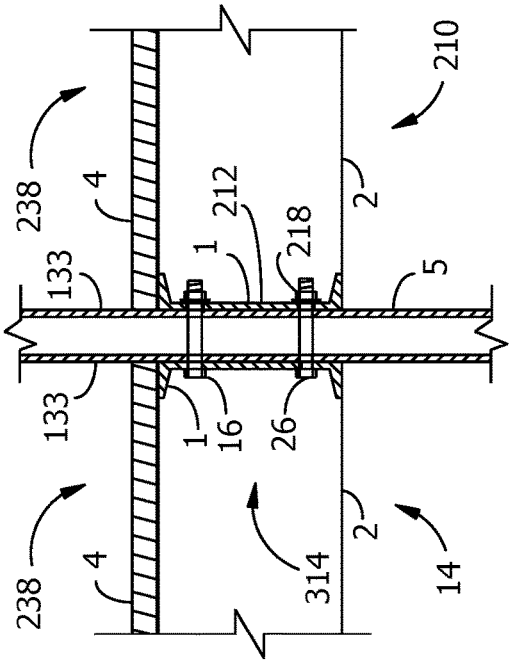
FIG. 29 continues the example of FIG. 26 and FIG. 28, showing in a cross-sectional view B-B an example of the hinge bolt and bolts joining the second, laterally adjacent frame assembly to the vertical support member and longitudinal frame member of the first frame assembly. A location and viewing direction for cross-sectional view B-B is marked by a section line B-B in FIG. 21.

FIG. 28 further illustrates an example of a bolt 26 positioned to pass through bolt apertures 8 formed in the longitudinal frame members 1 of both frame assemblies 238 and bolt apertures 21 formed in the intervening column flanges 133. FIG. 29 shows the example deck assemblies 238 and column 5 affixed to one another by washers and nuts securely tightened onto the hinge bolt and bolt(s). After being affixed by a hinge bolt and one or more bolts as shown in the example of FIG. 29, each column 5 is no longer free to rotated relative to the deck assemblies 238.

Figure 31:
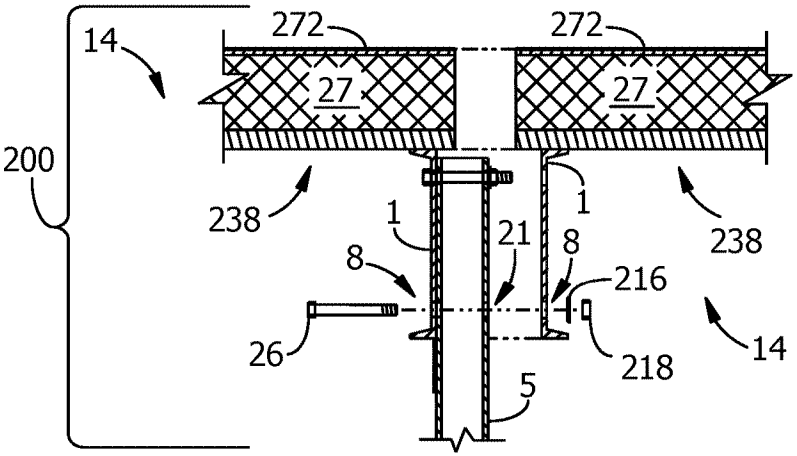
FIG. 31 continues the example of FIG. 30, showing a second roof deck from an adjacent frame assembly in position to be connected to the roof deck and vertical support member of the first frame assembly.
Figure 30:
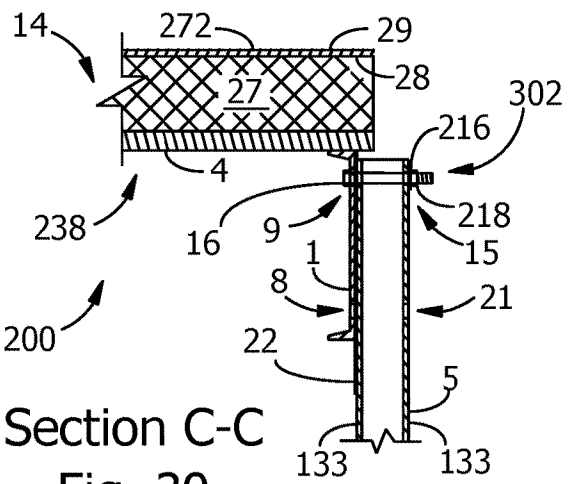
FIG. 30 shows a partial cross-sectional view C-C of an example frame assembly having a deck assembly configured as a roof deck, further illustrating some components of the roof deck and an example of the roof deck rotatably coupled to the vertical support member by a hinge bolt. A location and viewing direction for cross-sectional view C-C is marked by a section line C-C in FIG. 19.
Figure 32:
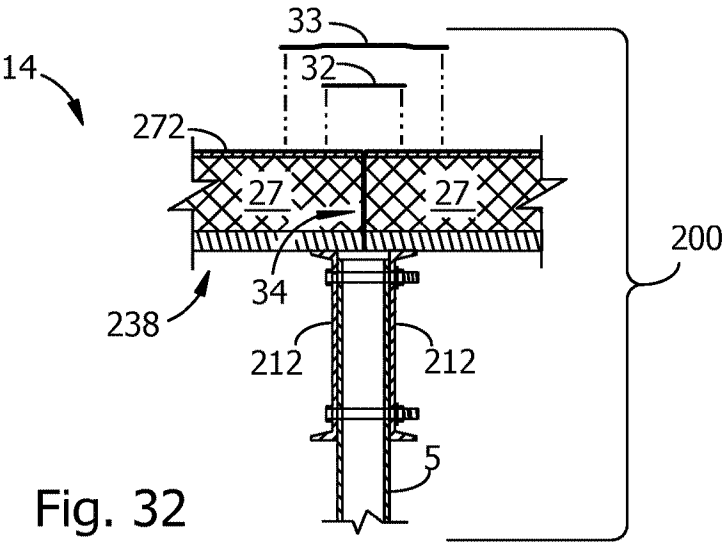
FIG. 32 continues the example of FIG. 31, showing an example of sealing materials being positioned to seal a seam between roof membranes of adjacent roof assemblies.

FIGS. 30-33 show cross sectional views of example connections between adjacent deck assemblies 238 configured to form a building roof. The example deck assembly 238 configured as a roof deck 272 includes a metal deck 4, a layer of insulation 27 possibly made from a rigid material adhered to the metal deck, a rigid board 28 possibly adhered to the insulation layer, and a waterproof sheet or membrane 29 covering the board. In the example of FIG. 30, the roof deck 272 is rotatably coupled to the column 5 by a hinge bolt 16 as previously described for Section A-A in FIG. 26. In the example of FIG. 31, a roof deck from an adjacent frame assembly 14 is positioned for connection to the example frame assembly of FIG. 30, following a procedure comparable to that described for FIG. 28. FIG. 32 continues the example of FIG. 30 and FIG. 31, showing the longitudinal frame members 1 of adjacent frame assemblies affixed to one another by hinge bolts, bolts, and associated washers and nuts as described for FIG. 29. Preferably, a plate whose top surface is aligned with the bottom of the channel beam is attached to the columns to serve as a "beam seat" for easier alignment of the adjacent frame assembly long channel beam bolt holes and attachment of the two folded frame assemblies 14 and 14A.

Figure 33:
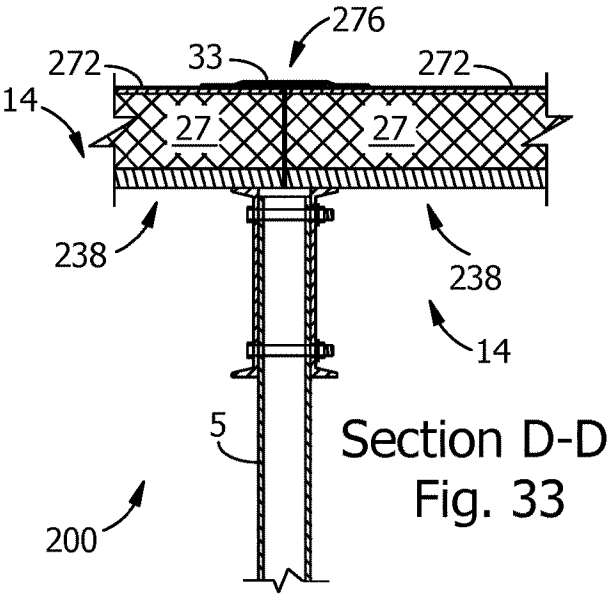
FIG. 33 shows in a cross-sectional view D-D an example of a sealed, watertight roof joint formed by the sealing materials of FIG. 32. A location and viewing direction for cross-sectional view D-D is marked by a section line D-D in FIG. 24.

FIG. 32 further illustrates an example of a sealing material 34 positioned to fill a gap that may be present between adjacent roof decks 272. After the sealing material 34 is added, a first 32 and an optional second 33 overlapping strip of a waterproof sealing membrane may be bonded over seams between roof membranes 29 on adjacent frame assemblies to form a watertight roof joint 276 as shown in the example of FIG. 33. The bonding of overlapping membrane layers may be accomplished by adhesive or by the application of sufficient heat to fuse the layers together.

The deck assemblies of the previous example embodiments 200 include longitudinal frame members shaped as channels having flat faces. The flat faces are either rotatably coupled to column flanges on vertical support members to form a folded frame configuration, or nonrotatably affixed to the column flanges to hold the frame assembly securely in the fully unfolded frame configuration. Rotatable connections 302 between the vertical support members and deck assemblies may be positioned at any preferred location along the flat sides of the longitudinal frame members 1 to give a preferred column-to-column spacing in a building frame. A frame assembly may alternatively include vertical support members having vertical support connectors positioned for forming rotatable connections at opposite longitudinal ends of the deck assemblies. FIGS. 34-65 include examples of frame assemblies having rotatable connections formed by vertical support connectors affixed to vertical support members.

Figure 34:
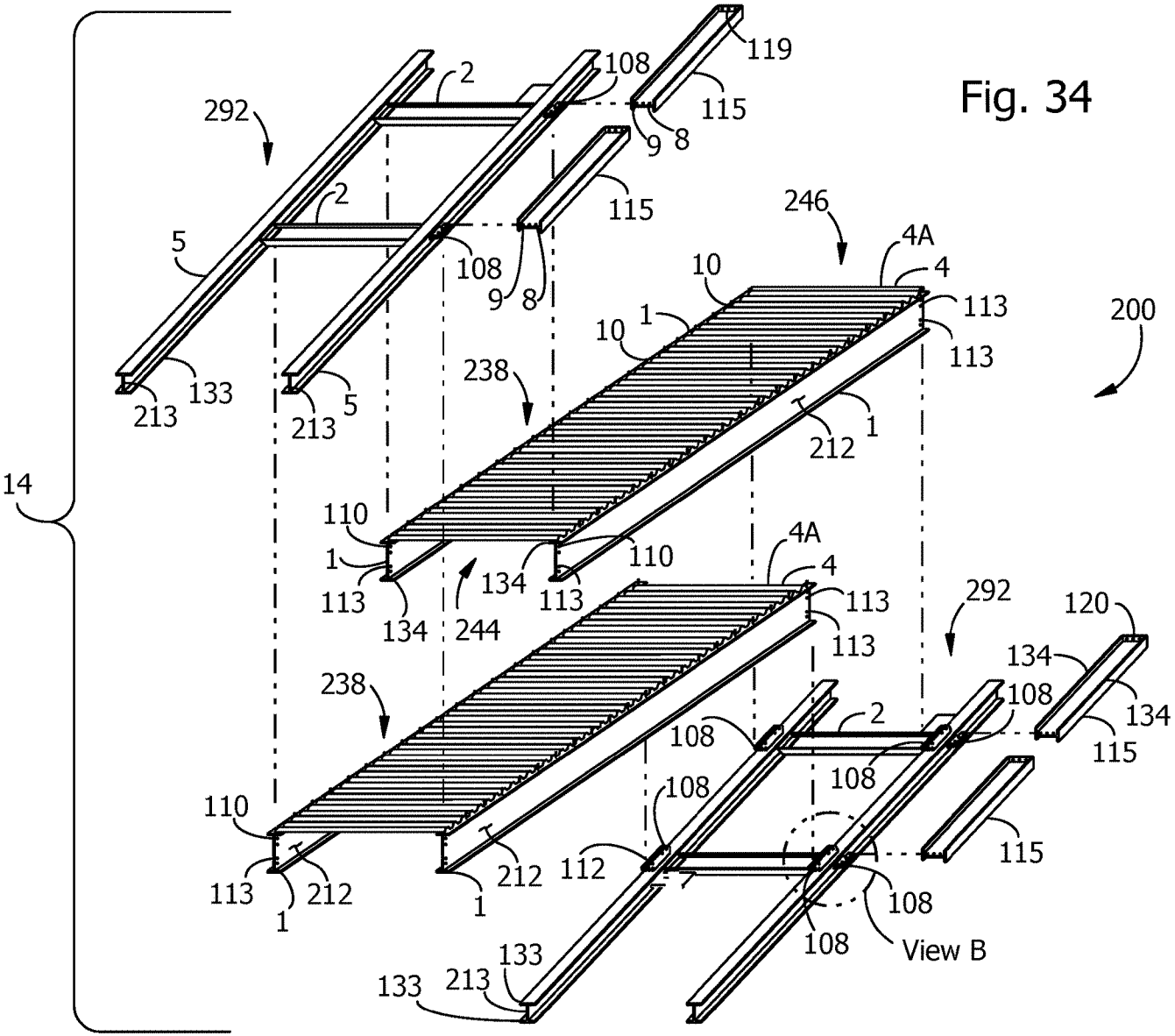
FIG. 34 shows an exploded pictorial view of an example frame assembly having two deck assemblies with the longitudinal frame members of each deck assembly formed from beams with flanges and webs, vertical support members including connectors rotatably coupled to the webs of the longitudinal frame members, and optional transverse beams rotatably coupled to the vertical support members.

An example frame assembly 14 having rotatable connections including vertical support connectors 108 is shown in an exploded pictorial view in FIG. 34. The example frame assembly 14 includes two vertical support members 292 configured to be rotatably coupled to two deck assemblies 23. Each example vertical support member 292 in the example embodiment 200 of FIG. 34 includes two columns 5, which may be H, W, or HSS steel. Transverse frame members 2 are affixed to the column web 213 on each column. Diagonal brace members 6 affixed to the column webs 213 of both columns 5 extend diagonally across the gap between columns spanned by the transverse frame members. Each vertical support member 292 optionally includes one or more transverse beams 115 rotatably coupled to a column 5 by a vertical support connector 108. When provided, the optional transverse beams 115 establish a preferred separation distance between a frame assembly and an adjacent frame assembly and may be used to support an additional deck assembly.

Each deck assembly 238 in the example embodiment 200 of FIG. 34 includes two longitudinal frame members 1 formed from H, W, or HSS beams. Some longitudinal frame members 1 include beam flanges 134 integrally formed with an intervening beam web. Where references are made to connections to a flange of an W beam used to form a longitudinal frame. In some embodiments a metal deck 4 is affixed to beam flanges 134 along the top sides of the longitudinal frame members. An unattached metal deck 4A may alternately be placed on top of the longitudinal frame members. A deck assembly may optionally include metal deck 4 affixed to the longitudinal frame members and unattached metal deck 4A.

Each vertical support member 292 includes a vertical support connector 108 positioned to receive an end of a longitudinal frame member 1 of a deck assembly. In the example of FIG. 34, each column 5 forming part of a vertical support member 292 includes two vertical support connectors 108 affixed to column flanges 133, one for coupling to an end of a longitudinal frame member on the lower deck assembly, and the other for coupling to a longitudinal frame member of the upper deck assembly. For the example frame assembly with two deck assemblies in FIG. 31, four vertical support connectors rotatably couple the four longitudinal frame members to the four columns.

Figures 35, 36:
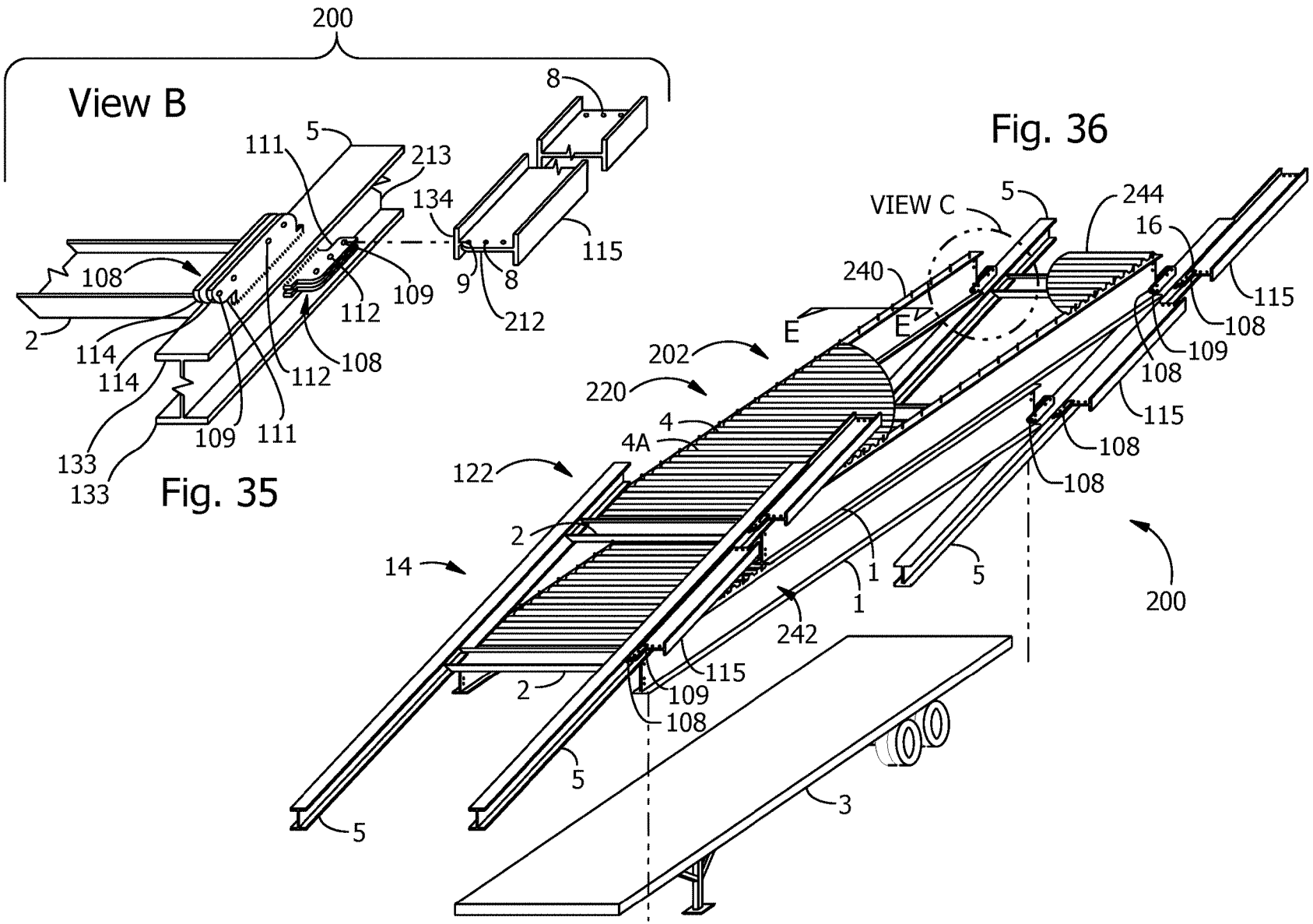
FIG. 35 shows in View B an exploded partial pictorial view of vertical support connectors affixed to a vertical support member, further illustrating an example of a transverse beam configured for rotatable connection to one of the vertical support connectors. The frame assembly location represented in View B is marked with a broken-line circle in FIG. 34.
FIG. 36 shows a pictorial view of the folded frame configuration of the frame assembly example of FIG. 34 and FIG. 35, further illustrating an example of the folded frame in position to be loaded on a trailer.

Example vertical support connectors 108 affixed to a column 5 included in some embodiments of a vertical support member 292 are shown in the partial exploded pictorial view of FIG. 35. A vertical support connector includes one, and optionally two, connector plates affixed to a column flange 133 for coupling to a longitudinal frame member or to a column web 213 for coupling to a transverse beam 115. Each connector plate 114 is formed with a hinge bolt aperture 109. The hinge bolt aperture is positioned to align with a corresponding hinge bolt aperture 110 in a beam rotatably coupled to the vertical support connector by a hinge bolt. Each connector plate is optionally formed with a flange gap 111 near the hinge bolt aperture. The flange gap 111 is positioned to receive a beam flange from a longitudinal frame member or a transverse beam rotatably coupled to the vertical support connector when a frame assembly is rotated into the folded frame configuration.

FIG. 36 shows an example of a folded frame configuration 220 for the two-deck frame assembly 202 of FIGS. 34-44. The example folded frame configuration shows the upper deck assembly resting on top of the lower deck assembly, the vertical support members and transverse beams rotated to their folded positions, and the frame assembly positioned for loading onto a conveyance 3.

Figure 37:
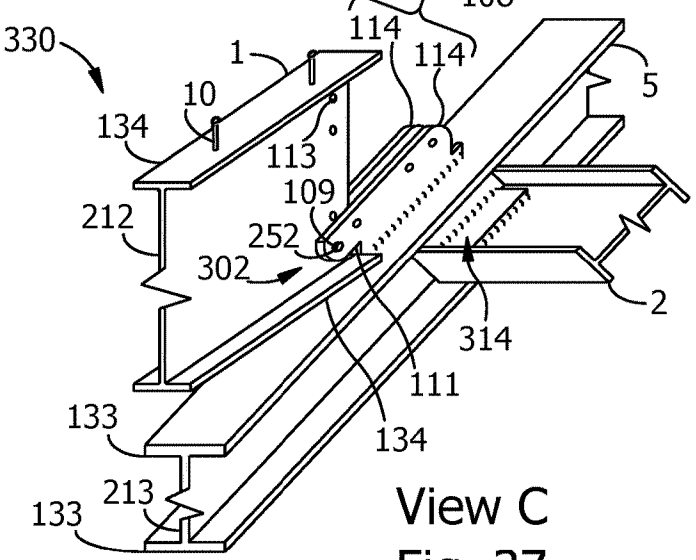
FIG. 37 shows in View C a partial pictorial view of some details of the connections of the longitudinal frame member, vertical support connector, and vertical support member from the example frame assembly embodiment of FIGS. 31-33, with the longitudinal frame member positioned for a folded frame configuration. The frame assembly location represented in View C is marked with a broken-line circle in FIG. 36.

View C in FIG. 37 illustrates a partial pictorial view of an example rotatable connection 302 for the frame assembly embodiments of FIGS. 34-44. The vertical support connector 108 is affixed to a column web 213 of a column 5. A connector hinge bolt 252 passes through hinge bolt apertures 109 formed in the connector plates 114 and through a hinge bolt aperture 110 (ref. FIG. 34) formed in the beam web 212 of the longitudinal frame member 1. A beam flange 134 of the longitudinal frame member is shown entering the flange gap 111 as the longitudinal frame member rotates into a partially unfolded frame configuration.

FIG. 37 further illustrates an example transverse frame member 2 affixed to the column 5 near the vertical support connector 108 for the longitudinal frame member 1. An optional support plate 314 affixed to the column web 213 of the column 5 and the web and/or flanges of the transverse frame member improves the strength of the connection between the column and the transverse frame member.

Figure 38:
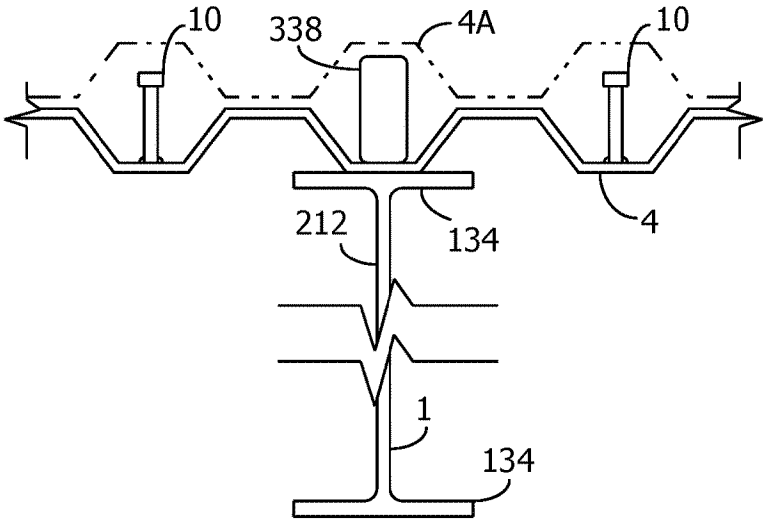
FIG. 38 is a partial end view of a longitudinal frame member for a deck assembly and examples of one attached metal deck and one relocated unattached metal deck in contact with a beam flange of the longitudinal frame member.

FIG. 38 shows an example of two metal decks 4 positioned on a top surface of a beam flange 134 for a longitudinal frame member 1. One of the decks 4 is part of the same frame assembly as the longitudinal frame member. The other deck 4 is part of an adjacent frame assembly. The two decks 4 are optionally separated by intervening stud bolts 10 welded to the longitudinal frame member. In some embodiments, unattached metal decks 4A rest against, but are not affixed to, the longitudinal frame members. Unattached metal decks 4A may be position with the aid of a roller mechanism 338.

Figure 40:
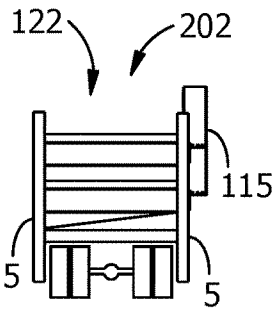
FIG. 40 is an end view of the trailer and frame assembly of FIG. 39.
Figure 39:
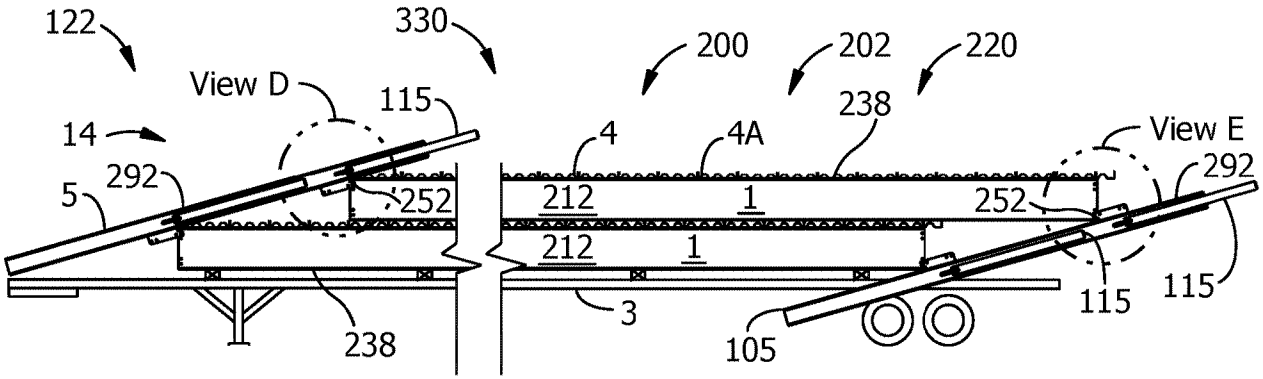
FIG. 39 is a side view of the example frame assembly of FIGS. 34-38 with the frame assembly loaded on a trailer in the folded frame configuration.

FIG. 39 shows a side view of an example frame assembly loaded aboard a conveyance 3. FIG. 40 shows an end view of the frame assembly from FIG. 39. The example folded frame configuration 220 arranges the two vertical support members 292 parallel to one another and the two deck assemblies 238 parallel to one another. For the frame assembly 14 to fold as shown in FIG. 39, the connector hinge bolts 252 are preferably positioned to pass through diagonally opposite corners of the beam web 212 of the longitudinal frame members 1.

Figure 41:
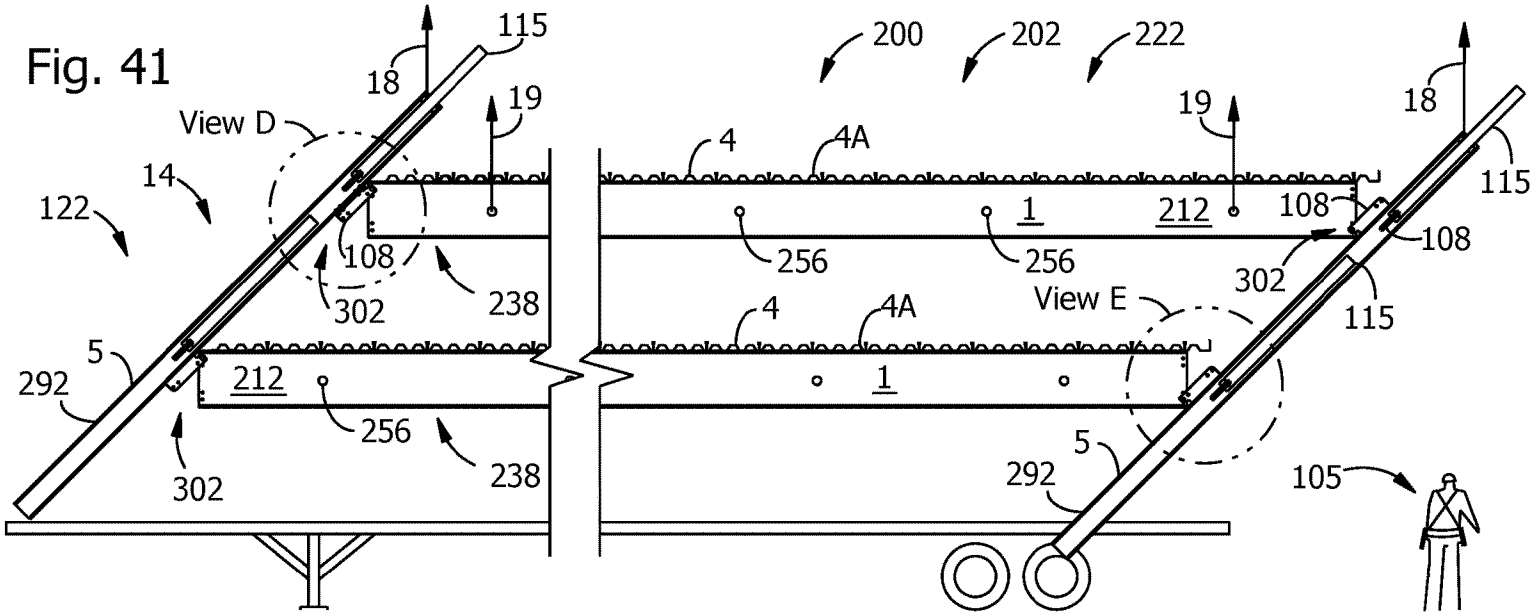
FIG. 41 is a side view of the example frame assembly of FIGS. 31-37, showing an example of the frame assembly in a partially unfolded configuration resulting from lifting the frame assembly by the upper ends of the vertical support members or from the top beam to remove the frame assembly from the trailer.
Figure 42:
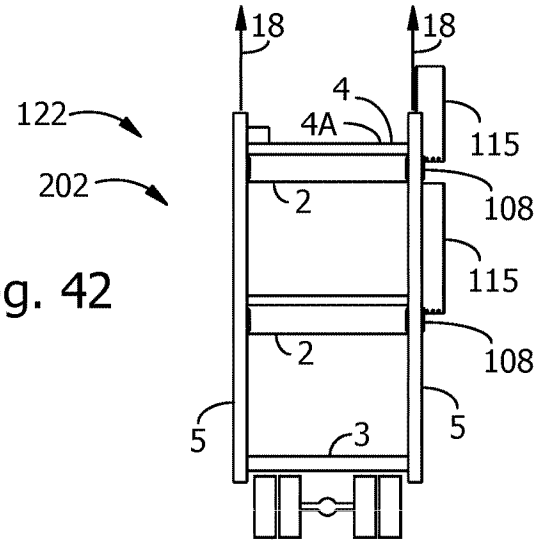
FIG. 42 shows an end view of the frame assembly and trailer of FIG. 41, illustrating an example of the transverse beams folded parallel to the vertical support members for transport aboard the trailer, and further showing that the transverse beams may remain folded while the frame assembly unfolds.

FIG. 41 and FIG. 42 continue the examples of FIG. 39 and FIG. 40, showing the two-deck frame assembly 202 in a partially unfolded frame configuration 222. A sketch of a construction worker 105 is included in FIG. 41 to suggest the approximate size of the example frame assembly 14. It will be appreciated that the example embodiments 200 may include frame assemblies that are substantially larger than the illustrated examples, or may alternatively include frame assemblies that are substantially smaller than the illustrated examples. As for other folded frame configurations of the disclosed example frame assembly embodiments 14, lifting the vertical support members 292 from the top ends of the columns 5 rotates the vertical support members away from the folded frame configuration into a partially unfolded frame configuration 222. FIG. 41 further illustrates an example frame assembly 122 with two floor decks and four columns. The columns remain parallel to other columns and the deck assemblies remain parallel to one another as the frame assembly transitions from the folded configuration to the fully unfolded configuration, for example by lifting at positions indicated by lift vectors 18 on the ends of the columns 5 or at positions indicated by lift vectors 19 on the longitudinal frame members 1.

Figure 43:
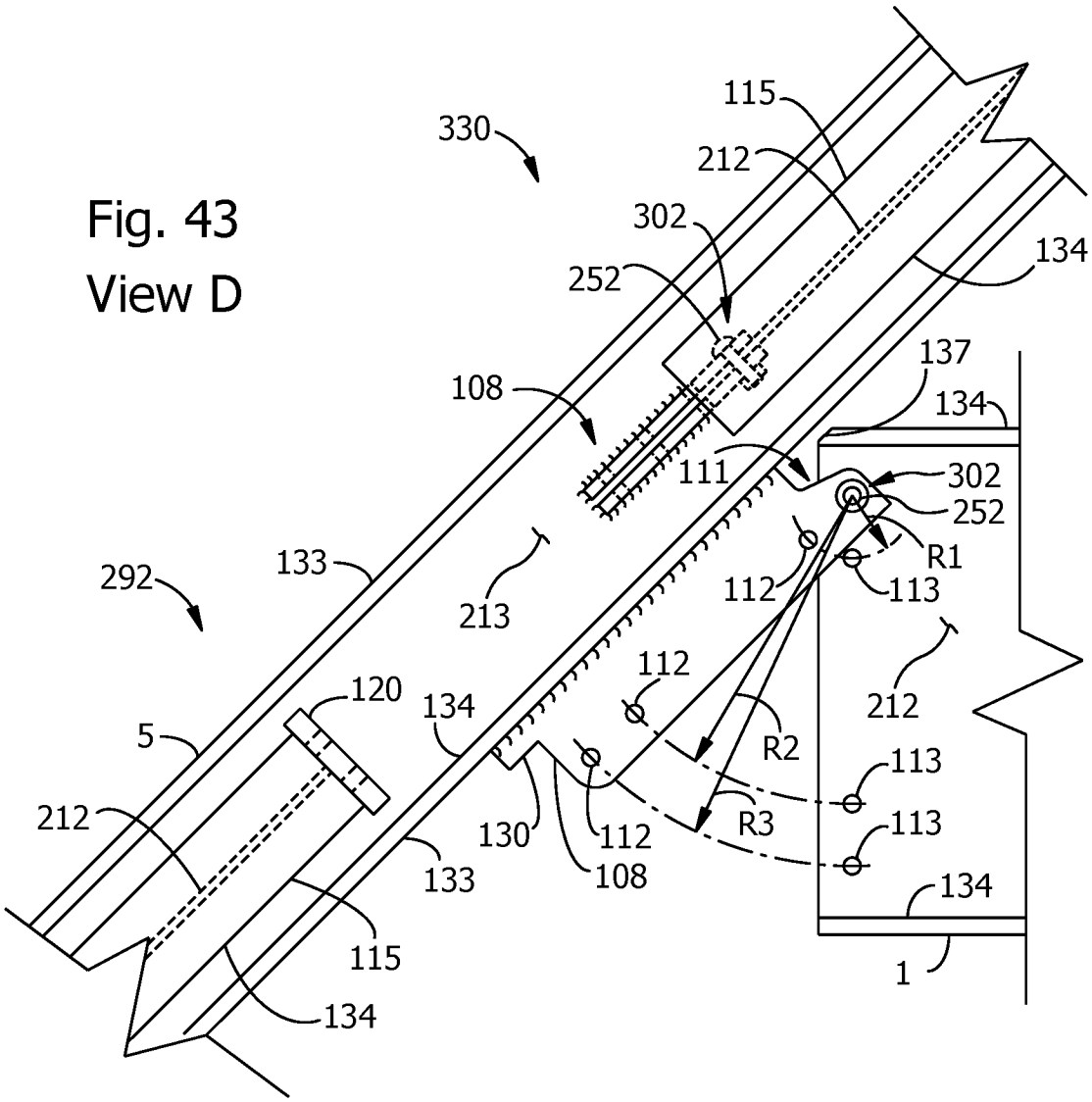
FIG. 43 shows in View D some details of the vertical support connectors rotatably connecting the transverse beam and longitudinal frame member to the vertical support member, and further illustrating an example of preferred alignment between bolt apertures in the vertical support connector and corresponding bolt apertures in the web of the longitudinal frame member. The frame assembly location represented in View D is marked with a broken-line circle in FIG. 41.
Figure 44:
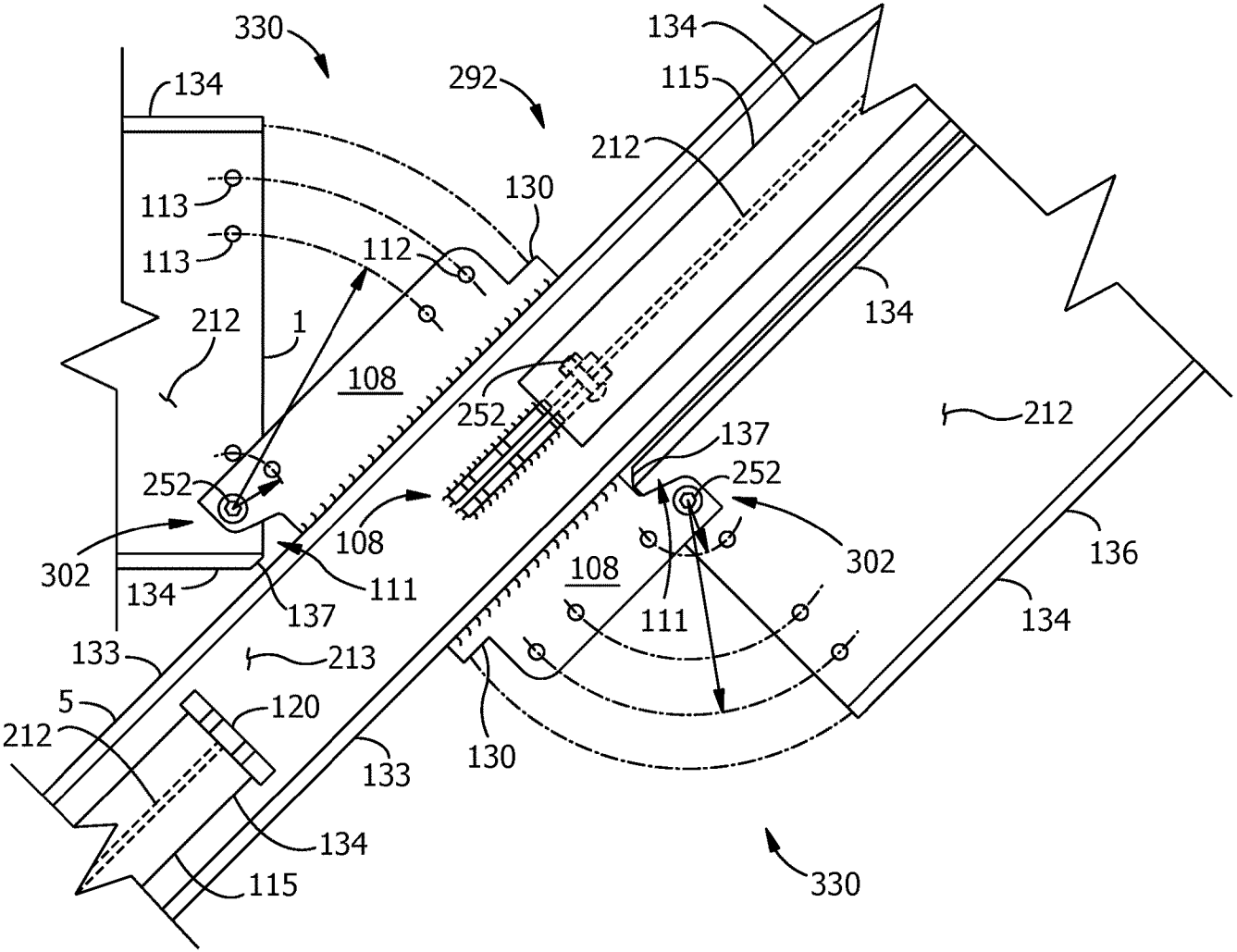
FIG. 44 continues the example of FIG. 43, showing in View E another vertical support connector at an end of the longitudinal frame member opposite the end shown in FIG. 43, and further illustrating an example of an optional beam rotatably coupled to the vertical support member with the web of the longitudinal frame member and the web of the optional beam having coincident centerlines. The frame assembly location represented in View E is marked with a broken-line circle in FIG. 41.

Apertures for hinge bolts and bolts formed in the vertical support connectors are preferably positioned to align with corresponding apertures formed in the longitudinal frame members. Examples of apertures positioned for alignment with one another are shown in FIG. 43 and FIG. 44. Each vertical support connector 108 is affixed, for example by welding, to a vertical support member 292. A vertical support member is represented in the examples of FIG. 43 and FIG. 44 by a segment of a column 5. FIG. 43 shows two examples of vertical column connectors 108. A first vertical column connector 108 is affixed to the column web 213 of the column 5. A transverse beam 115 is rotatably coupled to the first vertical column connector by a first connector hinge bolt 252 passing through apertures formed in the vertical column connector and the beam web 212 of the transverse beam. A second vertical column connector 108 is affixed to a column flange 133 of the column 5. A longitudinal frame member 1 is rotatably coupled to the second vertical column connector by a second connector hinge bolt 252 passing through apertures formed in the vertical column connector and the beam web 212 of the longitudinal frame member. The first and second vertical column connectors are further formed with bolt apertures positioned to align with corresponding bolt apertures 213 form in the beam web 212 of the transverse beam 115 and the beam web 212 of the longitudinal frame member 1.

For each rotatable connection 302 including a vertical support connector 108, the connector hinge bolt 252 establishes a center of rotation about which the rotatably coupled structural member rotates. A first bolt aperture 112 on the vertical support connector and a first bolt aperture 113 in a beam web are both positioned a same radial distance R1 from the center of rotation of the hinge bolt. An optional second bolt aperture 112 on the vertical support connector and an optional second bolt aperture 113 on the beam web are both positioned a same radial distance R2 from the center of rotation of the hinge bolt. An optional third bolt aperture 112 on the vertical support connector and an optional third bolt aperture 113 on the beam web are both positioned a same radial distance R3 from the center of rotation of the hinge bolt. When the frame assembly 14 is placed in the unfolded frame configuration, apertures positioned a same radial distance from a center rotation may be coaxially aligned so that a bolt may pass through the aligned apertures. More or fewer apertures may be provided as needed. A beam stop 130 is provided to help aid in the alignment of the apertures.

FIG. 44 further illustrates an example of an optional hinged short beam 136 rotatably connected to the column 5 by a third vertical support connector 108. The vertical support connectors 108 for the longitudinal frame member 1 and the hinged short beam 136 will preferably be positioned on the column 5 such that a longitudinal centerline through the beam web 212, a centerline through the column web 213, and another longitudinal centerline through the beam web 212 of the hinged short beam 136 are colinear with one another. Examples of colinear centerlines will be shown in more detail in FIG. 46.

The hinged short beam 136 is shown in a folded frame configuration with a beam flange 134 of the hinged short parallel to a flange 133 of the column 5. The beam flange 134 of the hinged short beam 134 may be formed with a chamfered corner 137. The vertical support member 108 may optionally be formed with a flange stop 130 to stop rotation of a rotatably coupled beam (e.g., 1, 134) when the apertures in the vertical support connector and the beam are aligned with one another, thereby establishing a fixed reference position for an unfolded frame configuration and making it easier to pass a bolt through the aligned apertures.

Figure 45:
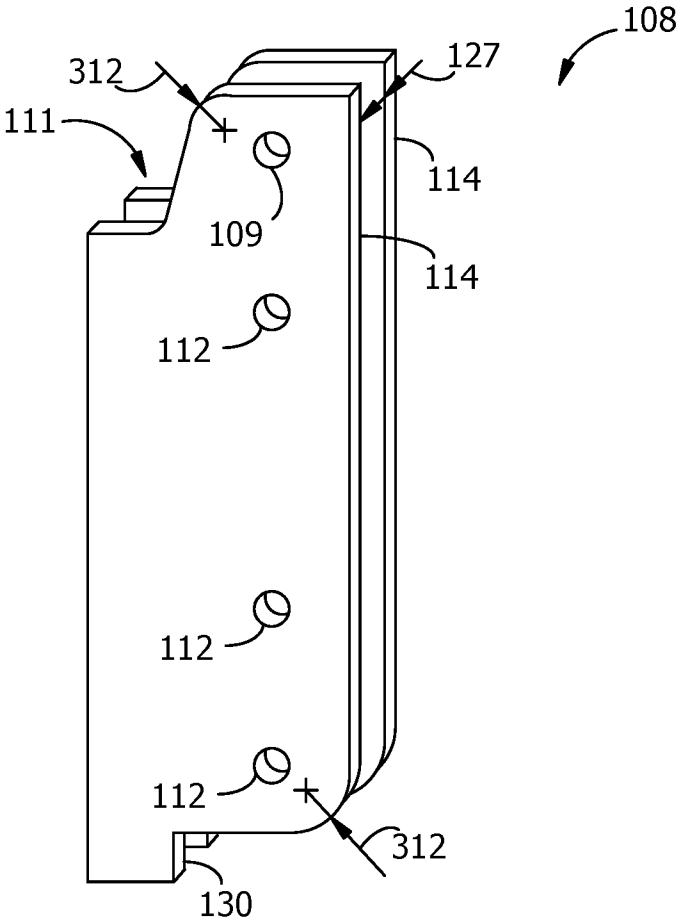
FIG. 45 is a pictorial view of an example of a vertical support connector in accord with the disclosed embodiments.
Figure 46:
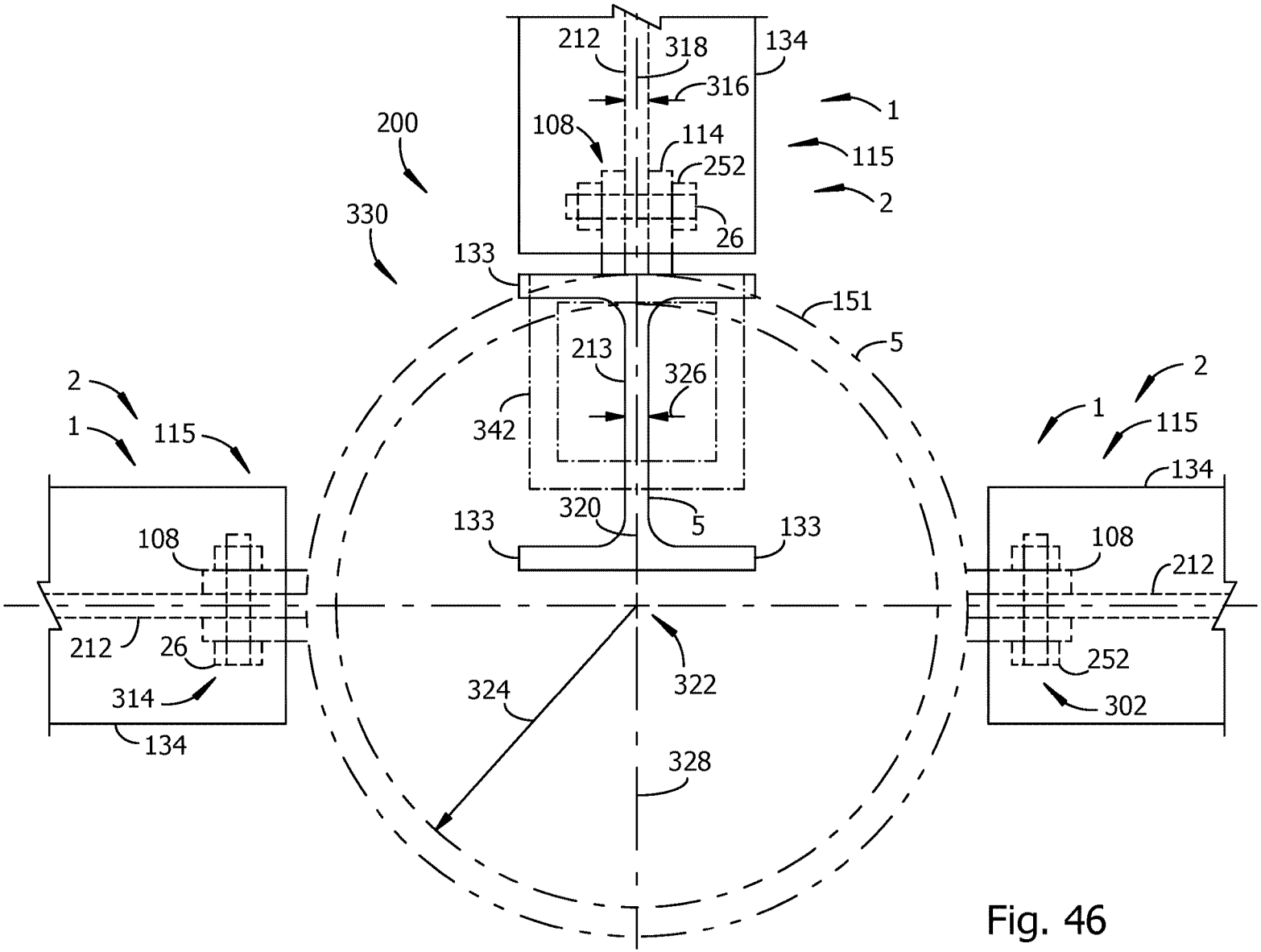
FIG. 46 is a schematic representation of alternative examples of a vertical support member and examples of attached horizontal beams, for example a transverse beam coupled to a vertical support member so as to establish a preferred condition of coincident centerlines, an example of a vertical support member having flanges and a web, and an example of a vertical support member formed from a hollow structural steel (HSS) tube shaped with cylindrical walls.

FIG. 45 shows a pictorial view of an example vertical support connector 108. A vertical support connector 108 includes one and optionally two connector plates 114. The optional second connector plate is preferably parallel to the first connector plate and is preferably separated from the first connector plate by a plate gap 127 have a dimension greater than a thickness dimension 316 of a beam web. An example thickness dimension 316 of a beam web is shown in FIG. 46. The connector plates may optionally be formed with a first corner radius 312 to provide clearance for the beam flange of a rotatably coupled beam being moved into or out of the folded frame condition. A second optional corner radius 312 may be formed near an end with the flange stop 130 to provide clearance for the beam flange of a rotatably coupled beam being moved into the unfolded frame configuration.

Embodiments 200 having vertical support connectors 108 affixed to vertical support members 5 will preferably have the vertical support connectors positioned to establish what are referred to herein as "colinear centerlines". A schematic view of examples of support members with coincident centerlines 330 is shown in FIG. 46. A first example of colinear centerlines shows a support member having a beam web 212 integrally formed with one or more beam flanges 134 rotatably coupled to a column flange 133 of a column 5. The view in FIG. 46 is downward toward the top end of a vertically-positioned column 5. The support member represents examples of a longitudinal frame member 1, a transverse frame member 2, and a transverse beam 115, any of which may be rotatably coupled to a column 5. A vertical support connector 108 is affixed to the column flange 133. A connector hinge bolt 252 passes through aligned apertures formed in the vertical support connector and the beam web 212. Bolts 26 passing through the vertical support connector and beam web are spatially separate from, but visually in line with, the connector hinge bolt 252 in the viewing direction represented in FIG. 46. The connector plates 114 of the vertical support connector are spaced apart from one another by at least the thickness of the beam web 212 to admit the beam web 212 between the connector plates. The vertical support connector 108 is preferably affixed to the column 5 such that a first centerline 318 passing midway through a thickness dimension 316 of the beam web 212 is colinear with a second centerline 320 passing midway through a thickness dimension 326 of the column web 213.

A second example of colinear centerlines in FIG. 46 replaces the example column 5 having a column web and column flanges with another example column 5 formed from a steel tube 151 shaped as a hollow cylinder with a circular cross section. The wall of the steel tube 151 is marked by broken lines. The cylindrical column 5 has an internal radius 324 from a radial center 322 to an internal surface of the steel tube. A vertical support connector 108 affixed to an outer surface of the steel tube will preferably be positioned with the first centerline 318 passing midway through the thickness dimension 316 of the beam web 212 is colinear with a second centerline 328 passing through the radial center 322 of the cylindrical column 151. An HSS tube 342 with a hollow square or rectangular cross-section may alternatively be used instead of the column 5.

Figure 47:
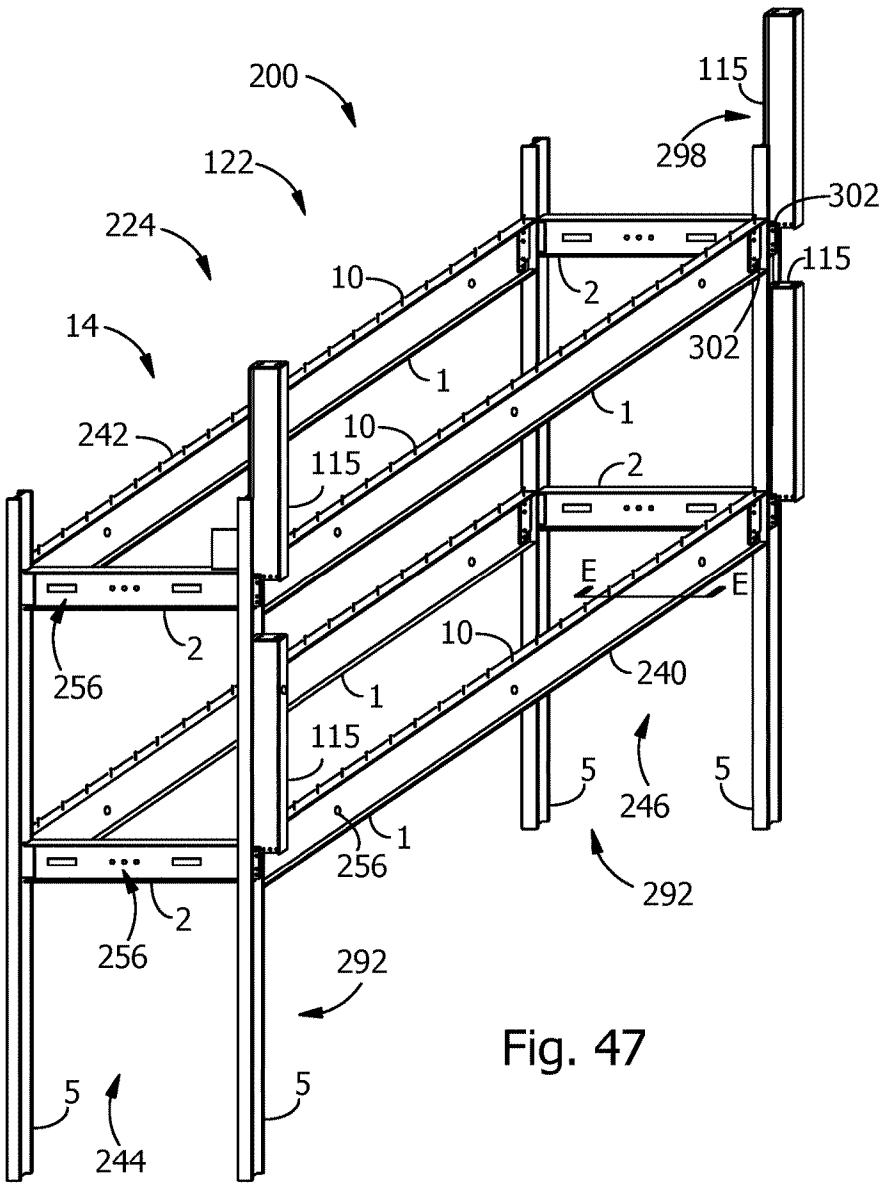
FIG. 47 shows a pictorial view of an example frame assembly having four vertical support members rotatably coupled to opposite ends of longitudinal frame members, the vertical support member having vertical support connectors attached to flanges on the vertical support members, the longitudinal frame members and vertical support members in a fully unfolded configuration, and the transverse beams folded approximately parallel to the vertical support members.

Another example of a frame assembly with two floor decks and four columns 122 is shown in FIG. 47. The metal deck 4 has been omitted in the example of FIG. 47 to more clearly show connections between the columns 5, the longitudinal support members 1, the transverse frame members 2, and the transverse beams 115.

Unless expressly stated otherwise herein, ordinary terms have their corresponding ordinary meanings within the respective contexts of their presentations, and ordinary terms of art have their corresponding regular meanings. The two columns 5 at the first end 244 are optionally affixed to one another by intervening brace members 6 and transverse frame members 2, thereby forming a structurally rigid vertical support member 292 rotatably coupled at the first end of the longitudinal frame members. The two columns 5 at the second end 246 are optionally affixed to one another by intervening brace members 6 and transverse frame members 2, thereby forming another structurally rigid vertical support member 292 rotatably coupled at the second end of the longitudinal frame members.

FIG. 47 further illustrates examples of transverse beams rotatably coupled to the vertical support members 292. As suggested in FIG. 48, each of the transverse beams 115 is rotatably coupled to a column by a hinge bolt passing through a rotatable coupling 302 including a vertical support connector 108. The transverse beam 115 is shown in an example folded position 298 (solid outline) and is rotatable in a direction 126 to a fully unfolded position 300 (broken-line outline). The fully unfolded position 300 may also be referred to as the horizontal position 300. FIG. 49 continues the examples of FIG. 47 and FIG. 48, showing the examples of an attached 4 and optional unattached 4A metal deck on the longitudinal frame members of each deck assembly.

Figure 48:
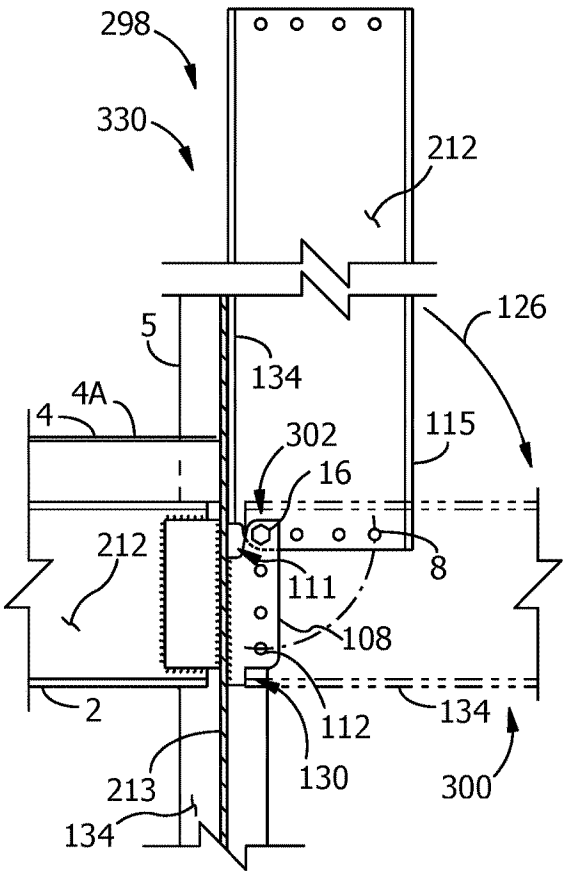
FIG. 48 is a cross-sectional view E-E showing some details of the vertical support connector and transverse beam from the frame assembly example of FIG. 47.
Figure 49:
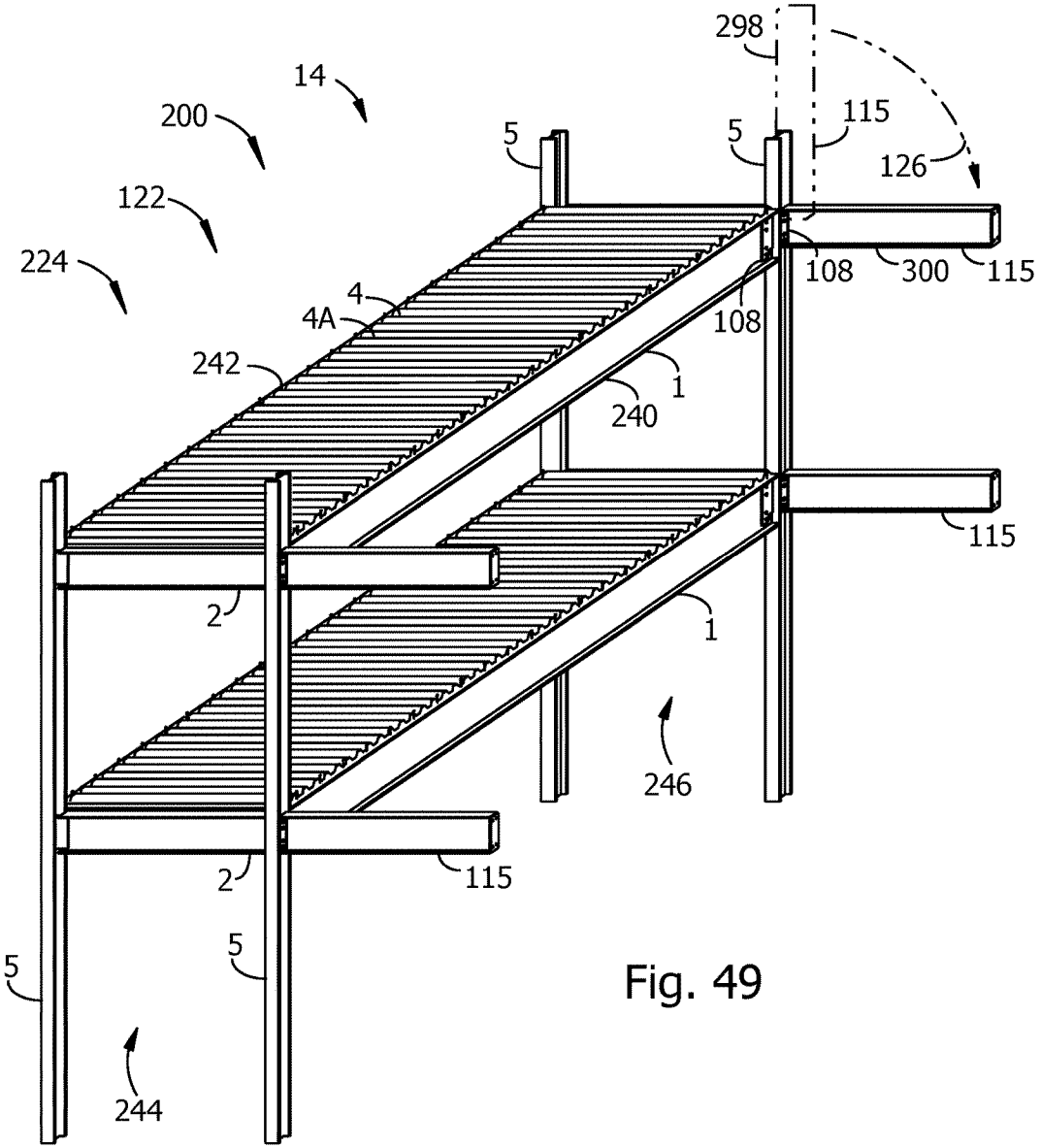
FIG. 49 continues the example of FIG. 47 and FIG. 48, showing the transverse beams rotated away from the vertical support members into a horizontal position.
Figure 50:
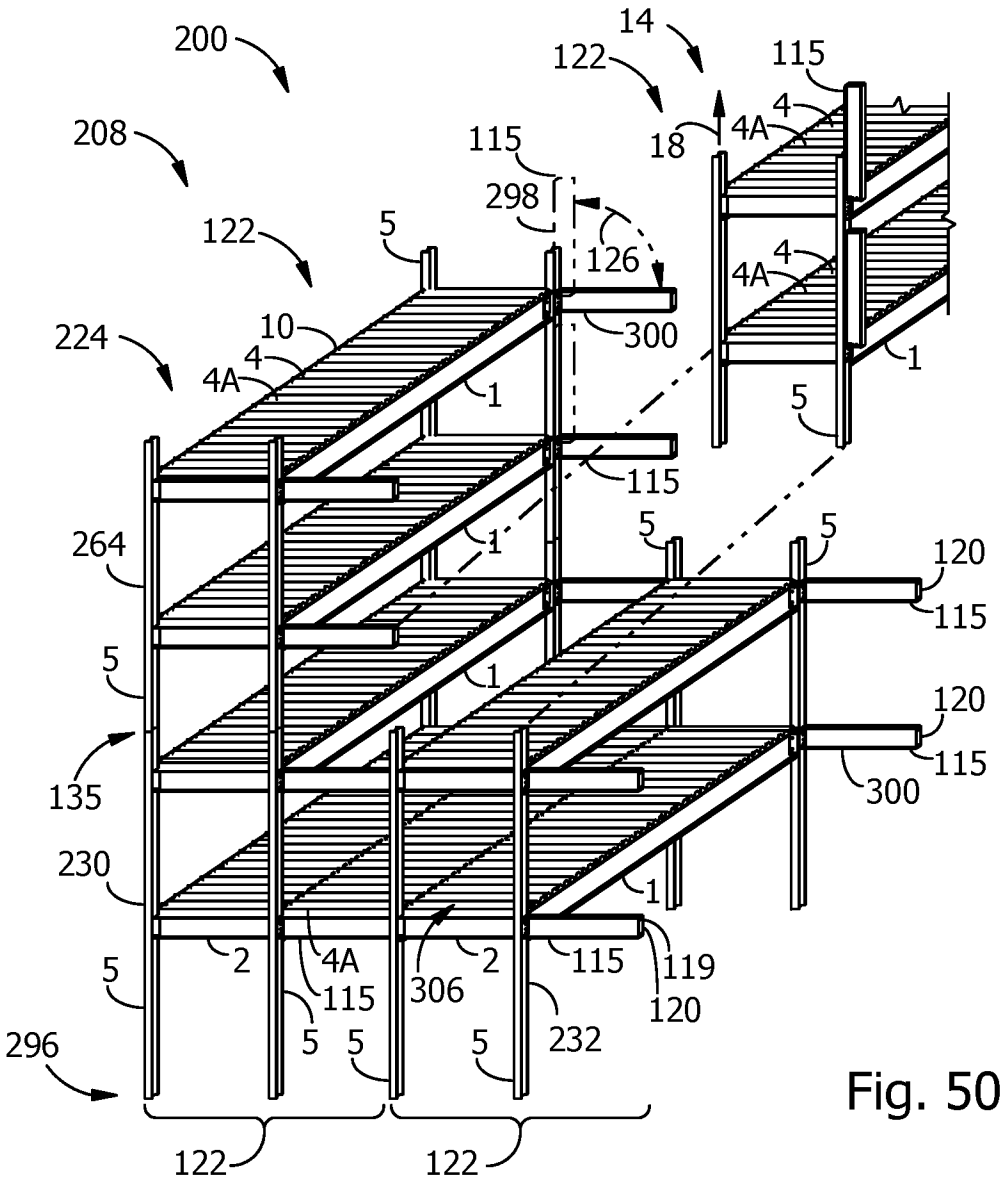
FIG. 50 shows a partial exploded pictorial view of an example building frame constructed with the frame assembly of FIGS. 47-49.

FIG. 50 illustrates an example of a building frame 208 in process of being constructed from the example frame assemblies 14 of FIGS. 47-49. Each of the frame assemblies in FIG. 50 are shown in the fully unfolded frame configuration.

As suggested in FIG. 50, the transverse beams 115 of a first deck assembly 230 at ground level are affixed to the columns 5 of an adjacent second deck assembly 232 at ground level. After the transverse beams 115 of the first deck assembly are affixed to the second deck assembly, for example by passing bolts through apertures 119 formed in an end of the transverse beam on the first frame assembly and a column web on the second frame assembly, a metal deck 4 may be placed on top of the transverse beams 115 and the longitudinal frame members to form a building floor 306 extending across both frame assemblies. FIG. 50 further shows an example of a third frame assembly 264 stacked column-to-column on top of the first frame assembly and a partial view of a fourth frame assembly being positioned before being affixed in the building frame adjacent the third frame assembly and on top of the second frame assembly. The columns 5 of the stacked frame assemblies may be affixed to one another at column splices 135. Connector plates are not shown.

Some embodiments of a frame assembly 14 having vertical support members rotatably coupled to deck assemblies 238 by vertical support connectors 108 include columns 5 with column flanges 133 separated by an intervening column web 213, as shown for example in FIGS. 34-44. Other embodiments of a frame assembly 14 having vertical support members and vertical support connectors 108 replace some of the flanged columns with HSS columns having outer walls with square, rectangular, or circular perimeter shapes. For example, two, and optionally all four, of the flanged columns 5 in the frame assembly example of FIG. 49 are replaced in some embodiments 200 by HSS columns. Frame assemblies with vertical support members 292 including HSS columns 151 instead of flanged columns 5 are shown in the example embodiments 200 of FIGS. 51-63.

Figure 51:
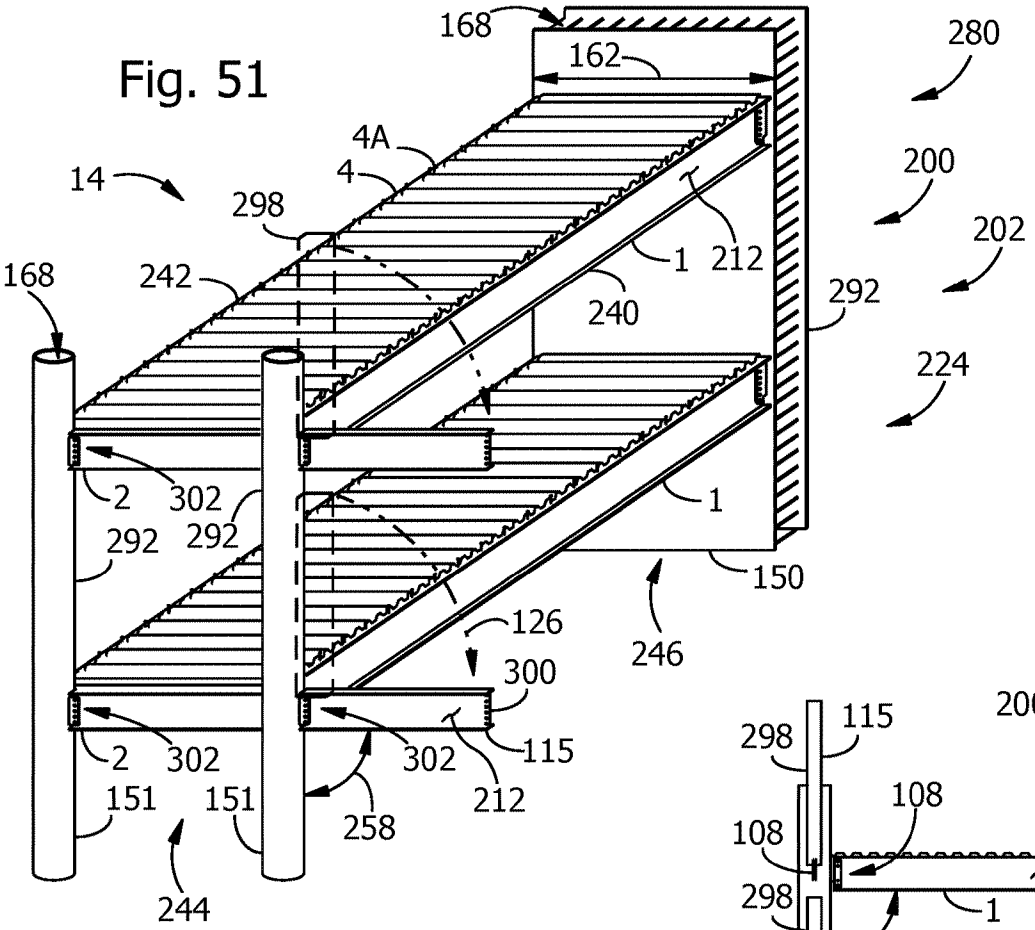
FIG. 51 is a pictorial view of a fully unfolded configuration of an example frame assembly having two deck assemblies rotatably coupled to two vertical support members, each vertical support member formed as a cylinder, and a third vertical support member including a hollow form for concrete fill.
Figure 52:
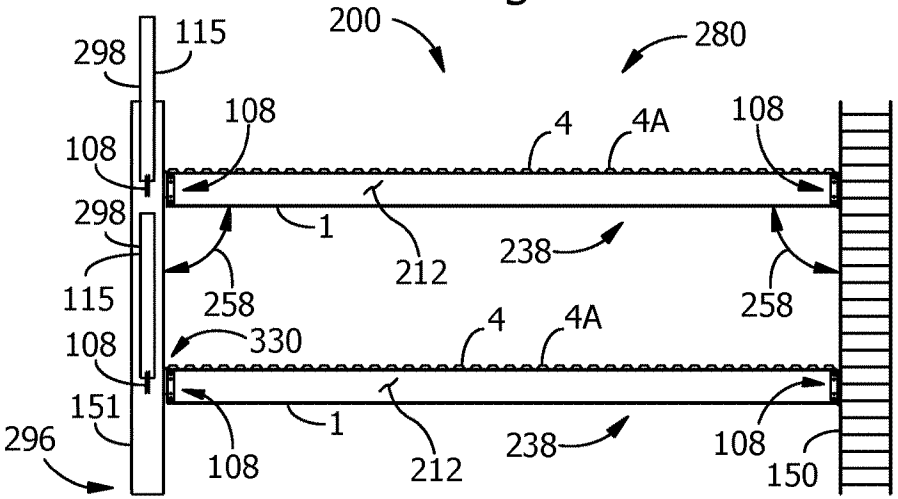
FIG. 52 is a side view of the example frame assembly of FIG. 51.

A frame assembly using HSS columns 151 for vertical support members 292 optionally includes transverse beams 115 rotatably coupled to the HSS columns by vertical support connectors 158. FIG. 51 shows an example frame assembly including two HSS columns 151 and two transverse beams 115. The frame assembly 14 in FIG. 51 is an example of a two-deck frame assembly 202 shown in a fully unfolded frame configuration 224. The transverse beams 115 are rotatable in a direction 126 from a position corresponding to a folded frame configuration or a partially unfolded frame configuration, marked by broken lines in FIG. 51, to a fully unfolded position with each of the transverse beams at a 90 degree angle 258 to the HSS columns. FIG. 52 shows a side view of the example frame assembly of FIG. 51. The transverse beams 115 in FIG. 52 are shown in an example of a folded position 298 while the HSS columns and deck assemblies 238 are shown in an example of a fully unfolded configuration.

Figure 53:
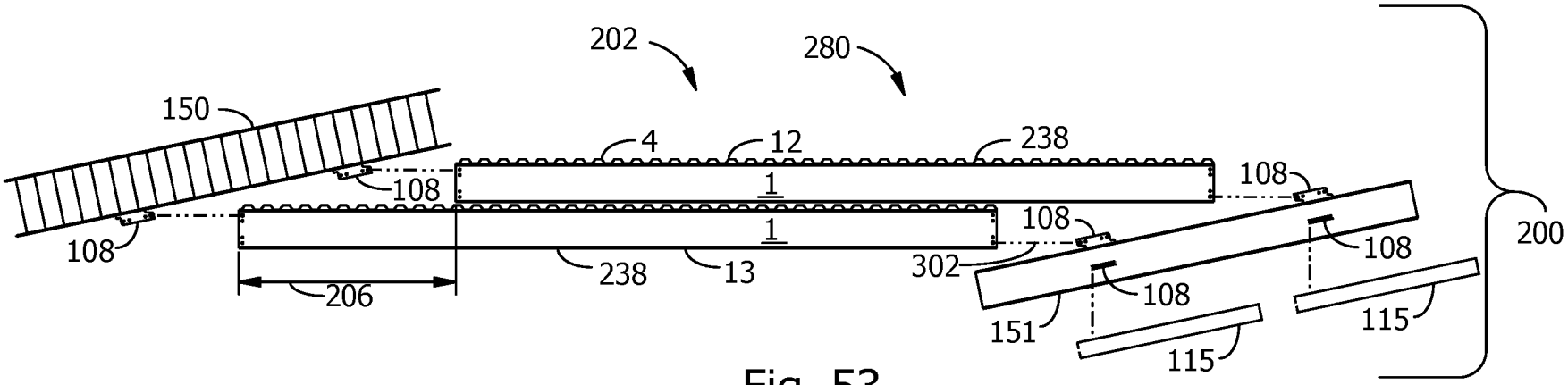
FIG. 53 is an exploded view toward a side of the example frame assembly of FIG. 51 and FIG. 52.

An example of components positioned for connection to form the example frame assembly 14 of FIG. 51 is shown in an exploded side view in FIG. 53. Each deck assembly in the example of FIG. 53 optionally includes previously installed MEP/FP components, for example the MEP/FP components shown schematically in FIG. 6. The upper floor deck assembly 12 may be placed on top of the lower floor deck assembly 13 with an end of the upper floor deck assembly displaced in a longitudinal direction by an offset distance 206 from the nearest end of the lower floor deck assembly. The offset distance 206 is selected to cause the hinge bolt apertures in the vertical column connectors 108 to align with the corresponding hinge bolt apertures 110 in the longitudinal fame members 1 of each deck assembly, enabling hinge bolts to be passed through the aligned apertures.

Figure 55:
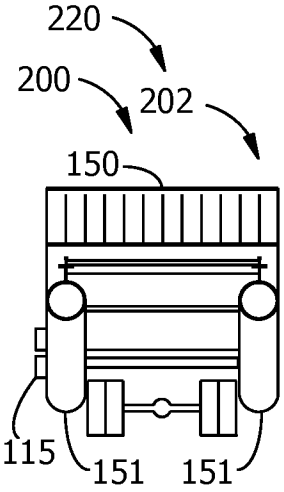
FIG. 55 is an end view of the example frame assembly and trailer of FIG. 54.
Figure 54:
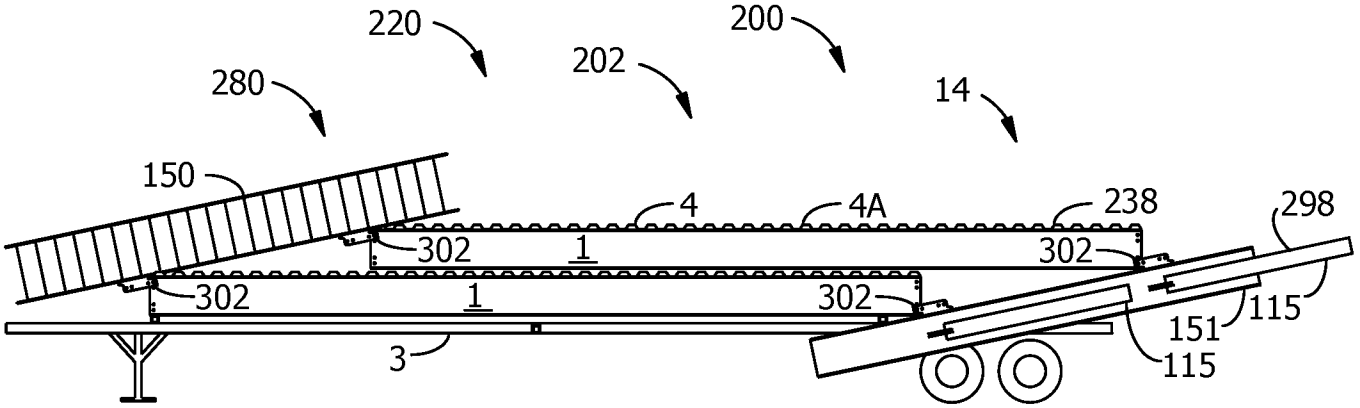
FIG. 54 is a side view of the folded frame configuration of the example frame assembly of FIGS. 51-53, showing the frame assembly loaded on a trailer.
Figure 56:
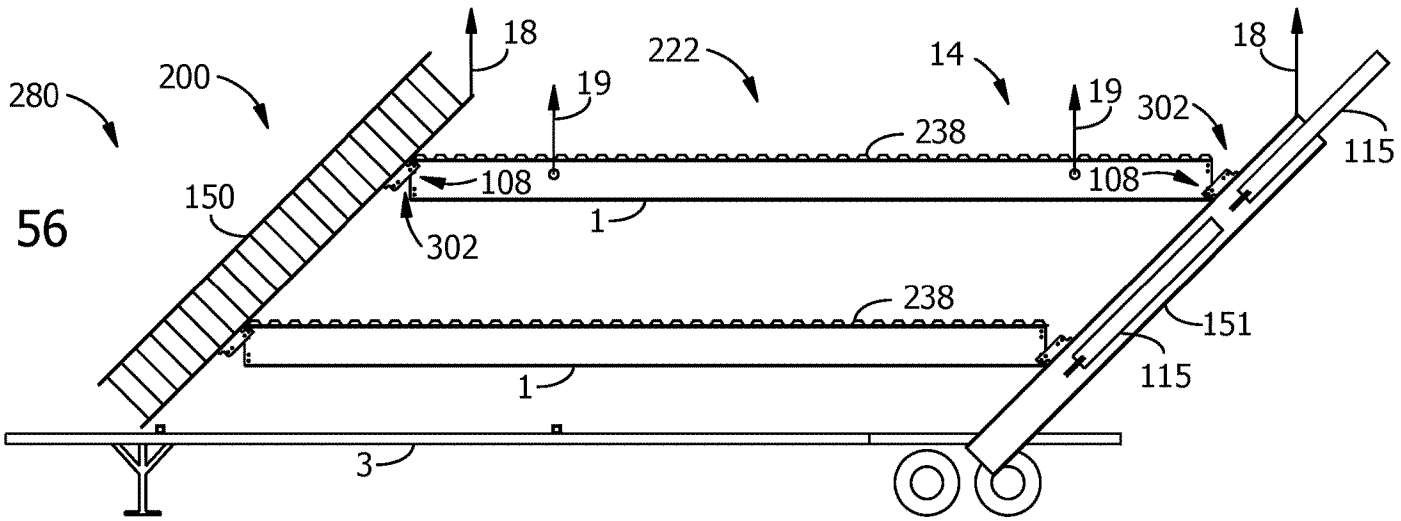
FIG. 56 is a side view of the partially unfolded configuration of the example frame assembly of FIGS. 51-55.
Figure 57:
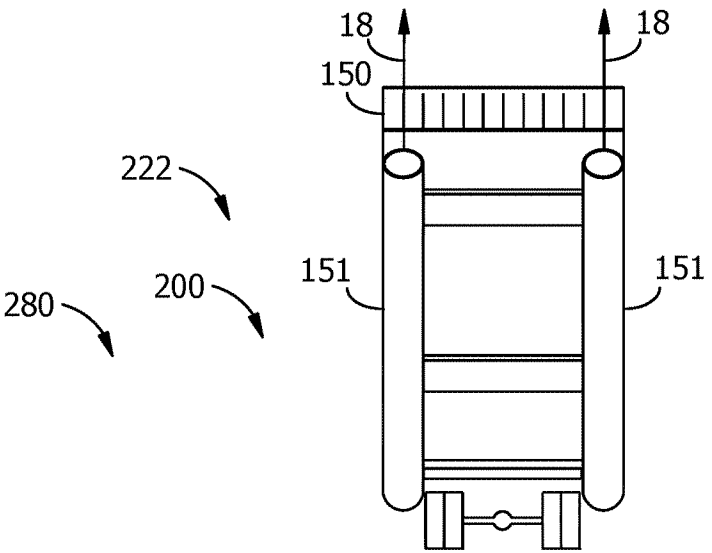
FIG. 57 is an end view of the partially unfolded frame assembly and trailer of FIG. 56.
Figure 58:
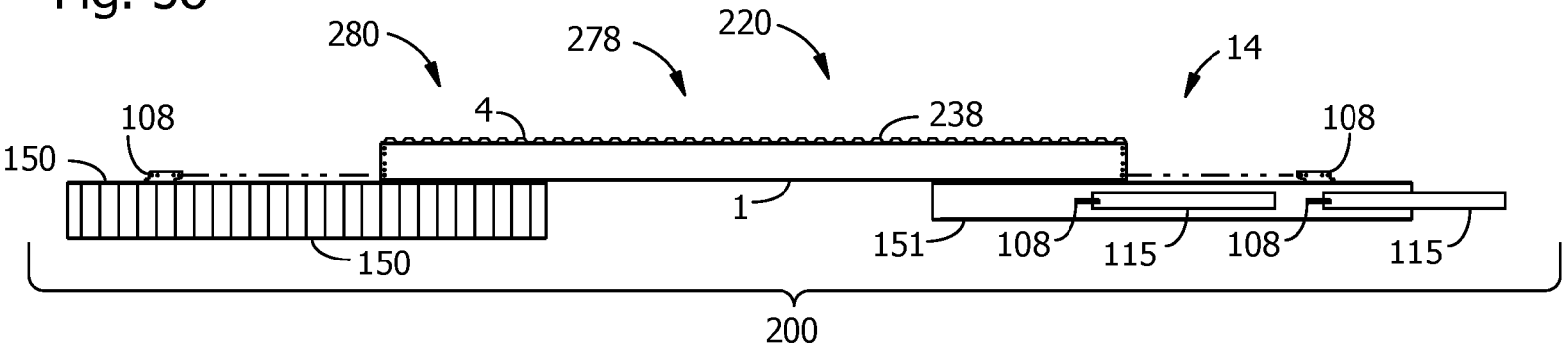
FIG. 58 is an alternative form of the frame assembly of 48 having one deck assembly, further illustrating an example of a folded frame configuration.

The frame assembly 14 in its folded frame configuration is shown loaded aboard a conveyance 3 in the side view of FIG. 54 and the end view of FIG. 55. Like the other frame assembly embodiments disclosed herein, the frame assembly 14 of FIG. 51 is well suited to being fabricated at a frame assembly manufacturing location different from the construction location of a building frame including more than one of the frame assemblies. FIG. 56 and FIG. 57 continue the example of FIG. 54 and FIG. 55, showing the frame assembly unfolding as it is lifted from the conveyance 3.

FIGS. 51-57 further illustrate examples of a frame assembly 14 having a vertical support member 292 implemented as a hollow rectangular structure 150 for forming a concrete wall. The hollow HSS tube 150, also referred to as a concrete form 150, preferably extends in a lateral direction from the longitudinal frame member along a side of the deck assembly to the longitudinal frame member on the opposite side of the deck assembly. The concrete form 150 optionally includes two rectangular metal plates separated from one another by intervening metal bars affixed to the plates. A frame assembly 14 including a concrete form 150 is configured for forming a frame assembly with a shear wall 280. Vertical support connectors 108 affixed to the metal plates establish the locations of rotatable connections to the vertical support members. After being affixed to a building frame, the HSS columns 151 and/or the concrete form 150 may be filled with concrete 168.

The example concrete form 150 in FIG. 51 has a transverse dimension 162 approximately equal to the transverse dimension 162 of the deck assemblies 238. A concrete form 150 may alternatively have a transverse dimension that is substantially larger or substantially smaller than the transverse dimension of an attached deck assembly.

Figure 59:
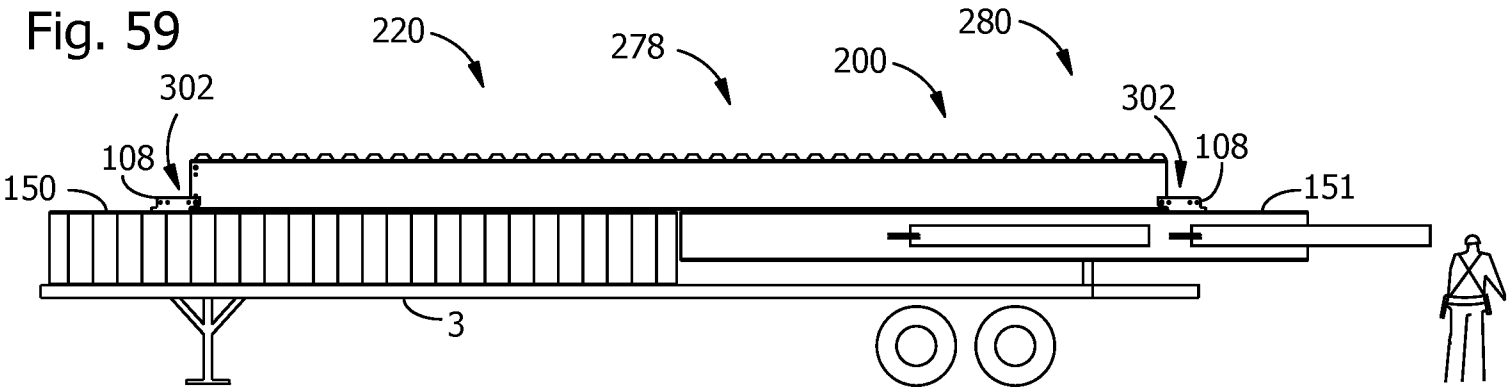
FIG. 59 shows a side view of an alternative folded frame configuration of the example frame assembly of FIG. 58, with the frame assembly loaded on a trailer.
Figure 60:
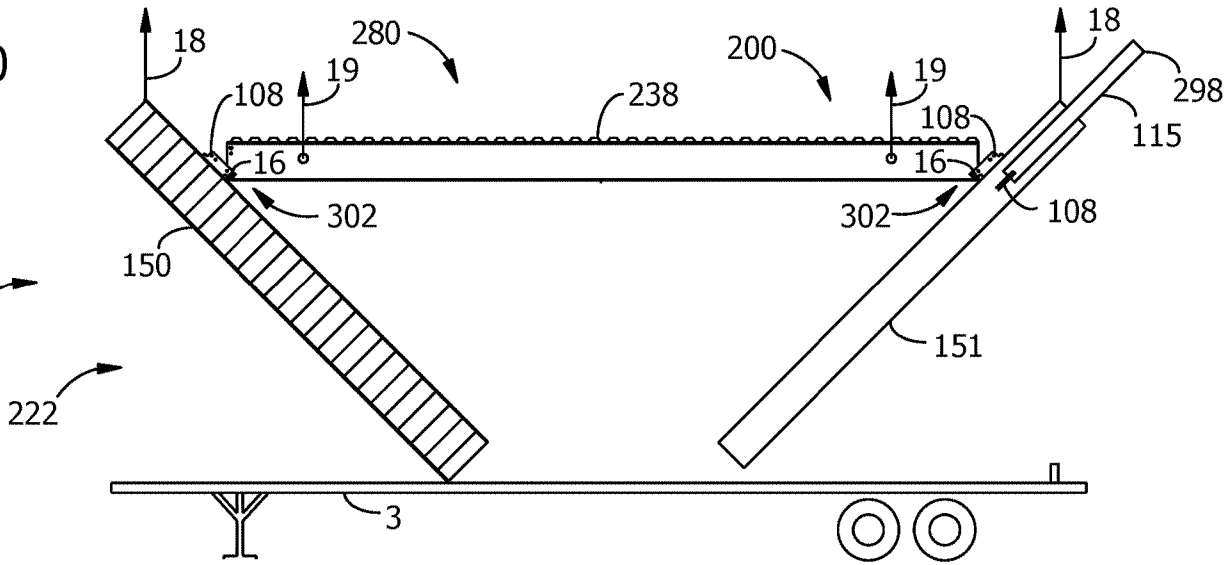
FIG. 60 is a side view of a partially unfolded configuration of the frame assembly of FIG. 58 and FIG. 59.
Figure 61:
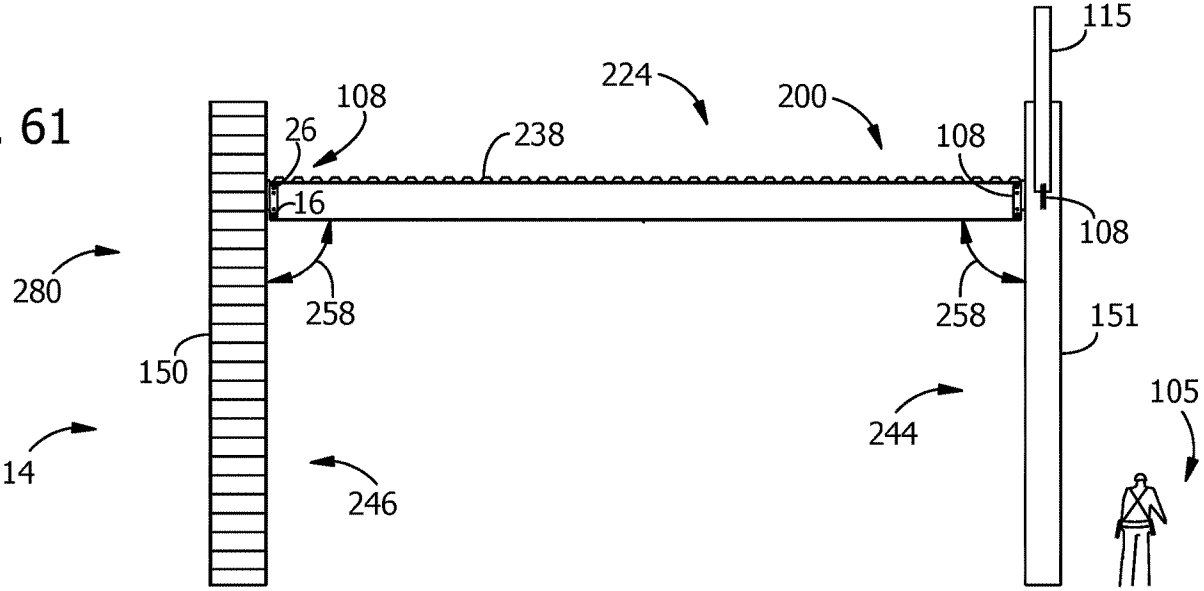
FIG. 61 is a side view showing the first, second, and third vertical support members of the example frame assembly of FIGS. 58-60 in a fully unfolded configuration and the example transverse beam folded parallel to the vertical support member.

Any of the example frame embodiments disclosed herein may be provided as a one-deck frame assembly as shown for example in FIGS. 58-62. An example one-deck assembly 278 having vertical support connectors 108 coupling vertical support members to longitudinal frame members 1 is shown in a first example folded frame configuration in FIG. 58 and a second, alternative folded frame configuration loaded aboard a conveyance 3 in FIG. 59. FIG. 60 continues the example of FIG. 59, showing the one-deck frame assembly unfolding to a partially unfolded frame configuration as the frame assembly is lifted from the conveyance. The one-deck frame assembly 278 is shown in a fully unfolded frame configuration 224 in FIG. 61.

Figure 63:
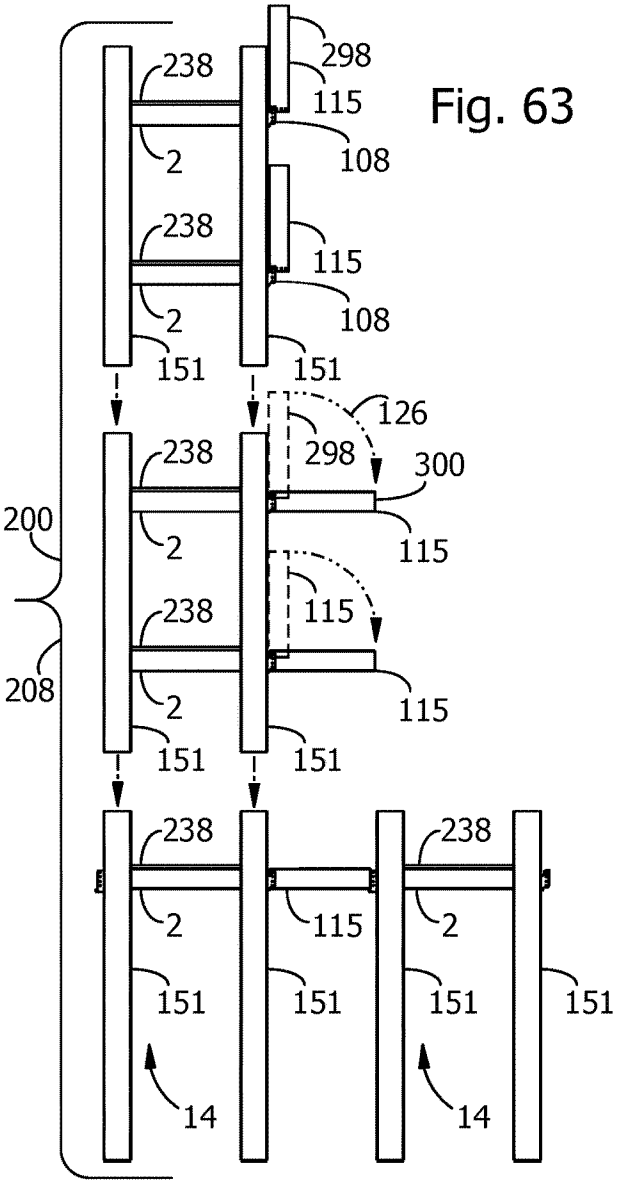
FIG. 63 is a partially exploded end view of the example building frame of FIG. 62.
Figure 62:
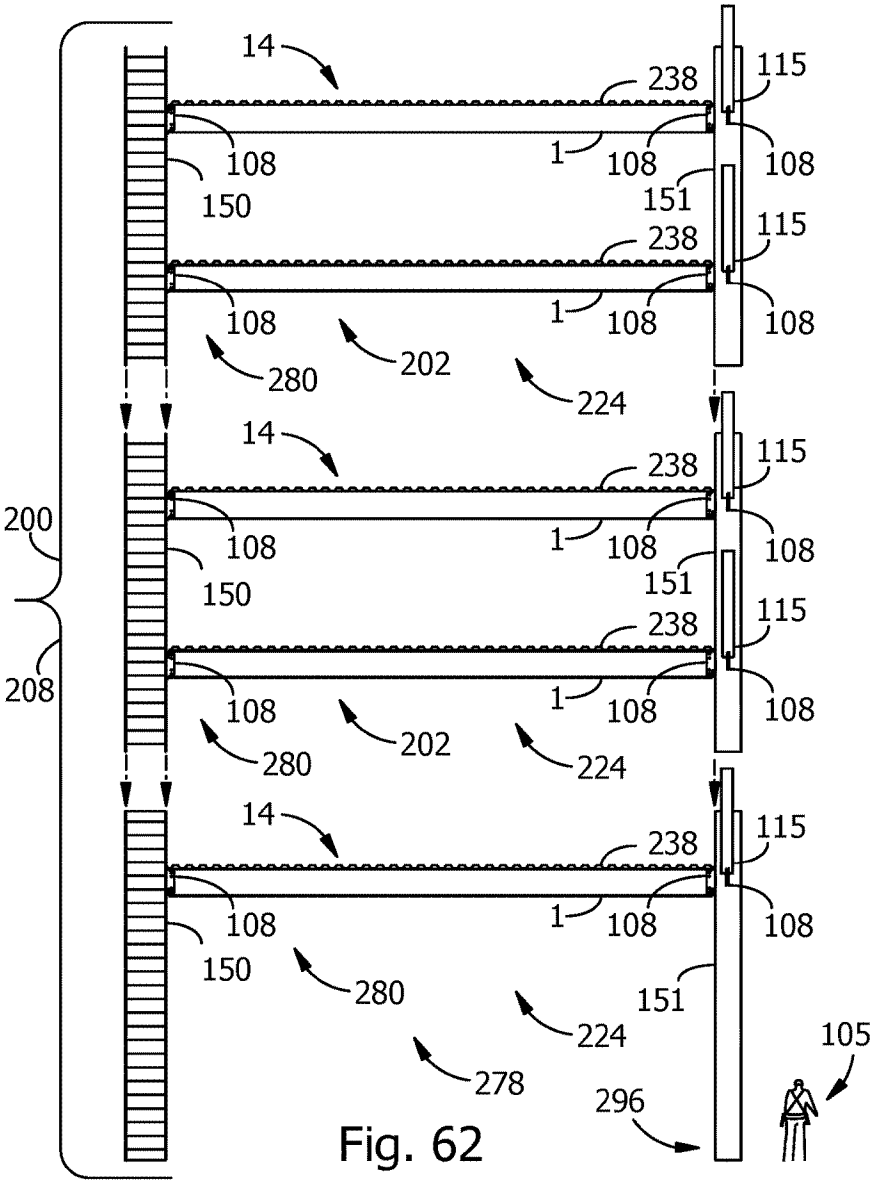
FIG. 62 shows a partially exploded side view of an example building frame being assembled from one one-deck and two two-deck frame assemblies from the examples of FIGS. 51-61.

An example building frame 208 in accord with an embodiment 200 is shown an exploded side view in FIG. 62 and an exploded end view in FIG. 63. The example building frames 208 include frame assemblies with shear walls 208. The lowest frame assemblies in each figure are configured as a one-deck frame assembly 278. Higher frame assemblies are examples of 2-deck frame assemblies 202, although frame assemblies with different numbers of deck assemblies 238 may be used.

Figure 64:
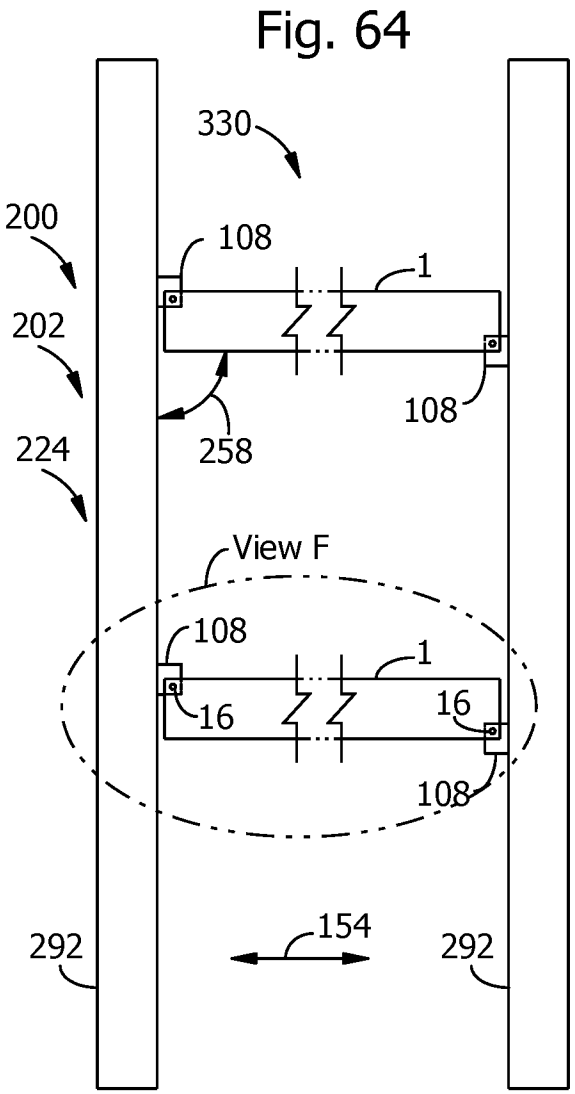
FIG. 64 is a schematic view of example preferred areas for location of hinge points for alternative hinge devices configured for rotatably connecting the longitudinal frame members of a frame assembly to the vertical support members.
Figure 65:
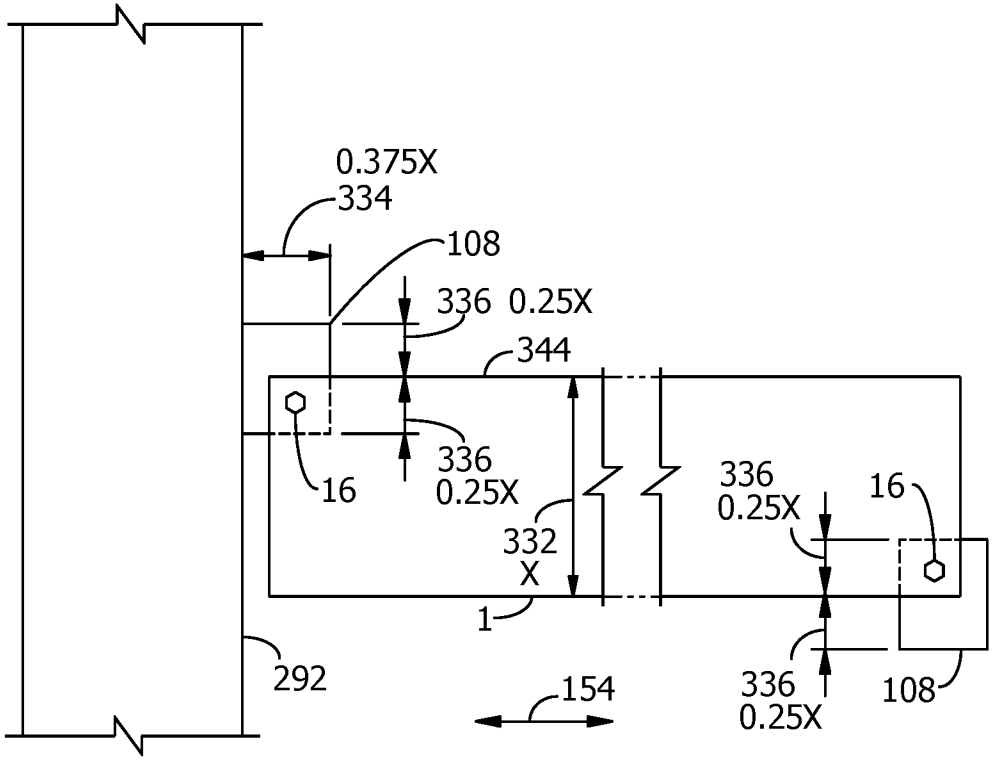
FIG. 65 is an enlarged view F of some details of the connections shown in FIG. 61. The location of view F is marked by a broken circle in FIG. 64.

Some embodiments 200 include a frame assembly 14 having rotatable connections 302 positioned at opposite diagonal corners of the longitudinal frame members, as suggested in the examples of FIGS. 64-65. The rotatable connections are represented in the figures by a vertical support connector 108 configured to receive a hinge bolt 16 passing through apertures formed in the vertical support connector and apertures formed near the corners at the ends of the longitudinal frame members. The vertical support connectors 108 are affixed to vertical support members 292.

View F in FIG. 62 shows examples of preferred positions for a hinge bolt 16 relative to edges of the vertical support connector 108 and the edges of a beam 1 rotatably connected to the vertical support member 292 at the vertical support connector. Preferred dimensions are expressed in the example of FIG. 62 as a ratio relative to a width dimension X 332 of a longitudinal frame member or other rotatably-connected frame member. A preferred maximum longitudinal separation distance 334 of the hinge bolt 16 from the vertical support member 292 has a value expressed as 0.375X (the mathematical product of 0.375 and the width dimension X) as marked at separation distance 334. A preferred maximum separation distance 336 of the hinge bolt 16 from the top edge 344 of the horizontal member rotatably connected to the vertical support member 292 is 0.25X as marked at separation distance 336. Rotatable columns around beam ends may have different types of hinged connections so long as the hinge point is within the boundary areas shown in FIGS. 61-64.

Unless expressly stated otherwise herein, ordinary terms have their corresponding ordinary meanings within the respective contexts of their presentations, and ordinary terms of art have their corresponding regular meanings.

What is claimed is:

1. A frame assembly for a building, comprising:

a deck assembly, comprising:

a first end, a second end longitudinally opposite said first end, a first side extending from said first end to said second end, and a second side transversely opposite said first side;

a first longitudinal frame member extending along said first side from said first end to said second end;

a second longitudinal frame member extending along said second side from said first end to said second end;

a metal deck positioned in contact with said first longitudinal frame member and said second longitudinal frame member, said metal deck extending from said first end to said second end;

a first vertical support member rotatably coupled to said first longitudinal frame member;

a second vertical support member rotatably coupled to said second longitudinal frame member transversely opposite said first vertical support member; and a third vertical support member rotatably coupled to said first longitudinal frame member said first longitudinal frame member and said second longitudinal frame member each including a beam web;

a fourth vertical support member rotatably coupled to said second longitudinal frame member; said first, second, third, and fourth vertical support members each including a column flange and a column web joined to said column flange;

a hinge bolt passing through said column flange of said first vertical support member and said beam web of said first longitudinal frame member;

a second hinge bolt passing through said column flange of said second vertical support member and said beam web of said second longitudinal frame member;

a third hinge bolt passing through said column flange of said third vertical support member and said beam web of said first longitudinal frame member; and a fourth hinge bolt passing through said column flange of said fourth vertical support member and said beam web of said second longitudinal frame member;

said deck assembly is a first deck assembly; and a second deck assembly rotatably coupled to said frame assembly between said first deck assembly and an upper end of said first vertical support member.

2. The frame assembly for a building of claim 1, further comprising:

a fifth hinge bolt passing through said column flange of said first vertical support member and said beam web of said first longitudinal frame member of said second deck assembly;

a sixth hinge bolt passing through said column flange of said second vertical support member and said beam web of said second longitudinal frame member of said second deck assembly;

a seventh hinge bolt passing through said column flange of said third vertical support member and said beam web of said first longitudinal frame member of said second deck assembly; and an eighth hinge bolt passing through said column flange of said fourth vertical support member and said beam web of said second longitudinal frame member of said second deck assembly.

3. The frame assembly for a building of claim 1, further comprising a third deck assembly rotatably coupled to said frame assembly between said second deck assembly and said upper end of said first vertical support member.

4. The frame assembly for a building of claim 1, wherein said first deck assembly forms a part of a building floor, said second deck assembly forms a part of a next higher building floor, and said first longitudinal frame member of said first deck assembly is parallel to said first longitudinal frame member of said second deck assembly.

5. The frame assembly of claim 1, wherein said first deck assembly forms a part of a building floor, said second deck assembly includes a waterproof roof membrane; and said second deck assembly forms a part of a building roof.

6. The frame assembly of claim 1, further comprising a brace rotatably coupled to said first longitudinal frame member of said first deck assembly, said brace extending to said first longitudinal frame member of said second deck assembly.

7. The frame assembly of claim 1, further comprising a folded frame configuration with said second deck assembly in contact with said first deck assembly.

8. The frame assembly of claim 1, further comprising a fully unfolded frame configuration with said first and third vertical support members perpendicular to said first longitudinal frame member of said first deck assembly and said second and fourth vertical support members perpendicular to said second longitudinal frame member of said first deck assembly.

9. The frame assembly of claim 8, said fully unfolded frame configuration further comprising:

said first longitudinal frame member of said first deck assembly positioned parallel to a horizontal reference; and said first longitudinal frame member of said second deck assembly tilted to an angle greater than one degree relative to said horizontal reference.

10. The frame assembly of claim 8, said fully unfolded frame configuration further comprising:

a first bolt passing through said column flange of said first vertical support member and said beam web of said first longitudinal frame member of said first deck assembly;

a second bolt passing through said column flange of said second vertical support member and said beam web of said second longitudinal frame member of said first deck assembly;

a third bolt passing through said column flange of said third vertical support member and said beam web of said first longitudinal frame member of said first deck assembly; and a fourth bolt passing through said column flange of said fourth vertical support member and said beam web of said second longitudinal frame member of said first deck assembly, wherein said first, second, third, and fourth bolts nonrotatably affix said first, second, third, and fourth vertical support members to said first deck assembly.

11. The frame assembly of claim 1, wherein said first vertical support member and said second vertical support member are rotatably coupled to said first deck assembly at a separation distance from said first end in a range from one-quarter to one-half a longitudinal dimension of said first deck assembly, thereby forming a cantilevered segment of said first deck assembly.

12. The frame assembly of claim 11, wherein said frame assembly is a first frame assembly, and further comprising a second of said frame assembly affixed to said first frame assembly.

13. The frame assembly of claim 12, wherein:

said fourth vertical support member of said first frame assembly is affixed to a cantilevered segment of said second frame assembly;

said second vertical support member of said first frame assembly is affixed to a second longitudinal frame member of said second frame assembly between said second vertical support member and a fourth vertical support member of said second frame assembly; and said fourth vertical support member of said second frame assembly is affixed to said cantilevered segment of said first frame assembly.

14. The frame assembly of claim 1, wherein said frame assembly is a first frame assembly, and further comprising a second of said frame assembly affixed to said first frame assembly with said upper end of said first vertical support member of said first frame assembly attached to a lower end of said first vertical support member of said second frame assembly.

15. The frame assembly of claim 1, wherein said deck assembly further comprises:

a first transverse frame member attached at said first end to said first longitudinal frame member and said second longitudinal frame member; and a second transverse frame member attached at said second end to said first longitudinal frame member and said second longitudinal frame member.

16. The frame assembly of claim 1, further comprising a vertical support connector, said vertical support connector comprising:

a connector plate;

a hinge bolt aperture formed through said connector plate;

a bolt aperture formed through said connector plate;

a flange gap formed in said connector plate; and a flange stop formed on said connector plate at an end opposite said flange gap.

17. The frame assembly of claim 16, further comprising:

a first of said vertical support connector strongly affixed to said column flange of said first vertical support member, said hinge bolt passing through said hinge bolt aperture of said first vertical support connector and said beam web of said first longitudinal frame member;

a second of said vertical support connector strongly affixed to said column flange of said second vertical support member, said second hinge bolt passing through said hinge bolt aperture of said second vertical support connector and said beam web of said second longitudinal frame member;

a third of said vertical support connector strongly affixed to said column flange of said third vertical support member, said third hinge bolt passing through said hinge bolt aperture of said third vertical support connector and said beam web of said first longitudinal frame member; and a fourth of said vertical support connector strongly affixed to said column flange of said fourth vertical support member, said fourth hinge bolt passing through said hinge bolt aperture of said fourth vertical support connector and said beam web of said second longitudinal frame member.

18. The frame assembly of claim 17, further comprising:

a transverse beam comprising a beam flange and a beam web attached to said beam flange; and a fifth of said vertical support connector strongly affixed to said column web of said first vertical support member, another of said hinge bolt passing through said hinge bolt aperture of said fifth vertical support connector and said beam web of said transverse beam.

19. The frame assembly of claim 18, further comprising:

a first centerline passing midway through a thickness dimension of said column web of said first vertical support member;

a second centerline passing midway through a thickness dimension of said beam web of said transverse beam; and said fifth column connector positioned on said first vertical support member with said first centerline colinear with said second centerline.

20. The frame assembly of claim 17, further comprising:

a first centerline passing midway through a thickness dimension of said column web of said first vertical support member;

a second centerline passing midway through a thickness dimension of said beam web of said first longitudinal frame member; and said first vertical support connector positioned on said first vertical support member with said first centerline colinear with said second centerline.

21. The frame assembly of claim 1, further comprising:

said first longitudinal frame member and said second longitudinal frame member each including a beam web;

said first vertical support member and said second vertical support member each formed as a cylinder;

a vertical support connector, comprising:

a connector plate;

a hinge bolt aperture formed through said connector plate;

a bolt aperture formed through said connector plate;

a flange gap formed in said connector plate; and a flange stop formed on said connector plate at an end opposite said flange gap;

a first of said vertical support connector strongly affixed to said first vertical support member with a first hinge bolt passing through said hinge bolt aperture of said first vertical support connector and said beam web of said first longitudinal frame member; and a second of said vertical support connector strongly affixed to said second vertical support member with a second hinge bolt passing through said hinge bolt aperture of said second vertical support connector and said beam web of said second longitudinal frame member.

22. The frame assembly of claim 21, further comprising:

a first centerline passing through a radial center of said first vertical support member;

a second centerline passing midway through a thickness dimension of said beam web of said first longitudinal frame member; and said first vertical support connector positioned on said first vertical support member with said first centerline colinear with said second centerline.

23. The frame assembly of claim 21, further comprising:

said third vertical support member comprises a hollow form for a concrete wall, said third vertical support member extending transversely from said first longitudinal frame member to said second longitudinal frame member;

a third of said vertical support connector strongly affixed to said third vertical support member and rotatably coupled to said beam web of said first longitudinal frame member; and a fourth of said vertical support connector strongly affixed to said third vertical support member and rotatably coupled to said beam web of said second longitudinal frame member.

24. The frame assembly of claim 23, wherein said frame assembly is a first frame assembly, and further comprising a second of said frame assembly affixed to said first frame assembly with said first vertical support member of said first frame assembly affixed to said first vertical support member of said second frame assembly, said second vertical support member of said first frame assembly affixed to said second vertical support member of said second frame assembly, and said third vertical support member of said first frame assembly affixed to said third vertical support member of said second frame assembly.

25. The frame assembly of claim 21, further comprising:

said longitudinal frame members having a width dimension; and said hinge bolt passing through said vertical support connector and said longitudinal frame member a maximum longitudinal distance equal to a mathematical product of 0.375 and said width dimension of said longitudinal frame member.

26. The frame assembly of claim 25, further comprising said hinge bolt passing through said vertical support member and said longitudinal frame member a maximum vertical distance equal to a mathematical product of 0.25 and said width dimension of said longitudinal frame member.

27. The frame assembly of claim 1, further comprising a transverse frame member affixed to said first vertical support member and said second vertical support member.

* * * * *